US011932356B1

(12) United States Patent
Ramsdell et al.

(10) Patent No.: US 11,932,356 B1
(45) Date of Patent: Mar. 19, 2024

(54) POWERED SWIM PLATFORM

(71) Applicant: Malibu Boats, LLC, Loudon, TN (US)

(72) Inventors: Lyle Andrew Ramsdell, Lenoir City, TN (US); Nicolas Ballesteros Velasco, Independence, KS (US)

(73) Assignee: Malibu Boats, LLC, Loudon, TN (US)

( * ) Notice: Subject to any disclaimer, the term of this patent is extended or adjusted under 35 U.S.C. 154(b) by 184 days.

(21) Appl. No.: 17/409,277

(22) Filed: Aug. 23, 2021

Related U.S. Application Data

(60) Provisional application No. 63/069,465, filed on Aug. 24, 2020.

(51) Int. Cl.
*B63B 3/48* (2006.01)

(52) U.S. Cl.
CPC ..... *B63B 3/48* (2013.01); *B63B 2003/485* (2013.01)

(58) Field of Classification Search
CPC ..... B63B 3/48; B63B 3/142; B63B 2003/485
USPC ..... 114/343, 362, 364
See application file for complete search history.

(56) References Cited

U.S. PATENT DOCUMENTS

| | | | |
|---|---|---|---|
| 369,129 | A | 8/1887 | Sheldon |
| 667,482 | A | 2/1901 | Albarda |
| 704,729 | A | 7/1902 | Zerbe |
| 1,196,682 | A | 8/1916 | Harriss |
| 1,264,320 | A | 4/1918 | Metzler |
| 2,081,868 | A | 5/1937 | Hampden |
| 2,174,622 | A | 10/1939 | Dale |
| 2,199,333 | A | 4/1940 | Dunklin |
| 2,158,949 | A | 1/1950 | Sarles et al. |
| 2,493,639 | A | 1/1950 | Pellegrini |
| 2,663,276 | A | 12/1953 | Ouellet |
| 2,807,228 | A | 9/1957 | Vandre |
| 2,809,849 | A | 10/1957 | Benne |
| 2,825,582 | A | 3/1958 | McDonald |
| 2,832,304 | A | 4/1958 | Elyosius et al. |
| 2,890,673 | A | 6/1959 | Chadwick, Jr. |
| 2,994,290 | A | 8/1961 | Merchant, Sr. |
| 2,998,791 | A | 9/1961 | Light |
| 3,046,928 | A | 7/1962 | Sherrill |
| 3,062,167 | A | 11/1962 | Bennett |
| 3,079,885 | A | 3/1963 | Cooke |
| 3,094,960 | A | 6/1963 | Lang |

(Continued)

FOREIGN PATENT DOCUMENTS

| | | |
|---|---|---|
| CA | 2271332 | 2/2000 |
| CN | 2597328 | 1/2004 |

(Continued)

OTHER PUBLICATIONS

Ex Parte Reexamination of U.S. Pat. No. 9,260,161 (U.S. Appl. No 90/013,819), filed Sep. 26, 2016, Gasper et al.

(Continued)

*Primary Examiner* — Daniel V Venne
(74) *Attorney, Agent, or Firm* — Knobbe Martens Olson & Bear, LLP

(57) ABSTRACT

A powered swim platform for improving accessibility to a swim deck of a water-sports boat or other watercraft. The powered swim platform includes a platform driven by an actuator. The actuator can rotate the platform between stowed and deployed configurations to assist a user in mounting or dismounting the swim deck of the water-sports boat or other watercraft.

29 Claims, 43 Drawing Sheets

(56) References Cited

U.S. PATENT DOCUMENTS

| | | | |
|---|---|---|---|
| 3,106,178 | A | 10/1963 | Cale |
| 3,111,103 | A | 11/1963 | Bennett |
| 3,159,134 | A | 12/1964 | Winnen |
| 3,174,166 | A | 3/1965 | Ehrenberg et al. |
| 3,195,680 | A | 7/1965 | Thornburg et al. |
| 3,200,782 | A | 8/1965 | Walden et al. |
| 3,247,820 | A | 4/1966 | White |
| 3,259,097 | A | 7/1966 | Veldhuizen et al. |
| 3,294,052 | A | 12/1966 | Jones |
| 3,305,045 | A | 2/1967 | Schlecht |
| 3,327,671 | A | 6/1967 | Comins |
| 3,372,663 | A | 3/1968 | Bue |
| 3,391,667 | A | 7/1968 | Bue |
| 3,394,947 | A | 7/1968 | Strube |
| 3,399,643 | A | 9/1968 | Bennett |
| 3,456,610 | A | 7/1969 | Beals |
| 3,456,611 | A | 7/1969 | Johnson |
| 3,501,190 | A | 3/1970 | McCrea |
| 3,507,515 | A | 4/1970 | Brammer |
| 3,577,948 | A | 5/1971 | Frey |
| 3,580,613 | A | 5/1971 | Northrop |
| 3,613,137 | A | 10/1971 | Eccles |
| 3,627,350 | A | 12/1971 | Cross |
| 3,628,484 | A | 12/1971 | Banner |
| 3,628,486 | A | 12/1971 | Bennett |
| 3,628,487 | A | 12/1971 | Bennett |
| 3,650,310 | A | 3/1972 | Childress |
| 3,670,685 | A | 6/1972 | Milessa |
| 3,695,204 | A | 10/1972 | Bennett |
| 3,698,343 | A | 10/1972 | Boome |
| 3,716,254 | A | 2/1973 | Tarvin |
| 3,756,622 | A | 9/1973 | Pyle |
| 3,760,759 | A | 9/1973 | Lang |
| 3,763,812 | A | 10/1973 | Rowe |
| 3,774,720 | A | 11/1973 | Hovey |
| 3,799,288 | A | 3/1974 | Manuel |
| 3,825,097 | A | 7/1974 | Owen |
| 3,861,713 | A | 1/1975 | McKee |
| 3,862,456 | A | 1/1975 | Fihser et al. |
| 3,892,290 | A | 7/1975 | Lang |
| 3,927,903 | A | 12/1975 | Jones |
| 3,982,493 | A | 9/1976 | Cronin |
| 3,986,503 | A | 10/1976 | Le Guillon |
| 4,021,071 | A | 5/1977 | Norman |
| 4,030,436 | A | 6/1977 | Stoberl |
| 4,174,115 | A | 11/1979 | Younblood |
| 4,178,871 | A | 12/1979 | Hirsch |
| 4,191,388 | A | 3/1980 | Barksdale |
| 4,193,477 | A | 3/1980 | Broyles |
| 4,194,754 | A | 3/1980 | Hightower |
| 4,198,070 | A | 4/1980 | Weiler |
| 4,232,626 | A | 11/1980 | Kern |
| 4,237,808 | A | 12/1980 | Doerffer |
| 4,261,278 | A | 4/1981 | Gaudin |
| 4,275,664 | A | 6/1981 | Reddy |
| 4,293,967 | A | 10/1981 | Ord |
| 4,391,453 | A | 7/1983 | Glaser |
| 4,432,436 | A | 2/1984 | Suiter |
| 4,434,738 | A | 3/1984 | Barkemeyer |
| 4,442,787 | A | 4/1984 | Curran et al. |
| 4,462,485 | A | 7/1984 | Terry et al. |
| 4,495,883 | A | 1/1985 | Hoy |
| 4,556,125 | A | 12/1985 | Johnson |
| 4,577,580 | A | 3/1986 | Diffely, Sr. |
| 4,597,742 | A | 7/1986 | Finkl |
| 4,605,098 | A | 9/1986 | Leuty |
| 4,644,893 | A | 2/1987 | Zepp |
| 4,669,414 | A | 6/1987 | Molino |
| 4,712,503 | A | 12/1987 | Ritten |
| 4,718,872 | A | 1/1988 | Olson et al. |
| 4,722,419 | A | 2/1988 | Hoszowski |
| 4,724,925 | A | 2/1988 | Ritten |
| 4,726,317 | A | 2/1988 | Ritten et al. |
| 4,742,795 | A | 5/1988 | DePrey et al. |
| 4,750,753 | A | 6/1988 | Dezern |
| 4,763,219 | A | 8/1988 | Nakamura |
| 4,765,438 | A | 8/1988 | Ritten |
| 4,776,295 | A | 10/1988 | Kline et al. |
| 4,799,447 | A | 1/1989 | Herbet et al. |
| 4,819,987 | A | 4/1989 | Stringer |
| 4,823,910 | A | 4/1989 | Day |
| 4,846,487 | A | 7/1989 | Criley |
| 4,854,259 | A | 8/1989 | Cluett |
| D304,573 | S | 11/1989 | Hoszowski |
| 4,895,093 | A | 1/1990 | Dalsbo |
| 4,907,673 | A | 3/1990 | Ginter et al. |
| 4,910,419 | A | 3/1990 | Hayashi et al. |
| 4,915,048 | A | 4/1990 | Stanford |
| 4,926,965 | A | 5/1990 | Fox |
| 4,930,797 | A | 6/1990 | Parrill |
| 4,964,358 | A | 10/1990 | Sandrow |
| 4,967,682 | A | 11/1990 | O'Donnell |
| 4,993,109 | A | 2/1991 | Stevens |
| 5,014,640 | A | 5/1991 | Owen |
| 5,025,747 | A | 6/1991 | Grayson |
| 5,028,063 | A | 7/1991 | Andrews |
| 5,039,119 | A | 8/1991 | Baughman |
| 5,041,040 | A | 8/1991 | Jones et al. |
| 5,058,520 | A | 10/1991 | Fahrney |
| 5,085,164 | A | 2/1992 | Whitton |
| 5,111,908 | A | 5/1992 | Reiter et al. |
| 5,113,780 | A | 5/1992 | Bennett et al. |
| 5,123,372 | A | 6/1992 | Kobayashi |
| 5,142,473 | A | 8/1992 | Davis |
| 5,152,244 | A | 10/1992 | Jarmillo |
| 5,193,478 | A | 3/1993 | Mardikian |
| 5,222,456 | A | 6/1993 | Friedrich |
| 5,224,436 | A | 7/1993 | Stricker |
| 5,235,926 | A | 8/1993 | Jones |
| 5,263,432 | A | 11/1993 | Davis |
| 5,294,175 | A | 3/1994 | Elton |
| 5,315,951 | A | 5/1994 | Finkl |
| 5,359,956 | A | 11/1994 | Lee |
| 5,377,610 | A | 1/1995 | Goebel |
| 5,385,110 | A | 1/1995 | Bennet et al. |
| 5,435,260 | A | 7/1995 | Granie et al. |
| 5,445,100 | A | 8/1995 | Finkl |
| 5,458,080 | A | 10/1995 | Jaramillo, Sr. |
| 5,474,012 | A | 12/1995 | Yamada et al. |
| 5,474,013 | A | 12/1995 | Wittmaier |
| 5,537,949 | A | 7/1996 | Blevins et al. |
| 5,549,071 | A | 8/1996 | Pigeon et al. |
| 5,549,312 | A | 8/1996 | Garvert |
| 5,560,679 | A | 10/1996 | Barnholdt |
| 5,572,944 | A | 11/1996 | Slikkers et al. |
| 5,584,733 | A | 12/1996 | Kobayashi |
| 5,613,462 | A | 3/1997 | Schwartz |
| 5,628,272 | A | 5/1997 | Thomas |
| 5,632,224 | A | 5/1997 | Schneider |
| 5,647,632 | A | 7/1997 | Fireman |
| 5,664,910 | A | 9/1997 | Lochtefeld et al. |
| 5,694,337 | A | 12/1997 | Macken |
| 5,732,996 | A | 3/1998 | Graffy |
| 5,787,835 | A | 8/1998 | Remnant |
| 5,788,311 | A | 8/1998 | Tibbals |
| 5,803,475 | A | 11/1998 | Dick |
| 5,829,380 | A | 11/1998 | Smith |
| 5,860,384 | A | 1/1999 | Castillo |
| 5,860,766 | A | 1/1999 | Lochtefeld et al. |
| 5,881,666 | A | 3/1999 | Crews, Jr. |
| 5,887,540 | A | 3/1999 | Krish, Jr. |
| 5,911,190 | A | 6/1999 | Lochtefeld et al. |
| 5,927,433 | A | 7/1999 | Jaramillo, Sr. |
| 5,970,905 | A | 10/1999 | Jaramillo, Sr. |
| 5,970,906 | A | 10/1999 | Hrescak |
| 6,006,689 | A | 12/1999 | Olofsson |
| 6,012,408 | A | 1/2000 | Castillo |
| 6,019,050 | A | 2/2000 | Ranta |
| 6,021,733 | A | 2/2000 | Jaramillo |
| 6,026,759 | A | 2/2000 | Hazelett et al. |
| 6,044,788 | A | 4/2000 | Larson et al. |
| 6,047,657 | A | 4/2000 | Cox |
| 6,058,875 | A | 5/2000 | Krish |
| 6,082,751 | A | 7/2000 | Hanes |

(56) References Cited

U.S. PATENT DOCUMENTS 6,098,566 A 8/2000 Metcalf
6,105,527 A 8/2000 Lochtefeld et al.
6,119,615 A 9/2000 Porat
6,119,809 A 9/2000 McClendon
6,138,601 A 10/2000 Anderson et al.
6,145,865 A 11/2000 Cannara
6,148,756 A 11/2000 Pavlov et al.
6,158,375 A 12/2000 Stuart, Jr.
6,167,830 B1 1/2001 Pilger
6,170,093 B1 1/2001 Kowalski
6,170,842 B1 1/2001 Mueller
6,182,598 B1 2/2001 Bozzo
6,213,044 B1 4/2001 Rodgers et al.
6,213,486 B1 4/2001 Kunz
6,234,099 B1 5/2001 Jessen et al.
6,270,106 B1 8/2001 Maki
6,354,237 B1 3/2002 Gaynor et al.
6,415,729 B1 7/2002 Nedderman, Jr. et al.
6,427,616 B1 8/2002 Hagen
6,520,104 B1 2/2003 Svensson
6,523,489 B2 2/2003 Simard et al.
6,523,490 B1 2/2003 Watkins
6,533,303 B1 3/2003 Watson
6,578,510 B1 6/2003 Scruggs
6,588,839 B1 7/2003 Salzer
6,603,402 B2 8/2003 Lentine et al.
6,606,959 B1 8/2003 Shen
6,631,938 B1 10/2003 Burns
6,745,715 B1 6/2004 Shen et al.
6,782,839 B1 8/2004 Nozaki
6,793,039 B2 9/2004 Schmid
6,827,031 B2 12/2004 Aoyama
6,874,441 B2 4/2005 Pigeon
6,904,863 B2 6/2005 Mardikian et al.
6,905,158 B1 6/2005 Bastian
6,923,136 B1 8/2005 D'Alessandro
6,935,263 B1 8/2005 Bandyopadhyay
6,941,884 B2 9/2005 Moore
6,942,272 B2 9/2005 Livingston
6,953,002 B2 10/2005 Jessen et al.
7,004,097 B2 2/2006 Zeromski
7,007,621 B1 3/2006 Bootes
7,018,252 B2 3/2006 Simard et al.
7,055,838 B2 6/2006 Lambie
7,059,648 B2 6/2006 Livingston
7,063,031 B2 6/2006 Earl, Jr. et al.
7,121,226 B2 10/2006 Grimaldi
7,140,318 B1 11/2006 Gasper
7,162,969 B2 1/2007 Houlder et al.
7,174,843 B1 2/2007 Tossavainen
7,182,175 B1 2/2007 Schmitt et al.
7,188,581 B1 3/2007 Davis et al.
7,201,111 B1 4/2007 Burkett
7,210,422 B1 5/2007 Hickok et al.
7,216,601 B1 5/2007 Mann
7,237,503 B2 7/2007 Stepp
7,246,565 B2 7/2007 Snook et al.
7,252,047 B1 8/2007 Baucom, Jr.
7,252,074 B2 8/2007 Chapman et al.
7,293,521 B1 11/2007 Johns et al.
7,311,058 B1 12/2007 Brooks et al.
7,314,019 B1 1/2008 Curi et al.
7,318,389 B2 1/2008 Boning
7,341,016 B2 3/2008 Terleski et al.
7,377,563 B1 5/2008 Demick
7,380,514 B2 6/2008 Loui et al.
7,381,108 B1 6/2008 Salmon
7,401,833 B2 7/2008 Dryja
7,410,031 B2 8/2008 Jensen
7,416,238 B2 8/2008 Houston
7,434,531 B1 10/2008 Zsido et al.
7,434,825 B2 10/2008 Williams
7,467,596 B2 12/2008 Salmon
7,497,748 B2 3/2009 Salmon
7,503,276 B1 3/2009 Curi et al.
7,607,400 B2 10/2009 Scotti
7,617,026 B2 11/2009 Gee et al.
7,641,525 B2 1/2010 Morvillo
7,707,956 B2 5/2010 Moore
7,735,441 B2 6/2010 Borum et al.
7,735,894 B2 6/2010 King et al.
7,766,357 B2 8/2010 Arvanites
7,780,490 B2 8/2010 Lundgren
7,896,419 B2 3/2011 Elliot et al.
7,900,575 B2 3/2011 Walbridge et al.
7,905,193 B2 3/2011 Beamer
7,958,837 B1 6/2011 Fraleigh
8,028,641 B1 10/2011 Sly
8,075,008 B1 12/2011 Hanser et al.
8,096,255 B2 1/2012 Morand et al.
8,100,079 B2 1/2012 Buzzi
8,191,493 B2 6/2012 Baywol
8,201,514 B2 6/2012 Coles
8,216,007 B2 7/2012 Moore
8,251,006 B2 8/2012 Kalil
8,261,682 B1 9/2012 DeVito
8,297,215 B1 10/2012 Chinn
8,327,790 B2 12/2012 Snow
8,336,477 B2 12/2012 Walker
8,375,880 B1 2/2013 St. Clair et al.
8,387,551 B2 3/2013 Muller
8,434,420 B2 5/2013 Muller
8,444,225 B2 5/2013 Behe
8,465,333 B2 6/2013 Sells
8,468,964 B2 6/2013 Hoberman et al.
8,479,677 B2 7/2013 Bolline et al.
8,480,445 B2 7/2013 Morvillo
8,522,706 B2 9/2013 Larson et al.
8,522,922 B1 9/2013 Stokes
8,523,285 B2 9/2013 Wihinen
8,534,214 B1 9/2013 Gasper
8,539,897 B1 9/2013 Gasper et al.
8,578,873 B2 11/2013 Gasper et al.
8,596,213 B2 12/2013 Greenwood et al.
8,622,012 B2 1/2014 Olofsson
8,631,753 B2 1/2014 Morvillo
8,636,110 B2 1/2014 Ebbenga et al.
8,646,400 B2 2/2014 Grimaldi
8,739,723 B1 6/2014 Murphy
8,795,012 B2 8/2014 Ooishi et al.
8,798,825 B1 8/2014 Hartman
D713,772 S 9/2014 Ziaylek
8,833,286 B1 9/2014 Sheedy et al.
8,905,354 B2 12/2014 Griffiths et al.
8,943,995 B2 2/2015 Muller
8,967,070 B2 3/2015 Kalil
8,968,043 B1 3/2015 Murphy
9,150,289 B1 10/2015 Brendel
9,156,372 B1 10/2015 Guglielmo et al.
9,199,695 B2 12/2015 Gasper et al.
9,254,896 B2 2/2016 Bertalan et al.
9,260,161 B2 2/2016 Gasper et al.
9,272,762 B1 3/2016 Murphy
9,315,235 B1 4/2016 Wood
9,315,236 B2 4/2016 Gasper
9,334,022 B2 5/2016 Gasper et al.
9,422,031 B2 8/2016 Roncarolo
9,475,548 B1 10/2016 Slocum
9,540,074 B1 1/2017 Pigeon
9,573,655 B1 2/2017 Pigeon
9,580,147 B2 2/2017 Gasper et al.
9,586,655 B1 * 3/2017 Butler ..... B63B 17/00
9,592,890 B2 3/2017 Christensen
D783,021 S 4/2017 Peel
9,611,006 B1 4/2017 Miller et al.
9,643,697 B2 5/2017 Sheedy et al.
9,669,903 B2 6/2017 Gasper et al.
9,694,873 B2 7/2017 Gasper et al.
9,891,620 B2 2/2018 Green et al.
9,914,504 B2 3/2018 Gasper et al.
9,926,043 B1 3/2018 Miller et al.
9,937,979 B1 * 4/2018 Holmes ..... B63B 29/02
10,086,913 B2 * 10/2018 Fafard ..... B63B 27/14
10,179,628 B2 1/2019 Gasper et al.

(56) References Cited

U.S. PATENT DOCUMENTS

| | | | |
|---|---|---|---|
| 10,202,171 | B1 | 2/2019 | Miller et al. |
| 10,308,321 | B1 | 6/2019 | Miller et al. |
| 10,322,777 | B2 | 6/2019 | Gasper et al. |
| 10,351,215 | B2 * | 7/2019 | Scozzoli ..... B63B 27/30 |
| 10,386,834 | B2 | 8/2019 | Green et al. |
| 10,399,645 | B1 * | 9/2019 | Holmes ..... B63B 27/146 |
| 10,668,991 | B1 | 6/2020 | Champlin et al. |
| 10,683,061 | B2 | 6/2020 | Gasper et al. |
| 10,858,068 | B1 | 12/2020 | Miller et al. |
| 11,067,979 | B2 | 7/2021 | Green et al. |
| 11,267,538 | B2 | 3/2022 | Ekern et al. |
| 11,332,219 | B2 | 5/2022 | Champlin et al. |
| 11,370,508 | B1 | 6/2022 | Dugger et al. |
| 11,383,795 | B2 * | 7/2022 | Giottoli ..... B63B 27/146 |
| 11,401,012 | B2 * | 8/2022 | Fafard ..... B63B 29/02 |
| 11,518,482 | B1 | 12/2022 | Dugger et al. |
| 11,572,136 | B2 | 2/2023 | Gasper et al. |
| 2002/0003340 | A1 | 1/2002 | Hallquist |
| 2002/0070577 | A1 | 6/2002 | Pool, III et al. |
| 2003/0070875 | A1 | 4/2003 | Medsker |
| 2004/0160079 | A1 | 8/2004 | Harper et al. |
| 2004/0256833 | A1 | 12/2004 | Cervenka |
| 2004/0261684 | A1 | 12/2004 | Pigeon |
| 2005/0046219 | A1 | 3/2005 | Livingston |
| 2005/0016439 | A1 | 6/2005 | Mardikian et al. |
| 2005/0124234 | A1 | 7/2005 | Sells et al. |
| 2005/0155540 | A1 | 7/2005 | Moore |
| 2006/0016047 | A1 | 1/2006 | Blackman et al. |
| 2006/0054067 | A1 | 3/2006 | Hoberman et al. |
| 2006/0217011 | A1 | 9/2006 | Morvillo |
| 2007/0078575 | A1 | 4/2007 | Wilson et al. |
| 2007/0125287 | A1 | 6/2007 | Walker |
| 2007/0137550 | A1 | 6/2007 | Davis et al. |
| 2007/0202757 | A1 | 8/2007 | Moore |
| 2008/0257245 | A1 | 10/2008 | Stella |
| 2008/0271660 | A1 | 11/2008 | Zsido et al. |
| 2008/0277958 | A1 | 11/2008 | King et al. |
| 2008/0281478 | A1 | 11/2008 | Gee et al. |
| 2009/0078188 | A1 | 3/2009 | Thomas |
| 2009/0165694 | A1 | 7/2009 | Beamer |
| 2010/0089697 | A1 | 4/2010 | Kreller |
| 2010/0101475 | A1 | 4/2010 | Mueller |
| 2010/0121493 | A1 | 5/2010 | Christensen et al. |
| 2010/0162938 | A1 | 7/2010 | Halfon |
| 2010/0251952 | A1 | 10/2010 | Baywol |
| 2011/0017115 | A1 | 1/2011 | Olofsson |
| 2011/0126751 | A1 | 6/2011 | Muller |
| 2011/0315063 | A1 | 12/2011 | Templeman et al. |
| 2011/0320072 | A1 | 12/2011 | Morvillo |
| 2012/0032418 | A1 | 2/2012 | Doucette et al. |
| 2012/0032490 | A1 | 2/2012 | Nowak et al. |
| 2012/0079977 | A1 | 4/2012 | Gai |
| 2013/0000542 | A1 | 1/2013 | Muller |
| 2013/0024074 | A1 | 1/2013 | Baur et al. |
| 2013/0145978 | A1 | 6/2013 | Viviani et al. |
| 2014/0026799 | A1 | 1/2014 | Kalil |
| 2015/0066249 | A1 | 3/2015 | Fieback et al. |
| 2016/0214681 | A1 | 7/2016 | Huyge et al. |
| 2017/0038771 | A1 | 2/2017 | Green et al. |
| 2017/0120986 | A1 | 5/2017 | Burnett et al. |
| 2021/0245838 | A1 | 8/2021 | Waters et al. |
| 2022/0075363 | A1 | 3/2022 | Green et al. |
| 2023/0043632 | A1 | 2/2023 | Champlin et al. |
| 2023/0090224 | A1 | 3/2023 | Dugger et al. |
| 2023/0278668 | A1 | 9/2023 | Gasper et al. |

FOREIGN PATENT DOCUMENTS

| | | |
|---|---|---|
| DE | 1077096 | 3/1960 |
| DE | 26 34 573 | 2/1978 |
| DE | 101 59 040 | 9/2002 |
| DE | 10 2008 057 537 | 5/2010 |
| EP | 1216918 | 11/2002 |
| EP | 1 435 325 | 7/2004 |
| EP | 1 058 645 | 10/2004 |
| EP | 2 065 301 | 3/2010 |
| FR | 2 235 040 | 10/1976 |
| FR | 2 556 312 | 6/1985 |
| FR | 2 603 236 | 3/1988 |
| FR | 2 689 085 | 10/1993 |
| GB | 254090 | 7/1926 |
| GB | 332315 | 7/1930 |
| GB | 2476469 | 6/2011 |
| NR | 86945 | 2/1956 |
| SU | 975490 | 11/1982 |
| WO | WO 93/00258 | 1/1993 |
| WO | WO 96/20105 | 7/1996 |
| WO | WO 99/55577 | 11/1999 |
| WO | WO 2005/118384 | 12/2005 |
| WO | WO 2006/058232 | 6/2006 |
| WO | WO 2007/072185 | 6/2007 |
| WO | WO 2009/113923 | 9/2009 |
| WO | WO 2009/077787 | 5/2010 |
| WO | WO 2011/099931 | 8/2011 |
| WO | WO 2013/040576 | 3/2013 |
| WO | WO 2013/071148 | 5/2013 |

OTHER PUBLICATIONS

U.S. Appl. No. 17/409,277 including its prosecution history, filed Aug. 23, 2021, Ramsdell et al.

U.S. Appl. No. 17/334,408 including its prosecution history, filed May 28, 2021, Wilson et al.

U.S. Appl. No. 17/806,179 including its prosecution history, filed Jun. 9, 2022, Ramsdell et al.

U.S. Appl. No. 17/735,857 including its prosecution history, filed May 3, 2022, Stanley et al.

MasterCraft Surf Tab—Screenshots taken from video uploaded on May 26, 2010 at http://www.youtube.com/watch?v=b1Q_MLRO31M.

Tige Convex VX—Screenshots taken from video uploaded on Oct. 10, 2012 at http://www.youtube.com/watch?v=jx5QXC-dU9w.

Centurion Wake Plate—Website dated Aug. 27, 2011—http://www.centurionboats.com/features-and-options/adjustable-wake-plate.html.

Nautique Surf System—Released Jan. 3, 2013—Website printout from http://www.nautique.com/models/nautique-surf-system.

Letter from Edmund J. Haughey of Fitzpatrick, Cella, Harper & Scinto, dated Feb. 3, 2016.

"Debut of new Sanger Surf Series," Wake World forum having postings between Oct. 4, 2008 and Feb. 9, 2009, webpage archive of http://www.wakeworld.com/forum/showthread.php?t=632602 dated May 30, 2012, 171 pages.

Screenshots taken from video titled "Surf Sanger," uploaded on Apr. 30, 2008 at https://www.youtube.com/watch?v=WcVIZZ7QZus.

Email from Edmund J. Haughey of Fitzpatrick, Cella, Harper & Scinto, dated Feb. 11, 2016.

Humphree Operator's Manual, dated 2009.

Humphree Installation Manual, dated 2009.

"Malibu Makes Boating Easier and More Fun With MaliView," dated Sep. 4, 2008.

Ski Locker—Trim The Waves to Suit Your Personality, Trailer Boats (as reprinted at http://www.switchbladewake.com/switchblade.pdf), Jul. 2005.

International Search Report dated Dec. 6, 2012 for PCT/US2012/055788.

International Search Report dated Jan. 25, 2013 for PCT/US2012/064504.

Volvo Penta—QL Boat Trim System Brochure—The Declaration of David Kennedy alleges that this brochure became publicly available prior to 2010.

Volvo Penta—QL Boat Trim System User & Installation Instructions—The Declaration of David Kennedy alleges that these instructions became publicly available prior to 2010.

Declaration of David Kennedy, dated Dec. 13, 2013, in *Malibu Boats, LLC* v. *Nautique Boat Co.*, Case No. 3:13-cv-00656, in the United States District Court for the Eastern District of Tennessee.

Switch Blade Wake Enhancement System, dated Apr. 10, 2006, https://switchbladewake.com/default.htm.

(56) References Cited

OTHER PUBLICATIONS

First Look Nautique Surf System Wakeworld in 3 pages, Author: David Williams, Jan. 16, 2013.
Lenco Marine Inc., Electric Trim Tab Kits in 2 pages, Oct. 2007.
QL—Quality Line product news: Trim system with new technology, dated Aug. 16, 2004.
Nautique Launches the Nautique Surf System—Press Release, dated Jan. 3, 2013.
Luke, Surf Expo WBM's Surf Expo-Booth View: MasterCraft, dated Sep. 10, 2009.
Luke, Wakeboarding Mastercraft X-25 2011, Wakeboard Boat Review, Feb. 16, 2011.
Luke, Wakeboarding Mastercraft X-2 2011, Wakeboard Boat Review, Feb. 16, 2011.
Luke, Wakeboarding Zane Schwenk Shreds MasterCrafts New Surf Tabs, Sep. 17, 2009.
Machine transcription (using a method from http://www.labnol.org/internet/transcribe-video-to-text/28914/) taken from a video titled "MasterCraft Rewind 2010—The BIG Review", allegedly uploaded on Dec. 30, 2009 at https://www.youtube.com/watch?v=85CoNjFc-WY.
Machine transcription (using a method from http://www.labnol.org/internet/transcribe-video-to-text/28914/) taken from a video titled "MasterCraft Rewind 2010—Surf Tab and Tower Camera Review", allegedly uploaded on Dec. 30, 2009 at https://www.youtube.com/watch?v=UVRra3sMV7A.
Machine transcription (using a method from http://www.labnol.org/internet/transcribe-video-to-text/28914/) taken from a video titled "MasterCraft CSX 265 Review", allegedly uploaded on Nov. 11, 2009 at https://www.youtube.com/watch?v=—N30QPJtfQ.
Machine transcription (using a method from http://www.labnol.org/internet/transcribe-video-to-text/28914/) taken from a video titled "Z3 Wakesurf Side to Side in Seconds", allegedly uploaded on Jul. 8, 2012 at https://www.youtube.com/watch?v=jVJIVomFjT0.
Machine transcription (using a method from http://www.labnol.org/internet/transcribe-video-to-text/28914/) taken from a video titled "The All-New Nautique Surf System", allegedly uploaded on Jan. 3, 2013 at https://www.youtube.com/watch?v=gtaySYhmAdA.
Machine transcription (using a method from http://www.labnol.org/internet/transcribe-video-to-text/28914/) taken from a video titled "Nautique Surf System How-to-Video", allegedly uploaded on Jan. 3, 2013 at https://www.youtube.com/watch?v=GnKfEtMskao.
MasterCraft Boat Company Recipient of NMMA Innovation Award, Feb. 2010.
MasterCraft Reveals New Innovations for 2010, Aug. 2009.
MasterCraft X-Series Models HV700 and HV450 Owner's Manual in 58 pages, Jul. 24, 2012.
Medallion Instrumentation Systems 2010 MasterCraft Viper System in 41 pages, alleged to have a date of prior to Sep. 16, 2010.
Medallion Instrumentation Systems MasterCraft University Instrumentation Training Part 1, Feb. 2012.
Nautique Surf System The new standard in Wakesurfing in 3 pages, Jan. 16, 2013.
Sanger Boats V237 2008 Wakeboarding Magazine in 4 pages, Jan. 1, 2008.
Screenshot taken early in a video titled "2011 MasterCraft X-25", allegedly uploaded on Mar. 15, 2011 at https://www.youtube.com/watch?v=CpPRDrLznoQ.
Screenshot taken early in a video titled "MasterCraft Rewind 2009—Day in the Life of the CSX 265", allegedly uploaded on Dec. 24, 2008 at https://www.youtube.com/watch?v=nr5xXu5fA54.
Screenshot taken early in a video titled "The History of Wake Surfing", allegedly uploaded on Sep. 27, 2012 at https://www.youtube.com/watch?v=KWYZf3A7aas.
Teakgate Modifications & Accessories (p. 1), TheMalibuCrew.com in 13 pages, Oct. 2012.
Teakgate Modifications & Accessories (p. 2), TheMalibuCrew.com in 11 pages, Oct. 2012.
Teakgate Modifications & Accessories (p. 3), TheMalibuCrew.com in 3 pages, Oct. 2012 to Nov. 2012.
Teakgate Modifications & Accessories (p. 4), TheMalibuCrew.com in 5 pages, Nov. 2012 to Mar. 2013.
Transcription taken from a video titled "2008 Surfing Sanger 237 Edition", allegedly uploaded on Sep. 17, 2008 at https://www.youtube.com/watch?v=VedGGGD79bM.
Transcription taken from a video titled "A ride on the wakesurf board", allegedly uploaded on Oct. 15, 2012 at https://www.youtube.com/watch?v=3ru47pbUgyo.
Transcription taken from a video titled "Malibu Sunsetter First Crossover", allegedly uploaded on Oct. 14, 2012 at https://www.youtube.com/watch?v=5Wou4sWdTXk.
Transcription taken from a video titled "Malibu Sunsetter with Teakgate—first water test", allegedly uploaded on Oct. 14, 2012 at https://www.youtube.com/watch?v=u3Bx5k7dOD8.
Transcription taken from a video titled "Malibu Sunsetter with 'Teakgate'", allegedly uploaded on Oct. 13, 2012 at https://www.youtube.com/watch?v=pUwoFd4wOTs.
Transcription taken from a video titled "MasterCraft X10 Featuring Surf Tabs", allegedly uploaded on Feb. 9, 2013 at https://www.youtube.com/watch?v=nVddaDkKR5k.
Transcription taken from a video titled "No need surf gates . . . Only a Mastercraft X10", allegedly uploaded on Nov. 23, 2012 at https://www.youtube.com/watch?v=oltkqqKwEes.
Transcription taken from a video titled "Riding the Teakgate Wave", allegedly uploaded on Oct. 15, 2012 at https://www.youtube.com/watch?v=VgH-WvdWdSo.
Transcription taken from a video titled "Steve wake surfing both sides of the wake", allegedly uploaded on Aug. 12, 2007 at https://www.youtube.com/watch?v=TAjUt6Kh-Xw.
Transcription taken from a video titled "Teakgate Dual Gate Test", allegedly uploaded on Nov. 12, 2012 at https://www.youtube.com/watch?v=c6nEgA099fs.
Transcription taken from a video titled "Teakgate Testing", allegedly uploaded on Nov. 12, 2012 at https://www.youtube.com/watch?v=H5tOiz9SdaQ.
Transcription taken from a video titled "Wakesurfing the Sanger 237", allegedly uploaded on Apr. 29, 2008 at https://www.youtube.com/watch?v=nG0YH8fwCmM.
Transcription taken from a video titled "Wakesurfing Crossover behind a 1987 Sunsetter", allegedly uploaded on Oct. 15, 2012 at https://www.youtube.com/watch?v=yCGsKoyLbYs.
Volvo Penta, QL Boat Trim System & Automatic Boat Trim Option in 4 pages. 2008.
Volvo Penta, QL Boat Trim System Brochure in 4 pages. 2007.
Volvo Penta, QL Boat Trim System Marine Accessories, www.qlmarine.com in 2 pages. 2004.
WakeWorld Forum Showthread, Is the Razor Blade the Switch Blade for Surfing in 14 pages, forum posts dated Feb. 8, 2008 and earlier.
WakeWorld MasterCraft Reveals New Innovations for 2010 in 3 pages, Aug. 24, 2009.
2010 Mastercraft Owner's Manual.
2011 Mastercraft Owner's Manual (Part 1—covering pp. #i -#4-33).
2011 Mastercraft Owner's Manual (Part 2—covering pp. #5-1-#24-4).
2012 Mastercraft Owner's Manual.
2013 Mastercraft Owner's Manual (Part 1—covering pp. #i-#2-45).
2013 Mastercraft Owner's Manual (Part 2—covering pp. #3-1-#6-18).
New QL Boat Trim System—Always Perfect Trim, dated Jul. 2007.
Malibu 2009 Owner's Manual.
MasterCraft Reveals 2010 Innovations, dated Sep. 3, 2009.
Machine transcription (using a method from http://www.labnol.org/internet/transcribe-video-to-text/28914/) taken from a video titled "Zane Schwenk—MasterCraft Surf Tabs", allegedly uploaded on May 26, 2010 at http://www.youtube.com/watch?v=b1Q_MLRO31M.
Nautique Surf System (2 Pages), dated Jan. 3, 2013, http://www.nautique.com/blog/index/nautique-surf-system.
Screenshot taken early in a video titled "X-2 Surfing 2010," allegedly uploaded on Aug. 31, 2010 at https://www.youtube.com/watch?v=1FbuXfaWFwU.

(56) References Cited

OTHER PUBLICATIONS

Castle Bravo—Power Trim Tabs, dated May 11, 2011, http://mhkaufman.blogspot.com/2011/05/power-trim-tabs.html.
Wake Plates?—Wakeboarder.com Forum, Posts dated Mar. 23, 2005 to Mar. 24, 2005, http://forums.wakeboarder.com/viewtopic.php?t=40149&SID.
Tips for Proper Boat Weighting, dated Sep. 28, 2012, https://www.wakeutah.com/2012/09/28/tips-for-proper-boat-weighting/.
Lenco Marine, Drawing 20609, 2 Pages, dated Dec. 3, 2009.
"A Simple Slip Vs. Roll Wake Enhancement Experiment," http://wakeworld.com/forum/showthread.php?t=544205, posts dated Feb. 13, 2008 and earlier.
"weighting a Sanger 237, need help," http://www.wakeworld.com/forum/showthread.php?t=770907, posts dated Jan. 25, 2010.
"Power wedge or trim tab ?? ," http://yamahajetboaters.com/forum/viewtopic.php?f=1&t=19792, posts dated Apr. 28, 2009 and earlier.
"Centurion Boats Enzo SV220 2008: Wakeboard Boat Review," Wakeboarding Magazine, Jan. 1, 2008, https://www.wakeboardingmag.com/blog/boats/2008/01/01/centurion-boats-enzo-sv220-2008/.
"Centurion Enzo SV 230," Nov. 10, 2008, https://www.boatingmag.com/boats/centurion-enzo-sv-230/.
"Boardstock 10," Aug. 31, 2005, http://wakeworld.com/news/latestinwake/boardstock-10.html.
Machine transcription taken from a video titled "World Champion Tow Boat History—Centurion Boats," allegedly uploaded Aug. 20, 2017 at https://www.youtube.com/watch?v=uHROZgUk91Q.
Lenco Owner's Manual, dated Jan, 26, 2010, in 24 Pages.
"Hydrofoil," Wikipedia, Wikimedia Foundation, available as early as Mar. 26, 2020, en.wikipedia.org/wiki/Hydrofoil.
Yun L., Bliault A., High Performance Marine Vessels, dated 2012. (Part 1 pp. C1-202).
Yun L., Bliault A., High Performance Marine Vessels, dated 2012. (Part 2 pp. 203-359).
Monsonnec, Fred, "The Foil Alphabet," dated Apr. 4, 2015, www.foilingweek.com/wp-content/uploads/2015/04/The-foil-alphabet-Fred-Monsonnec-04-04-2015.pdf?189db0&189db0.
Johnston, R.J., "Hydrofoils," Naval Eng. J., vol. 97 No. 2, 142-199, dated Feb. 1985.
Lei, Siyu, "A Look at the USS Aries," Columbia Missourian, dated Dec. 9, 2015, www.columbiamissourian.com/visuals/graphics/a-look-at-the-uss-aries/html_6b546320-9ed7-11e5-9427-fb3e65328a09.html.
Consultancy: Design, Owen Clarke Design: Yacht Design. Naval Architecture, https://www.owenclarkedesign.com//Yacht-Design-Engineering-Consultancy-Services.
The Revolution in Lifting Keel, The Keel Servant, https://thekeelservant.it/features/.
Canting & Lifting Keel System, Cariboni, https://caritec.com/en/products/canting-lifting-keel-system.
Canting Keel Hydraulic System, Cariboni-Caritec, https://www.nauticexpo.com/prod/cariboni/product-22728-256077.html.
Lifting Keel Mechanism, Le Tehnika, http://www.le-tehnika.com/index.php?location=1012.
Ac-86 Build, RC Groups, dated Aug. 21, 2013, https://www.rcgroups.com/forums/showthread.php?1887900-Ac-86-build/page5.
Bowler, Russ. "Scuttlebutt: Volvo 70 Keel Fairing System," Sailing Scuttlebutt, http://archive.sailingscuttlebutt.com/news/06/0309/.
D'Ambrosio, Luca, "Princess R35. The Sexy Revolution by Princess Yachts," Yachting Media, The International Yachting Media, dated Nov. 20, 2018, www.yachtingmedia.com/magazine/princess-r35.html.
Meet the foiling catamaran for family sailors—the fantastic Formula Whisper, YouTube, dated Jun. 30, 2015, at 4:28, https://www.youtube.com/watch?v=opxXm8Oub0A.
Formula Whisper, the exciting new boat that anyone can learn to foil, Yachting World, dated Sep. 7, 2015, https://www.yachtingworld.com/yachts-and-gear/formula-whisper-just-how-easy-is-it-to-get-this-boat-to-foil-67280.
Meet the foiling catamaran for family sailors—the fantastic Formula Whisper, YouTube, dated Jun. 30, 2015, at 6:20, https://www.youtube.com/watch?v=opxXm8Oub0A.
Dieter Loibner, The Efficiency of a Foiling Powercat, Professional Boatbuilder, dated Mar. 13, 2020, https://www.proboat.com/2020/03/foiling-powercat/.
Homebuilt Hydrofoil: Construction Manual, Midwest Engineering & Design, http://www.digitalmarketingusa.com/Hydrofoil.html.
Frances, Guru Bikes or Our Journey Into the Frigid North, New England Bicycle Consulting, dated Nov. 19, 2009, https://nebikeconsulting.wordpress.com/2009/11/19/guru-bikes-or-our-journey-into-the-frigid-north/.
Matthew Loveridge, Have carbon bikes reached classic status yet?, bikeradar, dated Dec. 13, 2019, https://www.bikeradar.com/features/classic-carbon-road-bikes/.
Brand new hydrofoil made by 100% 3k carbon fiber bigger wings for sup board surfboard, AliExpress, https://www.aliexpress.com/item/32834601920.html.
Evolution of airfoil weight and strength Carbon fiber inlay weave, Microbirds: Ultralight, dated Apr. 16, 2019, https://microbirds.com/evolution-of-airfoil-weight-and-strength/.
Hydrofoil, Fast Craft, http://www.fastacraft.com/images/hydrofoil.jpg.
Hydrofoil Systems, D&D Fabrication, dated 2004, http://www.ddfabrication.com/hydrofoil.htm.
Products from Foshan Pailian Aluminium Co, Ltd, Global Sources, https://www.globalsources.com/si/AS/Foshan-Pailian/6008829202228/pdt//Aluminium-profile/1161397058.htm.
Image of Transom Mounted Foil, retrieved from Internet, available as early as Mar. 26, 2020.
Image of Foil, retrieved from Internet, available as early as Mar. 26, 2020.
Andrew Noyce, Grismont Leads French Revolution In 3D Golf Club Design, dated Feb. 26, 2016, https://www.golfalot.com/equipment-news/grismont-driving-irons-3509.aspx.
Brunswick's Appeal Brief, filed May 4, 2018 in *Cobalt Boats, LLC* v. *Brunswick Corp.*, Case: 2018-1376 in the United States Court of Appeals for the Federal Circuit.
Cobalt's Appeal Brief, filed Aug. 13, 2018 in *Cobalt Boats, LLC* v. *Brunswick Corp.*, Case: 2018-1376 in the United States Court of Appeals for the Federal Circuit.
Brunswick's Reply Brief, filed Sep. 26, 2018 in *Cobalt Boats, LLC* v. *Brunswick Corp.*, Case: 2018-1376 in the United States Court of Appeals for the Federal Circuit.
Opinion and Judgment, decided May 31, 2019 in *Cobalt Boats, LLC* v. *Brunswick Corp.*, Case: 2018-1376 in the United States Court of Appeals for the Federal Circuit.
Brunswick's Appeal Brief, filed Jan. 27, 2017 in Brunswick Corp., *Sea Ray Boats, Inc.* v. *Cobalt Boats, LLC*, Case: 2017-1065 in the United States Court of Appeals for the Federal Circuit.
Cobalt's Appeal Brief, filed Mar. 8, 2017 in Brunswick Corp., *Sea Ray Boats, Inc.* v. *Cobalt Boats, LLC*, Case: 2017-1065 in the United States Court of Appeals for the Federal Circuit.
Brunswick's Reply Brief, filed Mar. 22, 2017 in Brunswick Corp., *Sea Ray Boats, Inc.* v. *Cobalt Boats, LLC*, Case: 2017-1065 in the United States Court of Appeals for the Federal Circuit.
Judgment, filed Sep. 7, 2017 in Brunswick Corp., *Sea Ray Boats, Inc.* v. *Cobalt Boats, LLC*, Case: 2017-1065 in the United States Court of Appeals for the Federal Circuit.
Cobalt's Complaint with Exhibits, filed Jan. 23, 2015 in *Cobalt Boats, LLC* v. *Sea Ray Boats, Inc.*, Case EDVA-2-15-00021 in the United States District Court for the Eastern District of Virginia.
Cobalt's Amended Complaint with Exhibits, filed Feb. 23, 2015 in *Cobalt Boats, LLC* v. *Sea Ray Boats, Inc. and Brunswick Corporation*, Case EDVA-2-15-00021 in the United States District Court for the Eastern District of Virginia.
Sea Ray's and Brunswick's Answer, filed Mar. 12, 2015 in *Cobalt Boats, LLC* v. *Sea Ray Boats, Inc. and Brunswick Corporation*, Case EDVA-2-15-00021 in the United States District Court for the Eastern District of Virginia.
Cobalt's Opening Claim Construction Brief, filed Sep. 25, 2015 in *Cobalt Boats, LLC* v. *Sea Ray Boats, Inc. and Brunswick Corpo-*

(56) References Cited

OTHER PUBLICATIONS

*ration*, Case EDVA-2-15-00021 in the United States District Court for the Eastern District of Virginia.
Declaration of B. Scott Eidson in Support of Cobalt's Openign Claim Construction Brief, filed Sep. 25, 2015 in C*Cobalt Boats, LLC* v. *Sea Ray Boats, Inc. and Brunswick Corporation*, Case EDVA-2-15-00021 in the United States District Court for the Eastern District of Virginia.
Sea Ray's and Brunswick's Opening Claim Construction Brief, filed Sep. 25, 2015 in *Cobalt Boats, LLC* v. *Sea Ray Boats, Inc. and Brunswick Corporation*, Case EDVA-2-15-00021 in the United States District Court for the Eastern District of Virginia.
Declaration of Dr. Charles A. Garris in Support of Sea Ray's and Brunswick's Opening Claim Construction Brief, filed Sep. 25, 2015 in *Cobalt Boats, LLC* v. *Sea Ray Boats, Inc. and Brunswick Corporation*, Case EDVA-2-15-00021 in the United States District Court for the Eastern District of Virginia.
Cobalt's Rebuttal Claim Construction Brief, filed Oct. 16, 2015 in *Cobalt Boats, LLC* v. *Sea Ray Boats, Inc. and Brunswick Corporation*, Case EDVA-2-15-00021 in the United States District Court for the Eastern District of Virginia.
Declaration of B. Scott Eidson in Support of Cobalt's Rebuttal Claim Construction Brief, filed Oct. 16, 2015 in *Cobalt Boats, LLC* v. *Sea Ray Boats, Inc. and Brunswick Corporation*, Case EDVA-2-15-00021 in the United States District Court for the Eastern District of Virginia.
Expert Declaratoin of Thomas R. Dyer, P.E., filed Oct. 16, 2015 in *Cobalt Boats, LLC* v. *Sea Ray Boats, Inc. and Brunswick Corporation*, Case EDVA-2-15-00021 in the United States District Court for the Eastern District of Virginia.
Sea Ray's and Brunswick's Responsive Claim Construction Brief, filed Oct. 16, 2015 in *Cobalt Boats, LLC* v. *Sea Ray Boats, Inc. and Brunswick Corporation*, Case EDVA-2-15-00021 in the United States District Court for the Eastern District of Virginia.
Expert Declaration of Dr. Charles A. Garris, Jr. in support of Sea Ray's and Brunswick's Responsive Claim Construction Brief, filed Oct. 16, 2015 in *Cobalt Boats, LLC* v. *Sea Ray Boats, Inc. and Brunswick Corporation*, Case EDVA-2-15-00021 in the United States District Court for the Eastern District of Virginia.
Joint Statement on Claim Construction, filed Dec. 7, 2016 in *Cobalt Boats, LLC* v. *Sea Ray Boats, Inc. and Brunswick Corporation*, Case EDVA-2-15-00021 in the United States District Court for the Eastern District of Virginia.
Cobalt's Supplemental Claim Construction Brief, filed Dec. 7, 2016 in *Cobalt Boats, LLC* v. *Sea Ray Boats, Inc. and Brunswick Corporation*, Case EDVA-2-15-00021 in the United States District Court for the Eastern District of Virginia.
Sea Ray's and Brunswick's Supplemental Claim Construction Brief, filed Dec. 7, 2016 in *Cobalt Boats, LLC* v. *Sea Ray Boats, Inc. and Brunswick Corporation*, Case EDVA-2-15-00021 in the United States District Court for the Eastern District of Virginia.
Transcript of Markman Hearing, filed Jan. 12, 2017 in *Cobalt Boats, LLC* v. *Sea Ray Boats, Inc. and Brunswick Corporation*, Case EDVA-2-15-00021 in the United States District Court for the Eastern District of Virginia.
Markman Opinion and Order, filed Dec. 21, 2016 in *Cobalt Boats, LLC* v. *Sea Ray Boats, Inc. and Brunswick Corporation*, Case EDVA-2-15-00021 in the United States District Court for the Eastern District of Virginia.
Sea Ray's and Brunkswick's Opening Brief in Support of Motion for Summary Judgment of Noninfringement, filed Jan. 25, 2017 in *Cobalt Boats, LLC* v. *Sea Ray Boats, Inc. and Brunswick Corporation*, Case EDVA-2-15-00021 in the United States District Court for the Eastern District of Virginia.
Cobalt's Opposition to Motion for Summary Judgment of Noninfringement, filed Feb. 8, 2017 in *Cobalt Boats, LLC* v. *Sea Ray Boats, Inc. and Brunswick Corporation*, Case EDVA-2-15-00021 in the United States District Court for the Eastern District of Virginia.
Sea Ray's and Brunkswick's Rebuttal in Support of Motion for Summary Judgment of Noninfringement, filed Feb. 14, 2017 in *Cobalt Boats, LLC* v. *Sea Ray Boats, Inc. and Brunswick Corporation*, Case EDVA-2-15-00021 in the United States District Court for the Eastern District of Virginia.
Cobalt's Sur-Reply Rebuttal in Support of Defendant's Motion for Summary Judgment of Noninfringement, filed Mar. 14, 2017 in *Cobalt Boats, LLC* v. *Sea Ray Boats, Inc. and Brunswick Corporation*, Case EDVA-2-15-00021 in the United States District Court for the Eastern District of Virginia.
Cobalt's Memorandum in Support of Motion to Correct Typographical Error in Markman Order, filed Feb. 3, 2017 in *Cobalt Boats, LLC* v. *Sea Ray Boats, Inc. and Brunswick Corporation*, Case EDVA-2-15-00021 in the United States District Court for the Eastern District of Virginia.
Sea Ray's and Brunswick's Response to Cobalt's Motion to Correct Typographical Errors in Markman Order, filed Feb. 17, 2017 in *Cobalt Boats, LLC* v. *Sea Ray Boats, Inc. and Brunswick Corporation*, Case EDVA-2-15-00021 in the United States District Court for the Eastern District of Virginia.
Order on Motion to Correct Typographical Errors in Markman Order, filed Mar. 22, 2017 in *Cobalt Boats, LLC* v. *Sea Ray Boats, Inc. and Brunswick Corporation*, Case EDVA-2-15-00021 in the United States District Court for the Eastern District of Virginia.
Cobalt's Memorandum in Support of Motion for Summary Judgment on Defendant's Invalidity Defenses, filed Apr. 28, 2017 in *Cobalt Boats, LLC* v. *Sea Ray Boats, Inc. and Brunswick Corporation*, Case EDVA-2-15-00021 in the United States District Court for the Eastern District of Virginia.
Expert Report of Charles A. Garris, Jr. Regarding Invalidity of the Asserted Claims of U.S. Pat. No. 8,375,880, filed Apr. 28, 2017 in *Cobalt Boats, LLC* v. *Sea Ray Boats, Inc. and Brunswick Corporation*, Case EDVA-2-15-00021 in the United States District Court for the Eastern District of Virginia.
Four Winns Sundowner Owners Manual, filed Apr. 28, 2017 in *Cobalt Boats, LLC* v. *Sea Ray Boats, Inc. and Brunswick Corporation*, Case EDVA-2-15-00021 in the United States District Court for the Eastern District of Virginia.
Four Winns SL Series Owners Manual, filed Apr. 28, 2017 in *Cobalt Boats, LLC* v. *Sea Ray Boats, Inc. and Brunswick Corporation*, Case EDVA-2-15-00021 in the United States District Court for the Eastern District of Virginia.
Four Winns Sundowner Stern Ladder, filed Apr. 28, 2017 in *Cobalt Boats, LLC* v. *Sea Ray Boats, Inc. and Brunswick Corporation*, Case EDVA-2-15-00021 in the United States District Court for the Eastern District of Virginia.
Four Winns Sundowner Swim Platform Ladder, filed Apr. 28, 2017 in *Cobalt Boats, LLC* v. *Sea Ray Boats, Inc. and Brunswick Corporation*, Case EDVA-2-15-00021 in the United States District Court for the Eastern District of Virginia.
Four Winns SL Locking Bow Ladder, filed Apr. 28, 2017 in C*Cobalt Boats, LLC* v. *Sea Ray Boats, Inc. and Brunswick Corporation*, Case EDVA-2-15-00021 in the United States District Court for the Eastern District of Virginia.
Sea Ray's and Brunswick's Brief in Opposition of Motion for Summary Judgment of Patent Validity, filed May 12, 2017 in *Cobalt Boats, LLC* v. *Sea Ray Boats, Inc. and Brunswick Corporation*, Case EDVA-2-15-00021 in the United States District Court for the Eastern District of Virginia.
Cobalt's Reply Memorandum in Support of Motion for Summary Judgment on Defendant's Invalidity Defenses, filed May 16, 2017 in *Cobalt Boats, LLC* v. *Sea Ray Boats, Inc. and Brunswick Corporation*, Case EDVA-2-15-00021 in the United States District Court for the Eastern District of Virginia.
Jury Verdict, filed Jun. 21, 2017 in *Cobalt Boats, LLC* v. *Sea Ray Boats, Inc. and Brunswick Corporation*, Case EDVA-2-15-00021 in the United States District Court for the Eastern District of Virginia.
Brunswick's Memorandum in Support of Motion for Judgment as a Matter of Law and New Trial, filed Jul. 21, 2017 in *Cobalt Boats, LLC* v. *Sea Ray Boats, Inc. and Brunswick Corporation*, Case EDVA-2-15-00021 in the United States District Court for the Eastern District of Virginia.
Cobalt's Opposition to Brunswick's Motion for Judgment as a Matter of Law and New Trial, filed Aug. 4, 2017 in *Cobalt Boats,*

(56) References Cited

OTHER PUBLICATIONS

*LLC* v. *Sea Ray Boats, Inc. and Brunswick Corporation*, Case EDVA-2-15-00021 in the United States District Court for the Eastern District of Virginia.
Brunswick's Rebuttal in Support of Motion for Judgment as a Matter of Law and New Trial, filed Aug. 10, 2017 in *Cobalt Boats, LLC* v. *Sea Ray Boats, Inc. and Brunswick Corporation*, Case EDVA-2-15-00021 in the United States District Court for the Eastern District of Virginia.
Opinion and Order regarding Motion for Judgment as a Matter of Law and New Trial, filed Dec. 4, 2017 in *Cobalt Boats, LLC* v. *Sea Ray Boats, Inc. and Brunswick Corporation*, Case EDVA-2-15-00021 in the United States District Court for the Eastern District of Virginia.
Order Entering Judgent of Non-Infringement, filed Aug. 14, 2019 in *Cobalt Boats, LLC* v. *Sea Ray Boats, Inc. and Brunswick Corporation*, Case EDVA-2-15-00021 in the United States District Court for the Eastern District of Virginia.
U.S. Pat. No. 8375880 File History, filed Apr. 16, 2015 in *Brunswick Corporation and Sea Ray Boats, Inc.* v. *Cobalt Boats, LLC*, Proceeding IPR2015-01060 in the Patent Trial and Appeal Board.
Declaration of Dr. Charles A. Garris, Jr., filed Apr. 16, 2015 in *Brunswick Corporation and Sea Ray Boats, Inc.* v. *Cobalt Boats, LLC*, Proceeding IPR2015-01060 in the Patent Trial and Appeal Board.
Bayliner 185, 195, 205, & 225 Runabouts, Owner's Manual Supplement, filed Apr. 16, 2015 in *Brunswick Corporation and Sea Ray Boats, Inc.* v. *Cobalt Boats, LLC*, Proceeding IPR2015-01060 in the Patent Trial and Appeal Board.
Petition for Inter Partes Review of U.S. Pat. No. 8,375,880, filed Apr. 16, 2015 in *Brunswick Corporation and Sea Ray Boats, Inc.* v. *Cobalt Boats, LLC*, Proceeding IPR2015-01060 in the Patent Trial and Appeal Board.
Cobalt R3: A 'Sensational' Addition to the Bowrider World, Boats.com, filed Jul. 24, 2015 in *Brunswick Corporation and Sea Ray Boats, Inc.* v. *Cobalt Boats, LLC*, Proceeding IPR2015-01060 in the Patent Trial and Appeal Board.
Patent Owner Preliminary Response to Petition, filed Jul. 24, 2015 in *Brunswick Corporation and Sea Ray Boats, Inc.* v. *Cobalt Boats, LLC*, Proceeding IPR2015-01060 in the Patent Trial and Appeal Board.
Photo of Cobalt Boat, filed Jul. 24, 2015 in *Brunswick Corporation and Sea Ray Boats, Inc.* v. *Cobalt Boats, LLC*, Proceeding IPR2015-01060 in the Patent Trial and Appeal Board.
Cobalt 26SD WSS Runabout, BoatingMag.com, filed Jul. 24, 2015 in *Brunswick Corportion and Sea Ray Boats, Inc.* v. *Cobalt Boats, LLC*, Proceeding IPR2015-01060 in the Patent Trial and Appeal Board.
Photo of Sea Ray Sundeck 240 Boat, filed Jul. 24, 2015 in *Brunswick Corporation and Sea Ray Boats, Inc.* v. *Cobalt Boats, LLC*, Proceeding IPR2015-01060 in the Patent Trial and Appeal Board.
Cobalt R5: Runabout Reawakening, Boats.com, filed Jul. 24, 2015 in *Brunswick Corporation and Sea Ray Boats, Inc.* v. *Cobalt Boats, LLC*, Proceeding IPR2015-01060 in the Patent Trial and Appeal Board.
Sea Ray Website Pages, filed Jul. 24, 2015 in *Brunswick Corporation and Sea Ray Boats, Inc.* v. *Cobalt Boats, LLC*, Proceeding IPR2015-01060 in the Patent Trial and Appeal Board.
Decision Instituting Inter Partes Review, entered Oct. 16, 2015 in *Brunswick Corporation and Sea Ray Boats, Inc.* v. *Cobalt Boats, LLC*, Proceeding IPR2015-01060 in the Patent Trial and Appeal Board.
3-D Illustration of Cobalt's Swim Step, filed Jan. 19, 2016 in *Brunswick Corporation and Sea Ray Boats, Inc.* v. *Cobalt Boats, LLC*, Proceeding IPR2015-01060 in the Patent Trial and Appeal Board.
Transcript of Deposition of Charles A. Garris, Jr., Ph.D, filed Jan. 19, 2016 in *Brunswick Corportion and Sea Ray Boats, Inc.* v. *Cobalt Boats, LLC*, Proceeding IPR2015-01060 in the Patent Trial and Appeal Board.
Photos of Cobalt Swim Step in the Deployed and Stowed Position, filed Jan. 19, 2016 in *Brunswick Corportion and Sea Ray Boats, Inc.* v. *Cobalt Boats, LLC*, Proceeding IPR2015-01060 in the Patent Trial and Appeal Board.
Collection of Cobalt Advertisements for the Swim Step, filed Jan. 19, 2016 in *Brunswick Corportion and Sea Ray Boats, Inc.* v. *Cobalt Boats, LLC*, Proceeding IPR2015-01060 in the Patent Trial and Appeal Board.
Comparison Chart Sea Ray, filed Jan. 19, 2016 in *Brunswick Corportion and Sea Ray Boats, Inc.* v. *Cobalt Boats, LLC*, Proceeding IPR2015-01060 in the Patent Trial and Appeal Board.
Claim Chart Cobalt, filed Jan. 19, 2016 in *Brunswick Corportion and Sea Ray Boats, Inc.* v. *Cobalt Boats, LLC*, Proceeding IPR2015-01060 in the Patent Trial and Appeal Board.
Declaration of Kevin C. Breen, filed Jan. 19, 2016 in *Brunswick Corportion and Sea Ray Boats, Inc.* v. *Cobalt Boats, LLC*, Proceeding IPR2015-01060 in the Patent Trial and Appeal Board.
Cobalt's Contingent Motion to Amend, filed Jan. 19, 2016 in *Brunswick Corportion and Sea Ray Boats, Inc.* v. *Cobalt Boats, LLC*, Proceeding IPR2015-01060 in the Patent Trial and Appeal Board.
Cobalt's Response, filed Jan. 19, 2016 in*Brunswick Corportion and Sea Ray Boats, Inc.* v. *Cobalt Boats, LLC*, Proceeding IPR2015-01060 in the Patent Trial and Appeal Board.
Petitioner's Response to Patent Owner's Contingent Motion to Amend, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt R5 Flyer, filed Apr. 19, 2016 in*Brunswick Corportion and Sea Ray Boats, Inc.* v. *Cobalt Boats, LLC*, Proceeding IPR2015-01060 in the Patent Trial and Appeal Board.
Cobalt 336 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt 273 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt 302 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt 200 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt R30 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt 296 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt 26SD Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt 210 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt CS3 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt A40 Coupe Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Chaparral Video, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt Waling on Water Website, filed Apr. 19, 2016 in *Brunswick Corportion and Sea Ray Boats, Inc.* v. *Cobalt Boats, LLC*, Proceeding IPR2015-01060 in the Patent Trial and Appeal Board.

(56) References Cited

OTHER PUBLICATIONS

Cobalt R7 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt Newest Innovations Website, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt R3 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt A25 Flyer, filed Apr. 19, 2016 in*Brunswick Corportion and Sea Ray Boats, Inc.* v. *Cobalt Boats, LLC*, Proceeding IPR2015-01060 in the Patent Trial and Appeal Board.
Brunswick's Response to Cobalt's First Set of Interrogatories, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt WSS Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt 243 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt A28 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt 273 Owners Manual, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Transcript of Deposition of Kevin C. Breen, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt 24SD Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt 220 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt Swim Step Website, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Petitioner's Exhibit List, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Cobalt A40 Flyer, filed Apr. 19, 2016 in *Brunswick Corportion and Sea Ray Boats, Inc.* v. *Cobalt Boats, LLC*, Proceeding IPR2015-01060 in the Patent Trial and Appeal Board.
Declaration of Kevin C. Breen in Support of Cobalt's Reply to Petitioner's Response to the Contingent Motion to Amend, filed May 19, 2016 in *Brunswick Corportion and Sea Ray Boats, Inc.* v. *Cobalt Boats, LLC*, Proceeding IPR2015-01060 in the Patent Trial and Appeal Board.
Cobalt's Reply to Petitioners' Response to Patent Owner's Contingent Motion to Amend, filed May 19, 2016 in *Brunswick Corportion and Sea Ray Boats, Inc.* v. *Cobalt Boats, LLC*, Proceeding IPR2015-01060 in the Patent Trial and Appeal Board.
Petitioner's Exhibit List, filed Jun. 9, 2016 in *Brunswick Corportion and Sea Ray Boats, Inc.* v. *Cobalt Boats, LLC*, Proceeding IPR2015-01060 in the Patent Trial and Appeal Board.
Transcript of Kevin C. Breen, filed Jun. 9, 2016 in *Brunswick Corportion and Sea Ray Boats, Inc.* v. *Cobalt Boats, LLC*, Proceeding IPR2015-01060 in the Patent Trial and Appeal Board.
Petitioner's Sur-Reply in Opposition to Patent Owner's Contingent Motion to Amend, filed Jun. 9, 2016 in *Brunswick Corportion and Sea Ray Boats, Inc.* v. *Cobalt Boats, LLC*, Proceeding IPR2015-01060 in the Patent Trial and Appeal Board.
Petitioner's Motion for Observation on Cross-Examination of Kevin Breen, filed Jun. 9, 2016 in *Brunswick Corportion and Sea Ray Boats, Inc.* v. *Cobalt Boats, LLC*, Proceeding IPR2015-01060 in the Patent Trial and Appeal Board.
Cobalt's Exhibit List, filed Jun. 23, 2016 in *Brunswick Corportion and Sea Ray Boats, Inc.* v. *Cobalt Boats, LLC*, Proceeding IPR2015-01060 in the Patent Trial and Appeal Board.
Cobalt's Response to Petitioner's Observation on the Cross-examination of Kevin Breen, filed Jun. 23, 2016 in *Brunswick Corportion and Sea Ray Boats, Inc.* v. *Cobalt Boats, LLC*, Proceeding IPR2015- 01060 in the Patent Trial and Appeal Board.
Transcript of Deposition of William Paxson St. Clair, filed Jul. 8, 2016 in *Brunswick Corportion and Sea Ray Boats, Inc.* v. *Cobalt Boats, LLC*, Proceeding IPR2015-01060 in the Patent Trial and Appeal Board.
Petitioner's Reply to Patent Owner's Response, filed Jul. 8, 2016 in *Brunswick Corportion and Sea Ray Boats, Inc.* v. *Cobalt Boats, LLC*, Proceeding IPR2015-01060 in the Patent Trial and Appeal Board.
Declaration of Paxson St. Clair, filed Jul. 8, 2016 in *Brunswick Corportion and Sea Ray Boats, Inc.* v. *Cobalt Boats, LLC*, Proceeding IPR2015-01060 in the Patent Trial and Appeal Board.
Collection of Cobalt Customer Surveys Prior to Swim Step Invention, filed Jul. 8, 2016 in *Brunswick Corportion and Sea Ray Boats, Inc.* v. *Cobalt Boats, LLC*, Proceeding IPR2015-01060 in the Patent Trial and Appeal Board.
Collection of Cobalt Customer Surveys After Swim Step Invention, filed Jul. 8, 2016 in *Brunswick Corportion and Sea Ray Boats, Inc.* v. *Cobalt Boats, LLC*, Proceeding IPR2015-01060 in the Patent Trial and Appeal Board.
Order for Additional Briefing Regarding Claim Construction, filed Aug. 4, 2016 in *Brunswick Corportion and Sea Ray Boats, Inc.* v. *Cobalt Boats, LLC*, Proceeding IPR2015-01060 in the Patent Trial and Appeal Board.
Transcript of Oral Hearing, filed Aug. 10, 2016 in *Brunswick Corportion and Sea Ray Boats, Inc.* v. *Cobalt Boats, LLC*, Proceeding IPR2015-01060 in the Patent Trial and Appeal Board.
Petitioners' Additional Briefing, filed Aug. 19, 2016 in *Brunswick Corportion and Sea Ray Boats, Inc.* v. *Cobalt Boats, LLC*, Proceeding IPR2015-01060 in the Patent Trial and Appeal Board.
Petitioners' Updated Exhibit List, filed Aug. 19, 2016 in *Brunswick Corportion and Sea Ray Boats, Inc.* v. *Cobalt Boats, LLC*, Proceeding IPR2015-01060 in the Patent Trial and Appeal Board.
Cobalt's Additional Briefing, filed Aug. 19, 2016 in *Brunswick Corportion and Sea Ray Boats, Inc.* v. *Cobalt Boats, LLC*, Proceeding IPR2015-01060 in the Patent Trial and Appeal Board.
Final Written Decision, entered Sep. 28, 2016 in *Brunswick Corportion and Sea Ray Boats, Inc.* v. *Cobalt Boats, LLC*, Proceeding IPR2015-01060 in the Patent Trial and Appeal Board.
Product Information on "Cobalt Boats A25", downloaded from internet on Feb. 15, 2010 at http://www.cobaltsboats.com/m1210/A25/index.php (1 page).
Product Information on "Cobalt Boats", downloaded from internet on Feb. 15, 2010 at http://www.cobaltboats.com/art/media/A2510_A259507L.jpg (1 page).
Product Information on "OPACMARE", downloaded from internet on Feb. 15, 2010 http://www.opacmare.it/pages/English Home/101 (1 page).
Product Information on "Hydraulic Platform Lift for sailboat and power boats personal watercraft, tenders, makes . . . ", Beaver-Brand Canvas, Inc., downloaded from internet on Feb. 15, 2010 at http://www.beaver-brandcanvas.com/hydraulicplatformli.html (1 page).
Product Information on "Hydraulic Swim Platforms", Florida Bow Thrusters, downloaded from the internet on Feb. 15, 2010 at http://www.floridabowthrusters.com/swim-platforms.html (1 page).
Product Information on "Swim Platforms," Fleet-Hydrol, downloaded from the internet on Feb. 15, 2010 at http://www/fleet-hydrol.com.au/marine/swimplatforms.htm (1 page).

* cited by examiner

POWERED SWIM PLATFORM

CROSS REFERENCE TO RELATED APPLICATIONS

This application claims priority to U.S. Provisional Patent Application No. 63/069,465, filed Aug. 24, 2020, which is incorporated herein by reference in its entirety. Any and all applications, if any, for which a foreign or domestic priority claim is identified in the Application Data Sheet of the present application are hereby incorporated by reference under 37 CFR 1.57.

FIELD

The present application relates generally to improving embarking from water onto a swim deck and disembarking into water from a swim deck of a boat and, more particularly, to a powered swim platform moveable between stowed and deployed positions.

BACKGROUND

Water sports that utilize a water-sports boat, including wakeboarding, waterskiing, wake surfing, tubing, swimming and the like, have become increasingly popular for a wide demographic. Particularly, the advent and ever-increasing popularity of wake surfing has widened the age and athletic spectrum of those who can safely and enjoyably participate in powered water sports. In many cases, a user participates in water sports without ever reaching a dock or shallow water. For example, a wake surfer may start a ride in the middle of a deep lake, ride, and then finish still in the deep water of the lake. Thus, participators usually ingress and egress, often with sport gear attached or at least in arm, from the swim deck. Users can ingress to and/or egress from various type of boats and other watercraft such as for swimming, scuba diving, recovering a man overboard, etc.

SUMMARY

It can be difficult, however, for some users to repeatedly enter the water-sports boat from the water and/or enter the water from the water-sports boat. For example, for egress from the boat to the water, a rider or swimmer might need to jump from a swim deck above the waterline, at the waterline, or just below the waterline, sometimes depending on an amount of ballast loaded to displace the hull. The person may climb down to sit on the swim deck to reduce the fall distance, but will still sink when leaving the deck. For ingress back into the boat from the water, a rider or swimmer may have to lift their weight and that of attached or used sports gear out of the water. Additionally, the life preserver/jacket can impede ingress as the swim deck tends to snag on bulky or hollow parts of the life jacket. Moreover, the participant(s) may be tired just after a long ride. This is especially true for wakeboarding and water skiing. Thus, overall, many parts of egress and especially ingress can be difficult and cumbersome. Accordingly, a user's experience can be enhanced by easing ingress to, and/or egress from, a swim deck of the water-sports boat. Although various embodiments are disclosed herein in connection with water-sports boats, other types of boats and other watercraft can have a swim deck and/or a movable platform according to the embodiments disclosed herein.

Various embodiments of a powered swim platform are described herein. In some variants, the powered swim platform can actuate a platform between stowed and deployed positions. In some exemplary disclosures, the stowed position of the platform can be stowed above and/or in a swim deck of a watercraft (e.g., water-sports boat). In some exemplary disclosures, the deployed position of the platform can be at a lower elevation (height) relative to the swim deck of the water-sports boat, enabling a user to more easily mount the swim deck from water by stepping or sitting onto the deployed platform. The powered swim platform can include a gear assembly that enables an actuator to rotate the platform between the stowed and deployed positions. The gear assembly can include a cover that encloses, which can include partially encloses, the gears to prevent object(s) (e.g., debris, a user's hair or digits, etc.) from contacting or becoming entangled with the gears.

Various embodiments disclosed herein relate to a powered platform for a water-sports boat or other watercraft. The powered platform can include a platform that is configured to move between a stowed position and a deployed position. The platform can be located at a lower elevation in the deployed configuration than in the stowed configuration. An actuator can be operatively coupled to the platform to drive the platform between the stowed and deployed positions.

BRIEF DESCRIPTION OF THE DRAWINGS

Various embodiments are depicted in the accompanying drawings for illustrative purposes and may not be drawn to scale, and should in no way be interpreted as limiting the scope of the embodiments. In addition, various features of different disclosed embodiments can be combined to form additional embodiments, which are part of this disclosure.

FIG. 20 is a flowchart of an example method for automatically preparing a water-sports boat for docking, loading onto a trailer, and/or the like.

DETAILED DESCRIPTION

Although certain embodiments and examples are described below, this disclosure extends beyond the specifically disclosed embodiments and/or uses and obvious modifications and equivalents thereof. Thus, it is intended that the scope of this disclosure should not be limited by any particular embodiments described below.

Figure 1A:
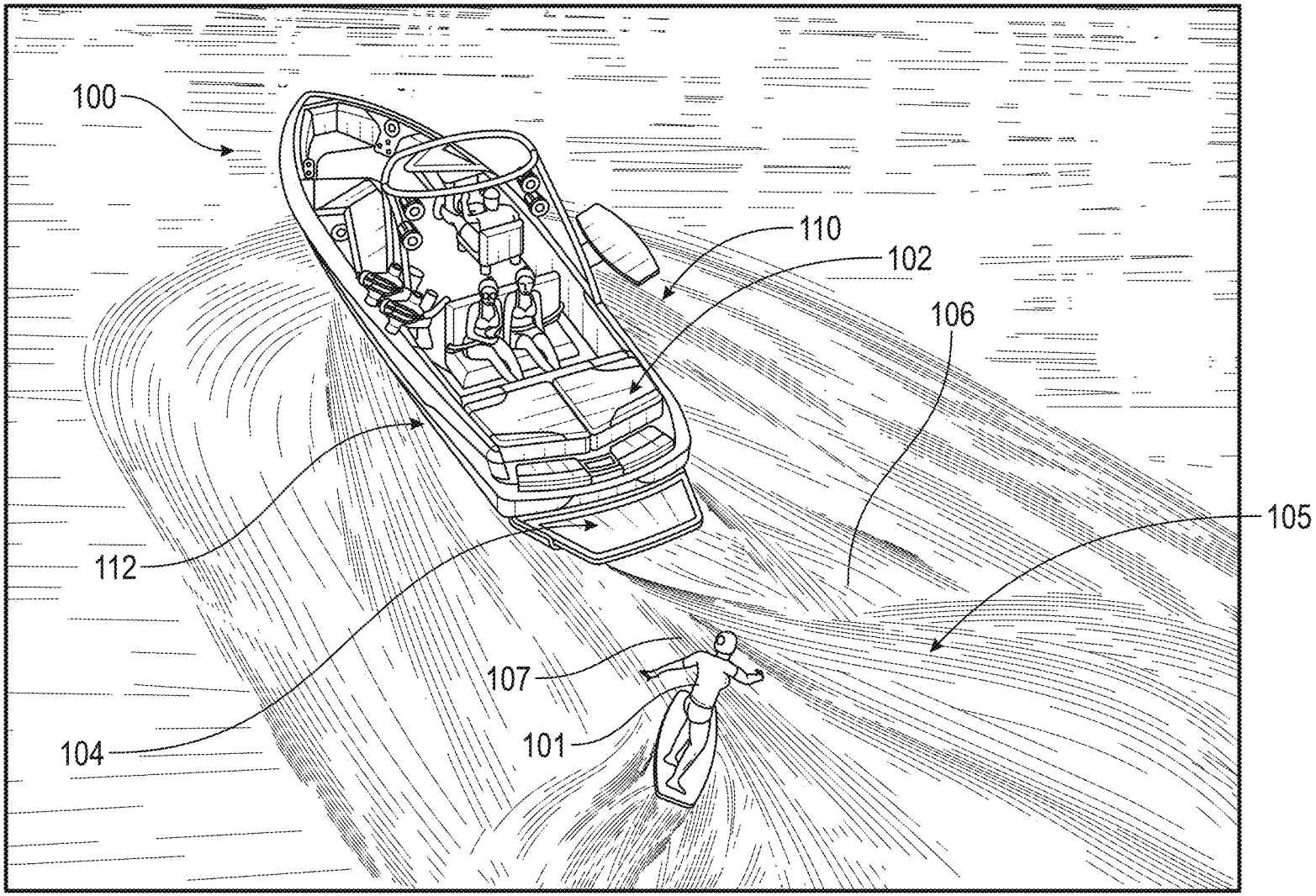
FIG. 1A illustrates an example water-sports boat with a rider wake surfing.

FIG. 1A illustrates an example water-sports boat (e.g., power boat, watercraft, boat, watercraft) 100 in use. The water-sports boat 100, as illustrated, is being used to create a wake 105 that can be surfed by the rider 101, in some examples, with or without the continued assistance of a tow rope. As the water-sports boat 100 travels through water, the water-sports boat 100 displaces water and thus generates waves including a bow wave and diverging stern waves on both sides of the water-sports boat 100. Due to pressure differences, these waves generally converge in the hollow formed behind the traveling water-sports boat 100 to form the wake 105. The wake 105 can be formed rearwardly away and in some examples, partially or completely offset from the stern 102 of the water-sports boat 100 to distance the rider 101 from the water-sports boat 100 while surfing.

Figure 1B:
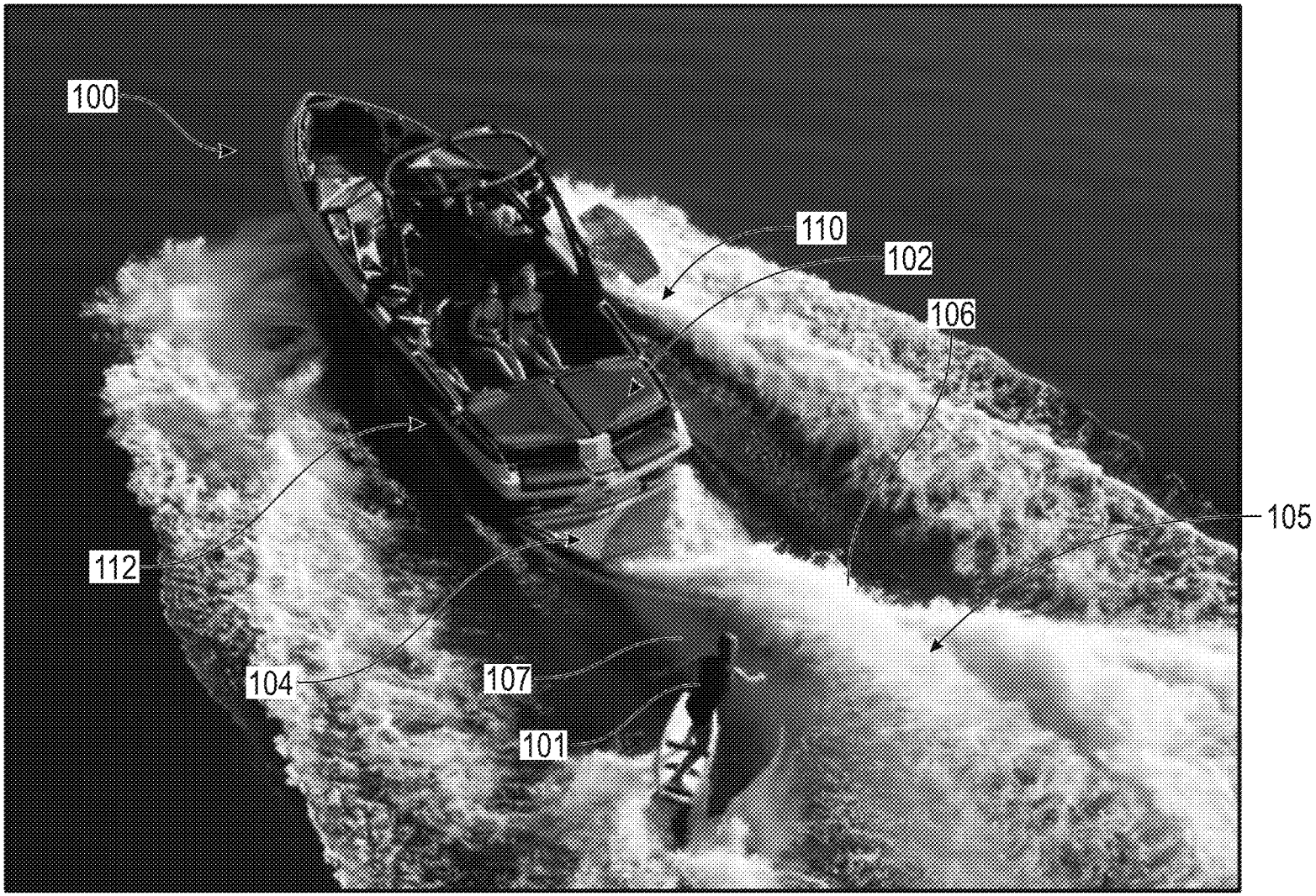
FIG. 1B shows a photograph of the subject matter of FIG. 1A.

The wake 105 is typically asymmetrical for wake surfing. In some boating systems, one side of the water-sports boat 100, for example, a port side 112 or starboard side 110, is lower in the water to form a suitable wave form for surfing in the wake 105. For example, as illustrated in FIG. 1A, the port side 112 is deeper in the water than the starboard side 110, forming a port-side portion 107 of the wake 105 into a steep wave that can be surfed. Lowering the port side 112 of the water-sports boat 100, especially at the stern 102, displaces more water on the port side 112 to form a larger and/or smoother wave for surfing on the port-side portion 107 of the wake 105. Other systems are designed to keep the hull level or mostly level and still displace water in a predetermined manner. As illustrated in FIG. 1A, a port-side portion 107 of the wake 105 is larger and smoother (e.g., more preferable for surfing) than the smaller and turbulent starboard-side portion 106. The stark contrast in smoothness is highlighted in the photograph of FIG. 1B, showing an organized smooth portion 107 juxtaposed against a disorganized turbulent portion 106. The lowered side of the water-sports boat 100 can be switched, such that starboard side 110 is lower in the water than the port side 112 to form a suitable wave form on the starboard-side portion 106 of the wake 105. In some variants, wave shaper(s), wedge(s), and/or a ballast tank system can be employed to form a suitable wave form for surfing in the wake 105. In some variants, the port side 112 and starboard side 110 are at equal positions in the water, while wave shaper(s) form a suitable wave form for surfing in the wake 105, as described elsewhere herein.

The water-sports boat 100 is not limited to wake surfing but can also be used for other water sports such as wakeboarding, water skiing, pulling inflatables (e.g., tubing), swimming, lounging, straightforward boating and many other water act ivies. In each of the foregoing water sports, the rider or swimmer 101 typically exits the boat 100 into the water to begin the activity. In other activities, the rider or swimmer may jump off any side of the boat. However, when finished, nearly everyone re-enters the boat 100 by way of the swim deck. For example, the freeboard around the remainder of the hull creates an often significant barrier for reentry. It is the swim deck that is just above the waterline, at the waterline, or when the boat is full of ballast, the top of the deck may be just below the waterline. In some examples, the top of the deck may be at the waterline, about six (6) to ten (10) inches above the waterline, to about six (6) to ten (10) inches below the waterline, often depending on the total ballast, including water ballast, people ballast, fuel, gear, etc. An artisan will recognize that different hull designs are configured to displace a certain amount of water and that displacement creates a range of where the waterline is with respect to the top surface of the swim deck. Added ballast of any kind changes that waterline.

When the top of the swim deck is a few inches below the waterline, it can still be difficult, however, for some riders or swimmers to repeatedly enter the water-sports boat from the water or enter the water from the water-sports boat 100. As the top rises out of the waterline, the foregoing difficulties are exacerbated.

Figure 2A:
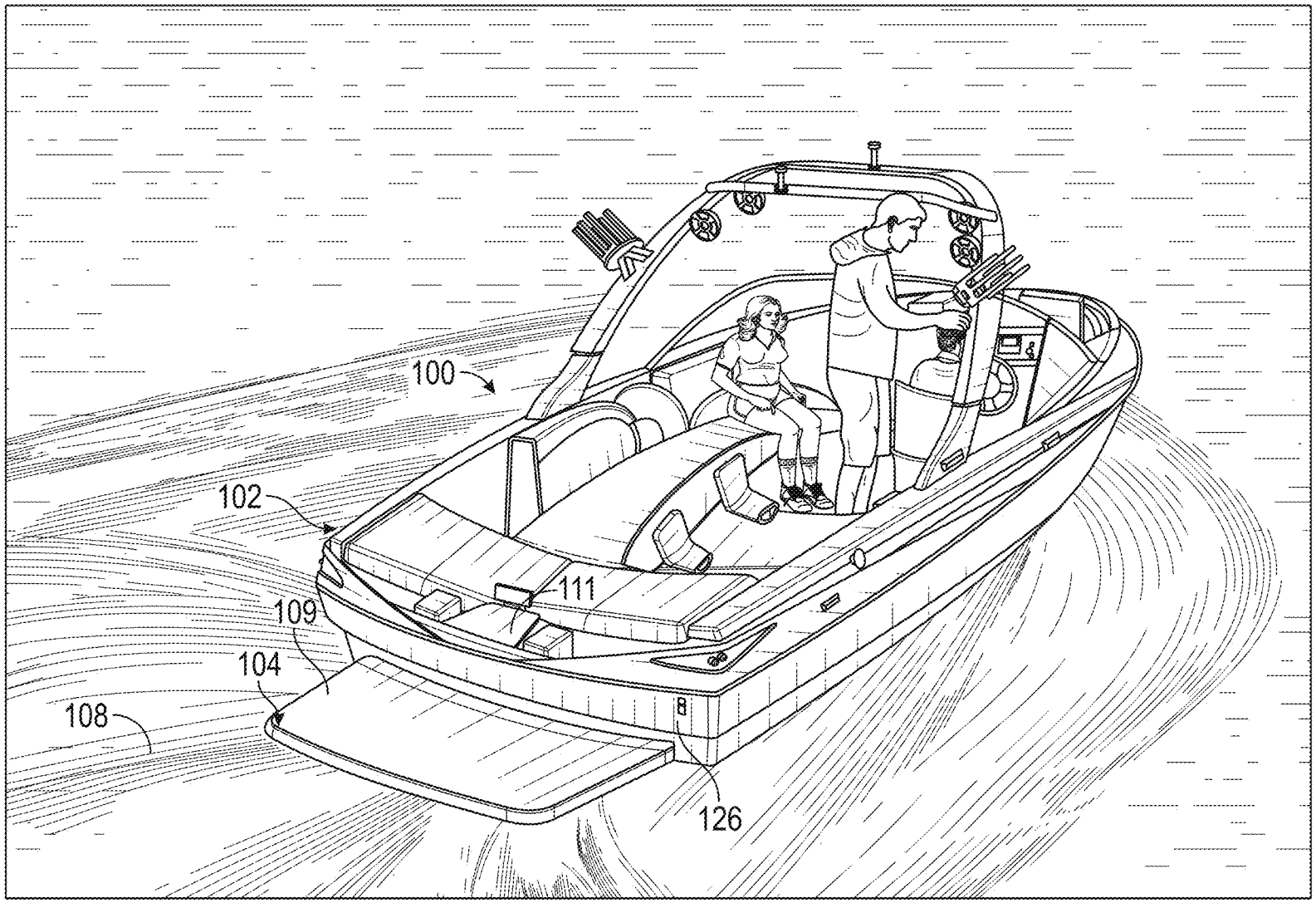
FIG. 2A illustrates an example water-sports boat in water with a swim deck.

As shown in FIG. 2A, the water-sports boat 100 can include a swim deck (deck) 104. The swim deck 104 can be disposed on a stern portion (stern) 102 of the boat 100. Specifically, the swim deck 104 can extend from the transom 126 of the boat 100. As illustrated, the swim deck 104 can be at a lower elevation relative to other weight supporting surface(s) 111 of the water-sports boat 100 while still including a top surface (upper surface, upper side, top side) 109 above and/or proximate the waterline 108. The swim deck 104 can aid riders or swimmers in ingressing into the boat 100 from the water and/or egressing from the boat 100 to the water. For example, for egress from the boat 100 to the water, a rider or swimmer might need to jump from the swim deck 104 above the waterline 108, at the waterline 108, or just below the waterline 108, sometimes depending on an amount of ballast loaded to displace the hull of the boat 100. The person may climb down to sit on the swim deck 104 to reduce the fall distance, but will still sink when leaving the deck 104 into the water. For ingress back into the boat 100 from the water, a rider or swimmer may have to lift their weight and that of attached or used sports gear (e.g., wakeboard, water ski, surf board, tube, etc.) out of the water. The user 101 can sit on the swim deck 104, or otherwise use the swim deck 104, to put on a water ski, wakeboard, or the like before entering the water and/or remove a water ski, wakeboard, or the like before re-entering the water-sports boat 100.

Figure 2B:
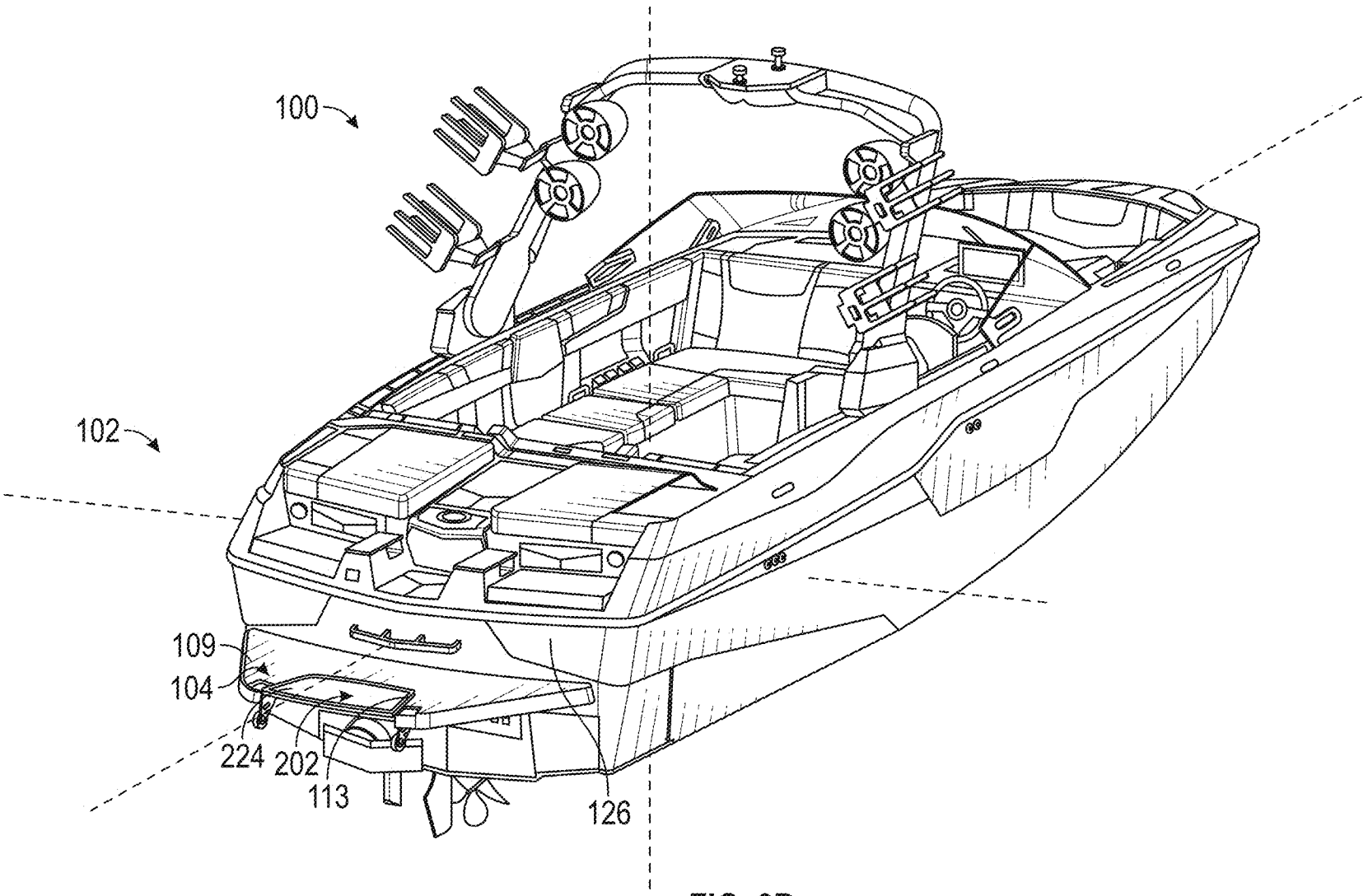
FIG. 2B illustrates an example water-sports boat with an exemplary deployable platform housed a least partially within a swim deck.

To improve the user's experience, the swim deck 104 can include a platform (swim platform, step, stand, board) 202, as shown in FIG. 2B. The platform 202 can assist the user in dismounting the swim deck 104 to water or mounting the swim deck 104 from the water. The platform 202 can be stowed (stored, disposed, positioned), as illustrated in FIG. 2B, within a receiving region (receiving space, recess, pocket, compartment, receptacle) 113 of the swim deck 104. Optionally, a first side (surface) 224 of the platform 202 can be flush with the surrounding top surface 109 of the swim deck 104 in the stowed position. Although various figures shows the swim deck 104 and platform 202 on a water-sports boat 100, other types of boats (cruisers, runabouts, pontoon boats, etc.) and other watercraft can have a swim deck 104 and/or a platform 202 according to the embodiments disclosed herein.

Figure 2C:
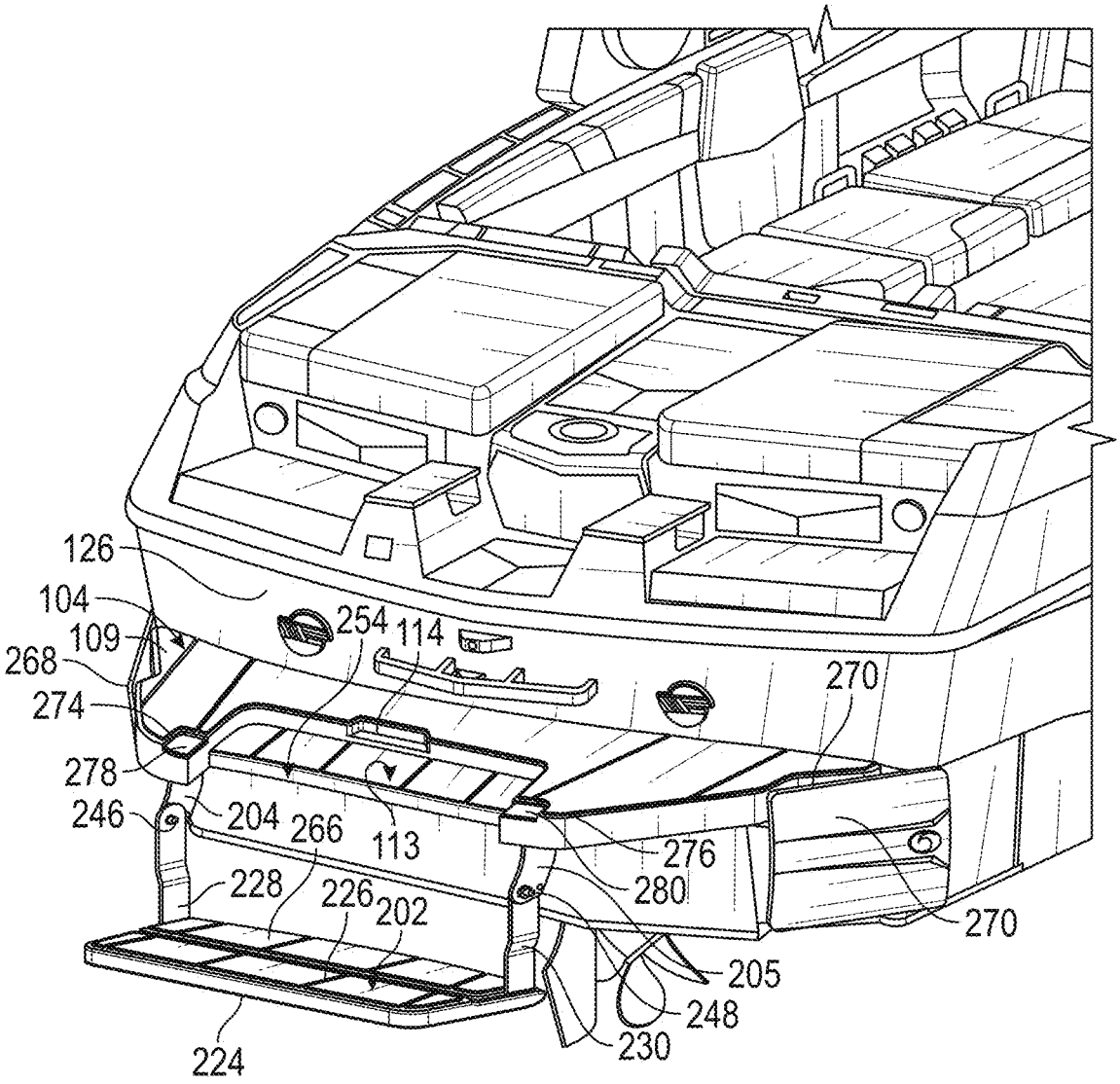
FIG. 2C illustrates a sternward portion of an example water-sports boat with a platform deployed from a swim deck.

The platform 202 can be moved (e.g., rotated) to a deployed position to assist the user in dismounting and mounting the swim deck 104, as shown in FIG. 2C. In the deployed positioned, the platform 202 can be submerged under water when the boat 100 is floating in water. A second side (surface) 226 of the platform 202 that is opposite the first side 224 can be mounted (e.g., stood upon, sat upon, knelt upon) by a user to ease mounting/dismounting the swim deck 104. The platform 202 can have a first arm (member, support, flange, appendage) 228 and/or second arm (member, support, flange, appendage) 230. In some variants, the platform 202 can have one, two, three, or four or more arms. The first arm 228 and/or second arm 230 can extend away from the second side 226 of the platform 202. The first arm 228 and/or second arm 230 can be disposed proximate the aft edge of the platform 202 when the platform 202 is in the stowed position. The first arm 228 and second arm 230 can be the same. The first arm 228 and the second arm 230 can be in mirrored configurations. The first arm 228 and the second arm 230 can be on and/or proximate opposing lateral sides (e.g., port and starboard sides) of the platform 202. The first arm 228 and the second arm 230 can be angled and/or curved inward such that the first arm 228 and second arm 230 can fit within a recess (gap, break) 254 of the swim deck 104 when the platform 202 is in the stowed position.

The first arm 228 of the platform 202 can be coupled to a first mount (support, panel, mounting panel, arm) 204. The first arm 228 can rotate relative to the first mount 204 to facilitate the rotation of the platform 202 between stowed and deployed positions. The first arm 228 and first mount 109 can be coupled at a first joint (pivot) 246 via a fastener (e.g., bolt, rod, shaft). In some variants, the first joint 246 and/or first arm 228 can be locked such that the platform 202 is selectively locked in the stowed or deployed positions. The first mount 204 can be coupled, which can include fixedly connected, to the swim deck 104. The first mount 204 can be disposed at an aft portion of the swim deck 104. The first mount 204 can include a first anchor (flange, clasp, hook) 278 that couples to the swim deck 104 within a first recess (groove, notch, indentation) 274. In some variants, the first mount 204 extends through the swim deck 104. In some variants, the first mount 204 can decouple from the swim deck 104. In some variants, the first mount 204 is integrated with the swim deck 104.

The second arm 230 of the platform 202 can be coupled to a second mount (support, panel, mounting panel, arm) 205. The second arm 230 can rotate relative to the second mount 205 to facilitate the rotation of the platform 202 between stowed and deployed positions. The second arm 230 and second mount 205 can be coupled at a second joint (pivot) 248 via a fastener (e.g., bolt, rod, shaft). In some variants, the second joint 248 and/or second arm 230 can be locked such that the platform 202 is selectively locked in the stowed or deployed positions. The second mount 205 can be coupled, which can include fixedly connected to the swim deck 104. The second mount 205 can include a second anchor (flange, clasp, hook) 280 that couples to the swim deck 104 within a second recess (groove, notch, indentation) 276. In some variants, the second mount 205 extends through the swim deck 104. In some variants, the second mount 205 can decouple from the swim deck 104. In some variants, the second mount 205 is integrated with the swim deck 104. The first mount 204 and second mount 205 can be disposed on opposing sides (e.g, starboard and port sides) of the receiving region 113.

The platform 202 can include a panel (step, rise, shelf, projection) 266. The panel 266 can be disposed on the second side 226 of the platform 202 such that the panel 266 is oriented facing up when the platform 202 is deployed. The panel 266 can help to prevent the user from sliding aft of the platform 202 and underneath the swim deck 104. The panel 266 can help to cue the user to the user's position relative to the aft edge of the platform 202. In some variants, the panel 266 can be an integral portion of the platform 202. In some variants, the panel 266 can be coupled to the second side 226 of the platform 202. The panel 266 can be made of a different material than the main portion of the second side 226 of the platform 202, so that the user can feel the difference of the panel 266 material as an indication that the user is at or near an edge of the platform. The panel 266 can be raised or lowered relative to the main portion of second side 226 of the platform 202, or can be separated therefrom by a gap or ridge or other tactile feature that a user can feel. The panel 266 can be positioned in a gap (break, recess) 254 of the swim deck 104 when the platform 202 is rotated into the stowed position. The panel 266 can include a textured surface, which can increase friction between a user and the panel 266 to prevent slipping, and/or a cushion material.

The platform 202 can be rotated into the receiving region 113 to be stowed. In the stowed position, the second side 226 of the platform 202 can face down into the receiving region 113 such that the first side 224 is facing up. The first side 224 can support the user as the user maneuvers about the upper surface 109 of the swim deck 104. The first side 224 can be positioned above the second side 226 of the platform 202, when the platform 202 is in the stowed position. In some variants, the platform 202 can be locked in the stowed position to prevent unintentional deployment. In the deployed position the second side 226 of the platform 202 can face up, and the first side 224 can face down. Since the first side 224 of the platform can be configured to support a user in the stowed position, and the second side 226 of the platform can be configured to support a user in the deployed position, both or one of the first side 224 and the second side 226 of the platform 202 can include a grip material (e.g., soft grip) to increase friction and prevent slipping, or a cushion material, etc.

The receiving region 113 of the swim deck 104 can have a pocket (hand recess, groove) 114 that can enable the user to firmly grasp the platform 202 for deployment. For deployment, the user can grasp the platform 202 and rotate the platform 202 away from the swim deck 104. The user can rotate the platform 202 away from the swim deck 104 until gravity rotates the platform 202 to the final deployed position, as illustrated in FIG. 2C.

Figure 2D:
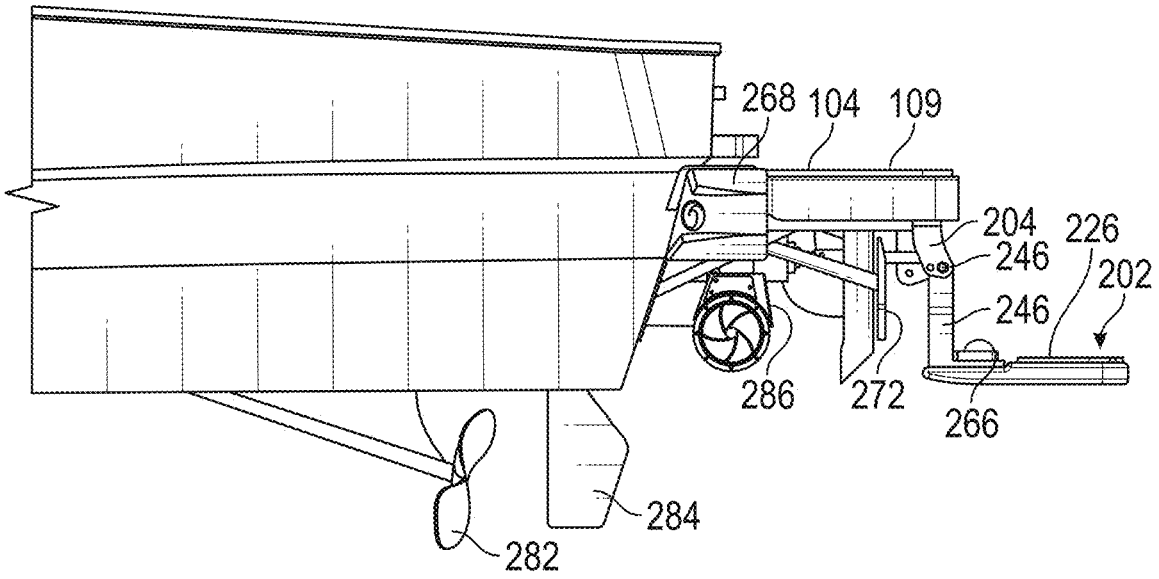
FIG. 2D illustrates another view of the sternward portion of the example water-sports boat of FIG. 2C with the platform deployed from the swim deck.

The water-sport boats 100 can include one or more wake modify features, as illustrated in FIGS. 2C-2D. The water-sports boat 100 can include one or more wake/wave shaper(s) (water diverter(s), flap(s), tab(s)) 268, 270 that can be mounted, which can include adjustably mounted, to the water-sports boat 100 for deflecting water travelling past the transom 126 of the water-sports boat 100 to shape a wake for surfing. The wake/wave shaper(s) 268, 270 can be controlled by a wave/wake shaper system 343, described in reference to FIG. 4. The wake/wave shaper 268 can be positioned on the port side 112 and/or stern 102 of the boat 100. The wake/wave shaper 270 can be positioned on the starboard side 110 and/or stern 102 of the boat 100. In some variants, the wake/wave shapers 268, 270 can be stowed, as illustrated in FIG. 2C, in recesses of the swim deck 104. One such device is commercially available from Malibu Boats, LLC of Louden, Tenn., under the product name "SURF GATE®," which is similar to those flaps described in U.S. Pat. Nos. 9,260,161 and 9,914,504, the entire contents of which are incorporated by reference herein. Other commercially available surf shapers include tabs or blades manually operated, electronically controlled, suction or bolt-on adherement devices, and the like.

The water-sports boat 100, as illustrated in FIG. 2D, can include a wake-modifying device (wedge) 272 to enhance the overall size of the wake formed by the watercraft. One such device is commercially available from Malibu Boats, LLC of Louden, Tenn. under the product name, "Power Wedge," which is similar to that described in U.S. Pat. No. 7,140,318, the entire content of which is incorporated herein for all purposes by this reference. Another such device may incorporate pivotal centerline fins of the type developed by Malibu Boats and described in U.S. Pat. No. 8,534,214, the entire content of which is also incorporated herein for all purposes by this reference.

The wake/wave shaper(s) 268, 270 and wake-modifying device 272 can modify the configuration of a wake, such as the shape and/or size. The wake/wave shaper(s) 268, 270 and/or wake modifying device 272 can be used with a ballast tank system to produce wakes of a greater size. The ballast tank system can utilize tanks that can fill and empty to selectively increase the weight of the water-sports boat 100 to produce wakes of greater size and/or different configurations.

The water-sports boat 100 can include a propeller 282 or similar device to propel the water-sports boat 100 and a rudder 284 or similar device to direct the movement of the water-sports boat 100. In some variants, the water-sports boat 100 can include a thruster 286, as shown in FIG. 2D. The thruster 286 can be used to rotate/pivot the stern 102 of the water-sports boat 100, which can be useful when docking, loading onto a trailer, and/or picking up a fallen rider from the water. The thruster 286 can include an electric motor which can be water cooled to allow for increased continuous use. The thruster 286 can be integrated into the transom 126. The thruster 286 can operate independent from the steering wheel of the water-sports boat 100. The thruster 286 can be integrated with the wake-modifying device (e.g., wedge) 272. The thruster 286 can be positioned out of the water when the boat 100 is on plane. One such device is commercially available from Malibu Boats, LLC under the product name "Stern Turn." In some variants, the thruster 286 may pivot to provide thrust in more directions than starboard 110 or port 112, such as thrust in up to 360 degrees. In some variants, more than one thruster 286 can be disposed on the water-sports boat 100. In some variants, a thruster 286 can be disposed proximate the bow of the water-sports boat 100.

It can be difficult to deploy and stow the platform 202 manually, in some cases. For example, it can be difficult for a user in the water to reach up to the pocket 114, grasp the platform 202, and rotate the platform 202 away from the swim deck 104 for deployment. It can be difficult for a driver to navigate the boat 100 to a fallen rider in the water and move aft to manually deploy the platform 202. It can be difficult for a user to stand on the swim deck 104 while deploying the platform 202. It can be difficult for the user, driver, or other operator to reach the platform 202 underwater and rotate the platform 202 into the receiving region 113 for stowage.

Figure 3:
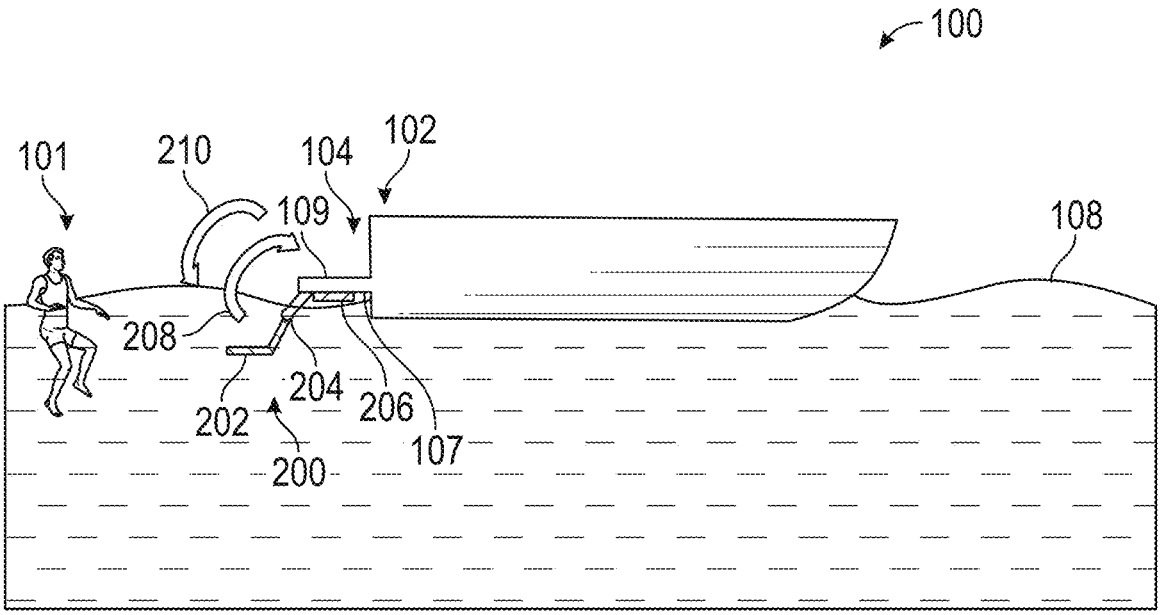
FIG. 3 schematically illustrates an example powered swim platform.

A powered swim platform (powered platform, powered swim step, powered step) 200, shown in FIG. 3, can automatically deploy and/or stow the platform 202, which can improve the user's experience. The powered swim platform 200 can automatically move (e.g., rotate) the platform 202 in a first direction 210 to a deployed position, as illustrated in FIG. 3. The powered swim platform 200 can automatically move (e.g., rotate) the platform 202 in a second direction 208, opposite the first direction 210, to a stowed position. In the stowed position, the platform 202 can be positioned at least partially within the swim deck 104, at least partially above the swim deck 104, and/or at least partially removed from the water. An actuator 206 can move (e.g., rotate) the platform 202 between the stowed and deployed positions. The platform 202 can rotate about an axis of rotation that is at a lower elevation (height) than the swim deck 104.

In the deployed position, the platform 202 can be positioned to assist the user in mounting/dismounting the swim deck 104. The platform 202 can be positioned within water supporting the water-sports boat 100. The platform 202 can be positioned below the water line 108. The platform 202 can be positioned at a lower elevation (height, position) relative to the swim deck 104. The platform 202 in the deployed position can be mounted (e.g., stood upon) by the user, which can position the user at a higher elevation (height, position) relative to the swim deck 104 compared to the elevation of the user within the water. The deployed platform 202 can advantageously enable the user to more easily step onto, sit on, or otherwise mount the swim deck 104 from the water or enter the water from the swim deck 104.

Figure 4:
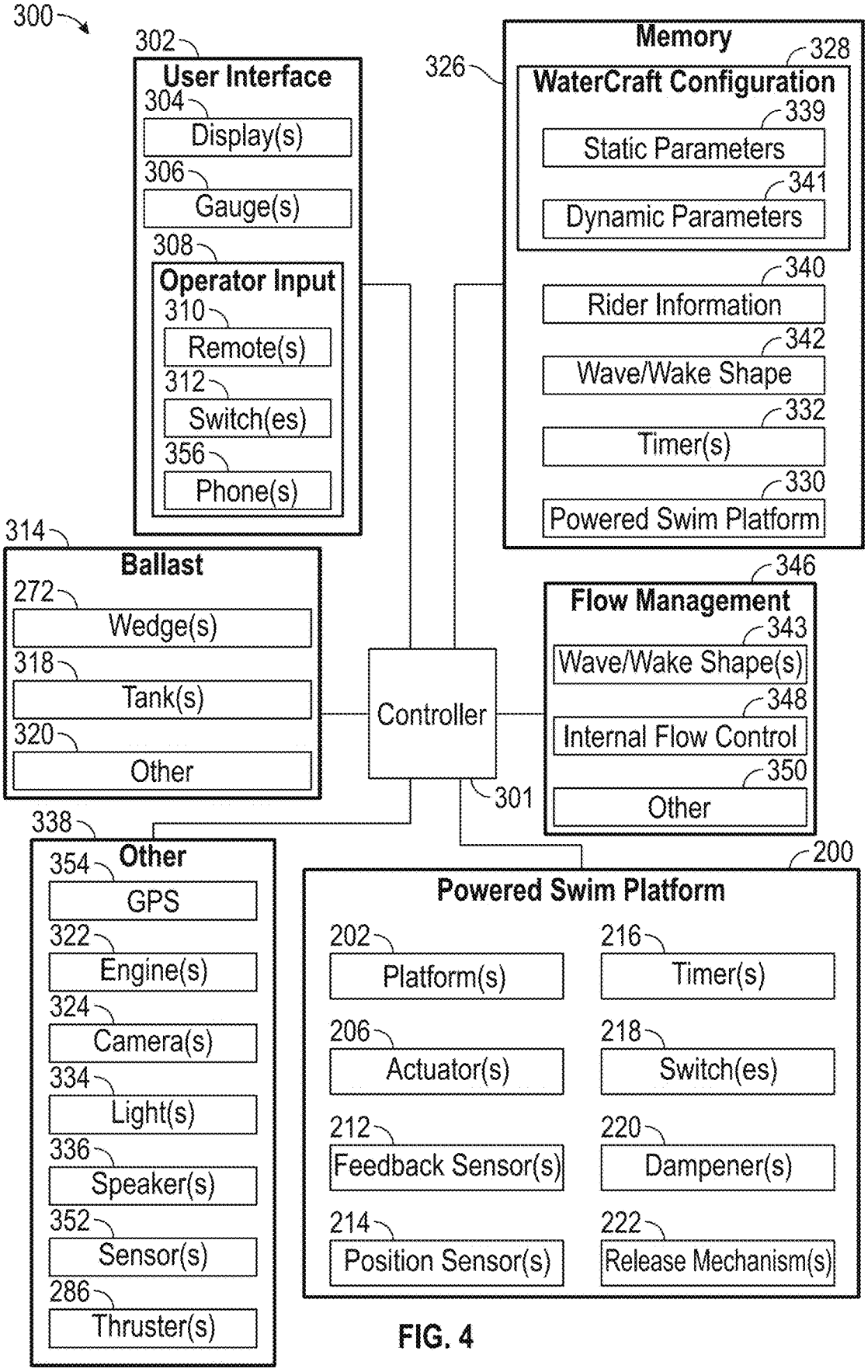
FIG. 4 schematically illustrates an example control system.

FIG. 4 schematically illustrates an example control system 300. The architecture of the control system 300 can include an arrangement of computer hardware and software components used to implement aspects of the present disclosure. The control system 300 may include more or fewer elements than those shown in FIG. 4. It is not necessary, however, that all of these elements be shown in order to provide an enabling disclosure.

The control system 300 can be integrated into the water-sports boat 100, for example, fully integrated with a CAN bus of the water-sports boat 100. In some variants, the control system 300 or a portion thereof can be an aftermarket solution which may be installed on and/or otherwise connected with the water-sports boat 100, which can include connecting into the CAN bus or operating independently of the CAN bus. The control system 300, in some variants, can control the powered swim platform 200 and/or other systems and features of the water-sports boat 100, such as those illustrated in FIG. 4, which can include a ballast system 314, wedge(s) 272, tank(s) 318, engine(s) 322, camera(s) 324, light(s) 334, speaker(s) 336, thruster(s) 286, etc. The control system 300 can include a controller 301 that is in communication, via a data communication technique (e.g., wired and/or wireless) with a memory system 326, user interface 302, ballast system 314, powered swim platform 200, flow management system 346, and/or other systems 338.

The user interface 302 can provide (e.g., display) information to an operator and/or receive input from the operator. The user interface 302 and/or portions thereof can be integrated into the water-sports boat 100, such as built into a console proximate an operator's seat. The user interface 302 and/or portions thereof can be an application on a portable device, such as an operator's phone 356. The user interface 302 can include display(s) 304 and/or gauge(s) 306. In some variants, the display(s) 304 can be the operator's phone 356. The display(s) 304 can show status/configuration information regarding the water-sports boat 100 and/or the systems thereof. For example, the display(s) 304 can illustrate the position of the platform 202, such as whether the platform 202 is in the stowed, deployed, and/or intermediate position. In some variants, the display(s) 304 can illustrate an angle of the platform 202, which can include an angle in real time. In some variants, the display(s) 304 can show a view from camera(s) 324. The camera(s) 324 can show a view of the stern portion 102, stern side, swim deck 104, powered swim platform 200, and/or platform 202, which can advantageously enable an operator of the water-sports boat 100 to monitor the status of the swim deck 104, powered swim platform 200, platform 202, and/or the user proximate the platform 202 and/or swim deck 104 without turning to look aft. In some variants, the display(s) 304 can display a view from the camera(s) 324 when the powered swim platform 200 is commanded to stow or deploy and/or is in the process of stowing or deploying. In some variants, the display(s) 304 can display an alert when the powered swim platform is commanded to stow or deploy and/or is in the process of stowing or deploying. The gauge(s) 306 can display information such as fuel level, battery level, fill level of the ballast tank(s) 318, etc.

The user interface 302 can receive operator input 308. The user interface 302 can receive operator input 308 to control the powered swim platform 200 and/or other systems, features, etc. of the water-sport boat 100. In some variants, the display(s) 304 are touch screen(s) that can receive operator input. In some variants, an operator and/or user can operate a switch(es) (button(s), switch(s), touch screen(s), knob(s), toggle(s), etc.) 312 to control the powered swim platform 200. For example, the switch 312 (or other user input element) can be manipulated to command the powered swim platform 200 to deploy or stow. In some variants, a phone 356, such as a smartphone (e.g., iPhone, Android operated phone, etc.), can be used to command the powered swim platform 200 and/or monitor the status of the powered swim platform 200 via an application.

In some variants, the switch(s) 312 can be located at or proximate the driving console (e.g., cockpit, control center, steering) to be easily accessible by an operator, which can include on the display(s) 304. In some variants, the switch(s) 312 can be located at or proximate the stern portion 102 of the water-sports boat 100, which can include a position accessible to the user when in the water and/or proximate the swim deck 104. In some variants, the switch(s) 312 is on an operator's portable device, such as a phone 356. In some variants, the switch(s) 312 is on a remote 312 that can be carried and/or worn by the user 101 and/or operator. In some variants, the switch(s) 312 is on another location of the water-sports boat 100. Various other types of user input elements can be used instead of, or in addition to, the switch(s).

The ballast system 314 can include various systems to control the depth of the hull of the water-sports boat 100 within water, which can modify the wake 105. The ballast system 314 can include the wedge(s) 272, described herein. The ballast system 314 can include tank(s) 318, which can be filled or emptied to adjust the hull level of the boat 100. The ballast system 314 can include other systems 320 to adjust the hull position of the boat 100.

The flow management system 346 can include the wave/wake shaper(s) system 343 which can control the wake/wave shaper(s) 268, 270. The flow management system 346 can include internal flow control 348, which can monitor the flow of water into and out of the ballast tank(s) 318. The flow management system 346 can include other systems 350.

The other systems 338 can include the engine(s) 322, camera(s) 324, light(s) 334, speaker(s) 336, sensor(s) 352, GPS 354, and/or thruster(s) 286. The camera(s) 324 can capture varying views of the water-sports boats 100 and surroundings. For example, the camera(s) 324 can capture an aft view that can show a rider. In some variants, the camera(s) 324 can be used to detect when a rider has fallen into the water such that the control system 300 can alert the operator via the display(s) 304, light(s) 334, phone(s) 356, and/or speaker(s) 336. In some variants, the camera(s) 324 can provide the control system 300 with the current position of the rider such that the control system 300 can adjust the configuration of the wedge(s) 272, ballast tank(s) 318, and/or wake/wave shaper(s) 268, 270 to create a suitable wake based on the rider position. For example, the control system 300 can, in some variants, switch the surfing wake from the starboard side 110 to the port side 112 upon detecting that the rider has switched from the starboard portion 106 to the port portion 107 of the wake 105. The light(s) 334, speaker(s) 336, and/or display(s) 304 can provide alerts to the operator.

The sensor(s) 352 can include orientation sensor(s) that detect the pitch, roll, and/or yaw orientations of the water-sports boat 100. In some variants, an orientation sensor(s) can detect heave of the water-sports boat 100. In some variants, the sensor(s) 328 can include depth sensor(s) that can detect the depth of the water in which the water-sports boat 100 is positioned. In some variants, the powered swim platform 200 will not deploy the platform 202 if the depth of water is not at or above a predetermined depth. In some variants, the powered swim platform 200 will automatically stow the platform 202 if the water depth is not at or above a predetermined depth The sensor(s) 352 can include speed sensor(s) that can determine the travel speed of the water-sports boat 100. The sensor(s) 352 can determine if the water-sports boat 100 is moving.

The GPS 354 can detect the location, speed, and/or movement of the water-sports boat 100. In some variants, the control system 300 can determine that the water-sports boat 100 is in an area with restrictions and control the various systems accordingly. For example, the control system 300 can determine, via the GPS 354, that the water-sports boat 100 is in a wake restriction area and control the size of the generated wake accordingly and/or alert the operator. In some variants, the water-sports boat 100 via GPS 354 can determine that the water-sports boat 100 is in an area that prohibits the use of ballast tanks and alert the operator and/or prohibit use of the ballast tank(s) 318.

As described elsewhere herein, the thruster(s) 286 can be used to turn, rotate, and/or pivot the water-sports boat 100. The thruster(s) 286 can improve the driver's control of the water-sports boat 100 for at least docking, loading onto a trailer, and/or collecting a fallen rider.

The powered swim platform 200 can include the platform 202, which is described in more detail elsewhere herein. The platform 202 can be actuated by the actuator 206 between the stowed and deployed positions. The actuator 206 can be a hydraulic actuator, electric actuator, electric hydraulic actuator, pneumatic actuator, linear actuator, rotary actuator, motor, and/or another suitable actuator. In some variants, the actuator 206 can be disengaged and/or otherwise facilitate manual manipulation of the platform 202. In some variants, the powered swim platform 200 includes a release mechanism 222 that enables an operator to manually maneuver the platform 202 between the stowed and deployed positions. In some variants, the release mechanism 222 is a pressure-release valve of the electric hydraulic actuator 206 that, when opened, enables the operator to manually maneuver the platform 202. In some variants, the platform 202 may not move or may not substantially move without actuation by the actuator 206 unless the release mechanism 222 is manipulated, which can advantageously impede unwanted movement of the platform 202.

The powered swim platform 200 can include a position sensor 214. The position sensor 214 can sense the status (e.g., position, location) of the platform 202, such as deployed, deploying, stowed, stowing, etc. The position sensor 214 can sense the angle of the platform 202, such as the angle of the platform 202 between the stowed and deployed positions. The position sensor 214 can verify that the platform 202 is at an expected location after the powered swim platform 200 begins to deploy or stow. For example, the platform 202 can have an expected position after a given amount of time upon commencing deployment or stowage. The powered swim platform 200 can have a timer 216 and/or the memory system 326 can have a timer 332 that begins counting upon commencing deployment or stowage of the platform 202. The control system 330 can compare the position (e.g., angle) of the platform 202 sensed by the position sensor 214 against the expected position (e.g., angle) of the platform 202 based on the elapsed time counted by the timer 332 and/or timer 216. The expected position can be saved in the memory system 326 (e.g., powered swim platform information 330). If the sensed position and the expected position are not the same and/or deviate beyond a predetermined range, the powered swim platform 200 can initiate operations, such as stopping deployment/stowage of the platform 202, alerting the operator and/or user with the light(s) 334, speaker(s) 336, and/or display(s) 304, and/or starting deployment/stowage of the platform 202.

In some variants, the powered swim platform 200 can include a feedback sensor 212. The feedback sensor 212 can sense if the actuator 206 is under a level of resistance and/or stress that exceeds a predetermined amount, which can indicate that the movement pathway of the platform 202 is obstructed. For example, the actuator 206 can experience a range of resistances depending on the circumstances of deployment/stowage. The resistance may be higher if the water-sports boat 100 is sitting lower in the water such that the platform 202 travels a larger distance through water, to or from a deeper depth, etc. If the resistance, however, exceeds a predetermined amount, the control system 300 can initiate operations, such as stopping deployment/stowage of the platform 202, alerting the operator and/or user 101 with the light(s) 334, speaker(s) 336, and/or display(s) 304, and/or starting deployment/stowage of the platform 202.

The powered swim platform 200 can include a dampener (shock) 220. The actuator 206 can drive the gears to maneuver (e.g., rotate) the platform 202 through the majority of the range of motion between the deployed and stowed positions (e.g., to proximate the deployed or stowed position) and the dampener 220 can drive the gears to maneuver (e.g., rotate) the platform 202 through the remainder of the range of motion to arrive at the final deployed or stowed position. In some variants, the actuator 206 drives (e.g., rotates) the platform 202 until within less than 1, 1-5, 5-10, 10-15, 15-20, 20-25, or greater than 25 degrees of the final deployed or stowed position. In some variants, the dampener 220 moves (e.g., rotates) the platform 202 the remaining less than 1, 1-5, 5-10, 10-15, 15-20, 20-25, or greater than 25 degrees to arrive at the final deployed or stowed position. The dampener 220 can provide a soft stop or finish, which can prevent damage to the powered swim platform 200 if an object interferes with stowing or deploying the platform 202. In some variants, the powered swim platform 200 does not have a dampener 220 and the actuator 206 drives (e.g., rotates) the platform 202 the entire range of motion between the deployed and stowed positions.

In some variants, the powered swim platform 200 can include one or more switches (or other user input element(s)) 218 that the operator or user 101 can use to command the powered swim platform 200 to maneuver (e.g., rotate) the platform 202 between the stowed and deployed configuration. The switch 218 can be positioned proximate the steering controls of the boat 100, proximate the platform 202 and/or swim deck 104 such that the switch 218 is accessible to a user in the water or on the swim deck 104, and/or at another location on the boat 100. In some variants, the powered swim platform 200 can include a shear point or breakaway point, such that the platform 202 will break away from the swim deck 104 upon the platform 202 colliding with an object with significant force. For example, the first arm 228 and second arm 230, or the first joint 246 (e.g., fastener, rod, etc.) and second joint 248 (e.g., fastener, rod, etc.), or first mount 204 and second mount 205, or any other suitable portion of the platform assembly can be configured to have a breaking point at less force than other portions of the platform assembly, the swim platform, and the couplings to the boat.

The memory system 326 can generally include RAM, ROM and/or other persistent auxiliary or non-transitory computer-readable media. The memory system 326 can store an operating system that provides computer program instructions for the controller 301 in the general administration and operation of the powered swim platform 200 and/or other systems, features, etc., which can at least include the methods described herein. The memory system 326 can store watercraft configuration information 328, which can include static parameters 339 such as hull shape, hull length, weight, etc., and/or dynamic parameters 341 such as passenger weight, ballast tank(s) 138 status, wedge 272 status, speed, water depth, fuel, wind conditions, engine 322 status, wave/wake shaper(s) system 343 status, etc. The memory system 326 can store powered swim platform information 330, which can include operation instructions for maneuvering the platform 202 between the stowed and deployed configurations, expected position (e.g., angle) of the platform 202 during stowage and/or deployment, safety operation instructions, current position of the platform 202, status of the powered swim platform 200, etc.

The memory system 326 can store rider information 340, such as favorite configurations of the wedge 272, ballast tank(s) 318, wave/wake shaper(s) system 343, speed of the water-sports boat, etc. This can enable the rider to conveniently store and reselect favorite configurations without reselecting the desired configuration for each of the wedge 272, ballast tank(s) 272, wave/wake shaper(s) system 343, speed of the water-sports boat, etc. The memory system 326 can include wave/wake shape instructions 342 to control the wedge 130, ballast tank(s) 318, wave/wake shaper(s) system 343, speed of the water-sports boat 100, etc. to create a suitable wake shape for water skiing, wake boarding, surfing, pulling inflatables, minimizing a wake, reducing fuel use, improving the speed of the water-sports boat 100, improving riding comfort, etc. The memory system 326 can include wave/wake shape instructions 342 to control the wedge 130, ballast tank system 132, foil displacement system 138, wave/wake shaper(s) system 343, speed of the water-sports boat 100, etc. to create wakes of varying sizes, such as large, medium, and/or small wakes, and/or to position a surfing wave in the port, starboard, and/or center position. In some variants, the memory system 326 includes a timer 332 to determine whether the powered swim platform 200 and/or other system is performing correctly, as described elsewhere herein. The memory system 326 can include operation instructions for performing all the methods and actions described herein.

In some variants, the powered swim platform 200 may deploy and/or stow the platform 202 if certain conditions are met. For example, the powered swim platform 200 may deploy the platform 202 if the engine 322 of the water-sports boat 100 is not running and/or if the water-sports boat 100 is not moving or moving at or below a predetermined speed. In some variants, the powered swim platform 200 may deploy the platform 202 if the water-sports boat 100 is within at least a predetermined depth of water. In some variants, the powered swim platform 200 may not deploy the platform 202 if an object is positioned within the expected movement pathway of the platform 202, which can be detected by the camera(s) 324 and/or another sensor that can detect the presence of an object. In some variants, the engine 322 will not start if the powered swim platform 200 is deployed and/or not in the stowed position. In some variants, the powered swim platform 200 will automatically stow if the engine 322 is commanded to start and/or the water-sports boat 100 is commanded to move and/or is moving at or above a predetermined speed. In some variants, the powered swim platform 200 will not deploy and/or stow if an object is on the swim deck 104, which can be detected by the camera(s) 324 and/or another sensor that can detect the presence of an object. In some variants, the operator input 308 includes a go-home switch (button) that, when manipulated, can automatically stow the powered swim platform 200, stow the wedge 272 upon forward movement of the boat 100, empty the tank(s) 318 of the ballast system 314, stow the wake shaper(S) 268, 270, and/or perform other automated tasks to prepare the water-sports boat 100 for docking, loading onto a trailer, etc.

In some variants, the light(s) 334 alert an operator and/or user that the powered swim platform 200 is about to deploy or stow, is deploying or stowing, and/or is deployed or stowed. In some variants, the light(s) 334 can provide a unique alert for when the powered swim platform 200 is about to deploy or stow, is deploying or stowing, and/or is deployed or stowed. This can alert the operator and/or user of the anticipated and/or current status of the powered swim platform 200. The alerts of the light(s) 334 can include flashes, flashing patterns, reduced brightness, increased brightness, colors, and/or other cues. In some variants, the light(s) 334 can indicate when there is an issue with the powered swim platform 200. In some variants, the light(s) of an operator's portable device (e.g., phone 356) can provide an alert.

In some variants, the speaker(s) 336 can alert an operator and/or user that the powered swim platform 200 is about to deploy or stow, is deploying or stowing, and/or is deployed or stowed. In some variants, the speaker(s) 336 can provide a unique alert for when the powered swim platform 200 is about to deploy or stow, is deploying or stowing, and/or is deployed or stowed. This can alert the operator and/or user of the anticipated and/or current status of the powered swim platform 200. The alerts of the speaker(s) 336 can include a variety of sounds. In some variants, the speaker(s) of an operator's portable device (e.g., phone 356) can provide an alert. In some variants, the speaker(s) 336 can indicate when there is an issue with the powered swim platform 200. Various other types of alerts can be used, such as a display of text or a symbol.

Figure 5:
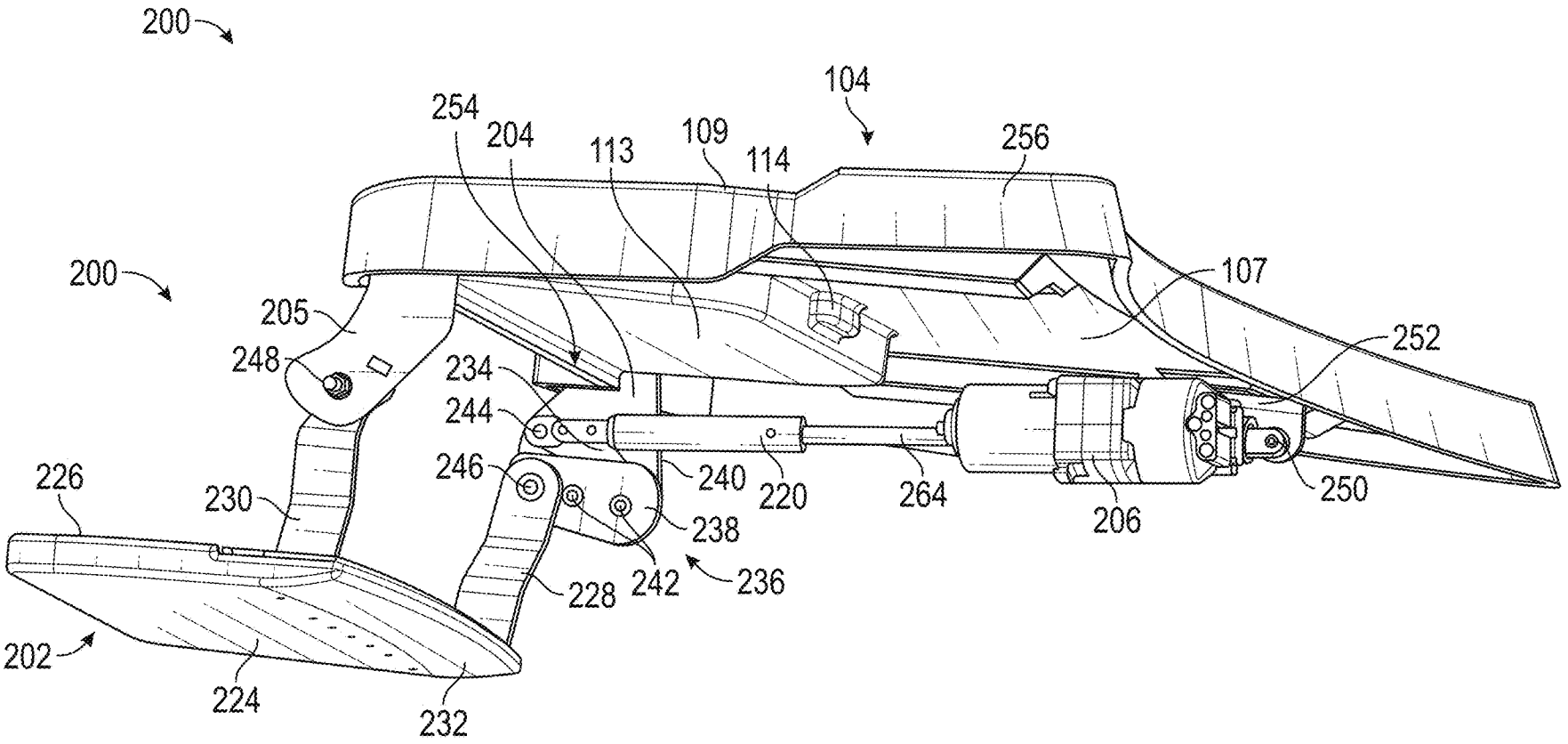
FIG. 5 illustrates an example powered swim platform with the platform deployed.

FIGS. 5-12 illustrate an example of the powered swim platform 200. As illustrated in FIG. 5, the platform 202 is in the deployed position which can assist the user in mounting and dismounting the swim deck 104. The platform 202 has a first side (surface) 224 and a second side (surface) 226. The first side 224 and second side 226 are on opposing sides (surfaces) of the platform 202. In the deployed position, the first side 224 is positioned below (lower than) the second side 226 or, stated differently, the second side 226 is positioned above (higher than) the first side 224. In the deployed position, the second side 226 is configured to support the user.

In the stowed position, the platform 202 is maneuvered (e.g., rotated) to be positioned within the receiving region 113 of the swim deck 104, as shown and described in reference to FIGS. 9-12. In the stowed position, the first side 224 is positioned above (higher than) the second side 226 or, stated differently, the second side 226 is positioned below (lower than) the first side 224. In the stowed position, the first side 224 is configured to support the user.

The first side 224 can include an inclined surface (chamfer) 232. The inclined surface 232 can be disposed on and/or proximate an edge of the platform 202, such as the edge of the platform 202 and/or first side 224 that is most aft when the platform 202 is stowed. The inclined surface 232 can increase the comfort of the user 101 while using the platform 202. For example, the inclined surface 232 may enable the user 101 to comfortably hang the user's legs off the aft side of the swim deck 204 while the user is seated on the first side 224 of the platform 202 in the stowed position, the aft side being substantially free of sharp edges.

The platform 202 may be made of a variety of materials, such as fiberglass, metal(s) (steel, aluminum, etc.), metal alloy(s), polymers, and/or other suitable materials. In some variants, the platform 202 can include grip, such as soft grip, to increase friction (e.g., increase surface area) between the user and the platform 202 which can enable the user to more easily stand and/or otherwise mount the platform 202. In some variants, the first side 224 and/or the second side 226 have grip applied thereto. In some variants, the first side 224 and/or second side 226 have friction-increasing texture(s), surface area increasing texture(s), and/or roughened surfaces.

The platform 202 can have a first arm 228 and/or second arm 230, as described herein. In some variants, the platform 202 can have one, two, three, or four or more arms. The first arm 228 can be coupled to the first mount 204. The first mount 204 can be coupled, which can include attached, fixedly connected, etc., to the swim deck 204. The first mount 204 can be positioned between the receiving region 113 and an outer wall 256 of the swim deck 104. The first mount 204 can extend away from the bottom surface 107 of the swim deck 104.

Figure 6:
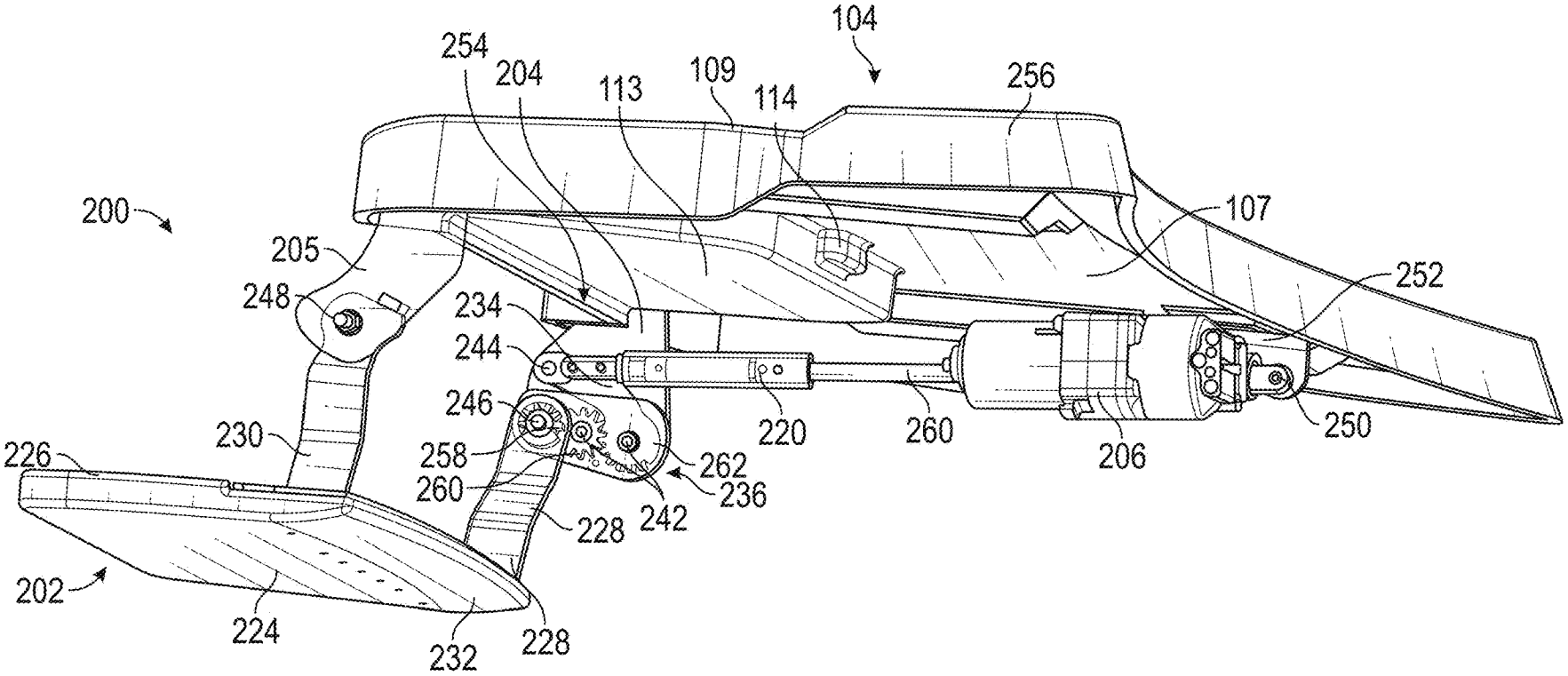
FIG. 6 illustrates an exemplary gear assembly of the powered swim platform with a cover removed.
Figure 7:
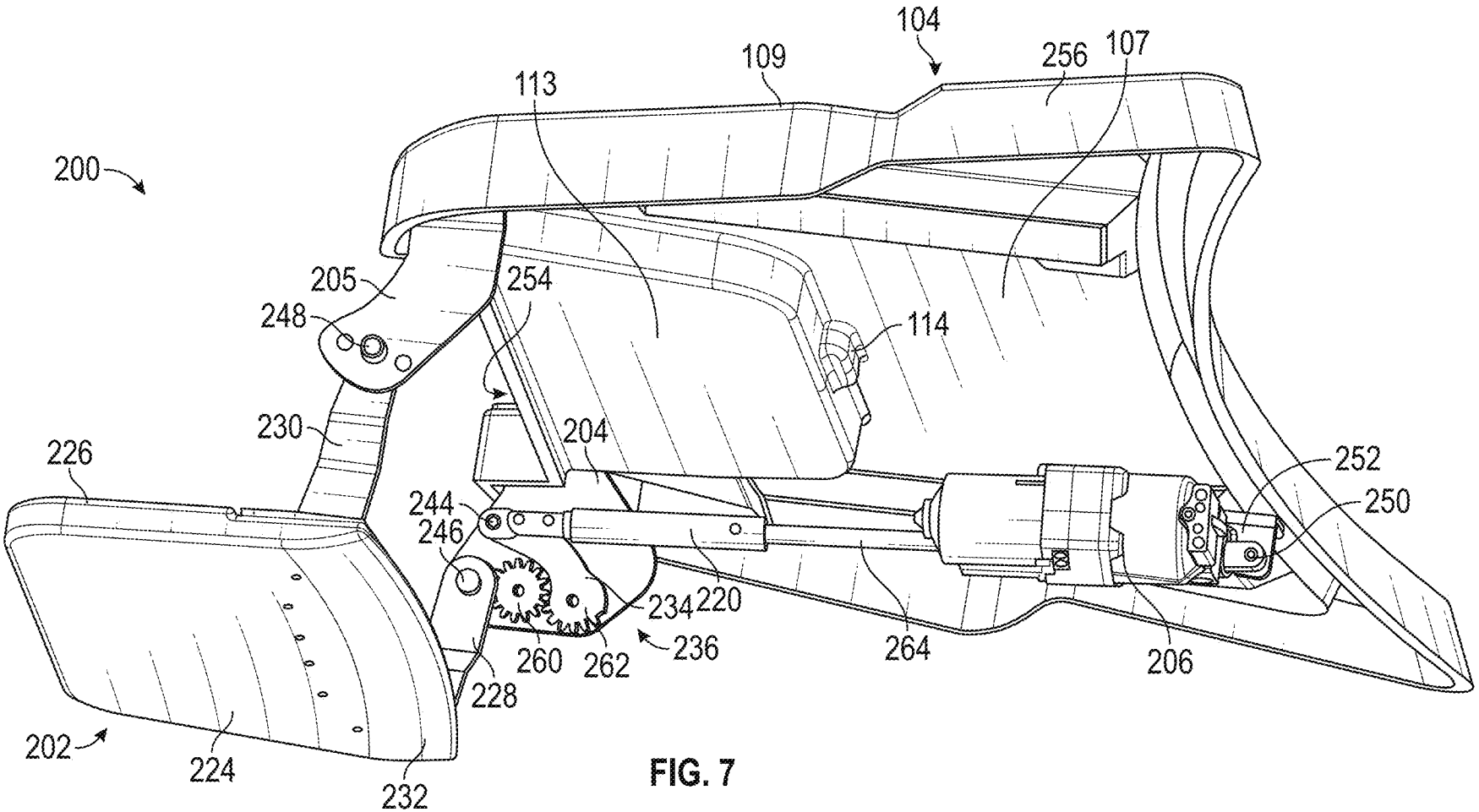
FIG. 7 illustrates another view of the powered swim platform with the platform deployed.

A gear assembly 236 can be disposed between the first mount 204 and the first arm 228. The gear assembly 236 can be mounted on the first mount 204. The gear assembly 236 can enable the actuator 206 to rotate the platform 202. The gear assembly 236 can convert linear motion of the actuator 206 into rotational motion such that actuation of the linear actuator 206 can cause the platform 202 to rotate between the deployed and stowed configurations. The gear assembly 236 can cause the platform 202 to rotate about a fastener (e.g., first joint, first pivot, bolt, rod, shaft) 246. The first arm 228 can be coupled to the first mount 204 via the fastener (e.g., bolt, rod, shaft). More specifically, the fastener 246 can couple the first arm 228 to the first mount 204 with a first gear 258 disposed therebetween, as shown in FIG. 6. The fastener 246 can couple the first gear 258 to the first mount 204. The first gear 258 can rotate about the fastener 246. The first gear 258 can be coupled, e.g. rotatably coupled, to the first arm 228 such that rotation of the first gear 258 causes rotation of the first arm 228 and the platform 202. The first gear 258 can have a portion without teeth, which can inhibit rotation of the first gear 258 relative to an engaged second gear 260. The second gear 260 can be disposed between the first gear 258 and a third gear 262, engaging both the first gear 258 and the third gear 262. The third gear 262 can be a portion of an actuating arm (e.g., support, member) 234. In some variants, the third gear 262 is coupled, which can include rotatably coupled, to the actuating arm 234 such that movement of the actuating arm 234 causes movement of the third gear 262. The third gear 262 can have a portion without teeth, which can inhibit rotation of the third gear 262 relative to the second gear 260. The second gear 260 and the third gear 262 can be coupled to the first mount 204 by fasteners (e.g., bolt, rod, shaft) 242. The second gear 260 and the third gear 262 can rotate about the fasteners 242. The third gear 262 can rotate in a first direction such that the second gear 260 rotates in a second opposite direction causing the first gear 258 to rotate in the first direction, being the same direction of rotation as the third gear 262. In some variants, the gear assembly 236 can include one, two, three, four, or more gears.

Figure 11:
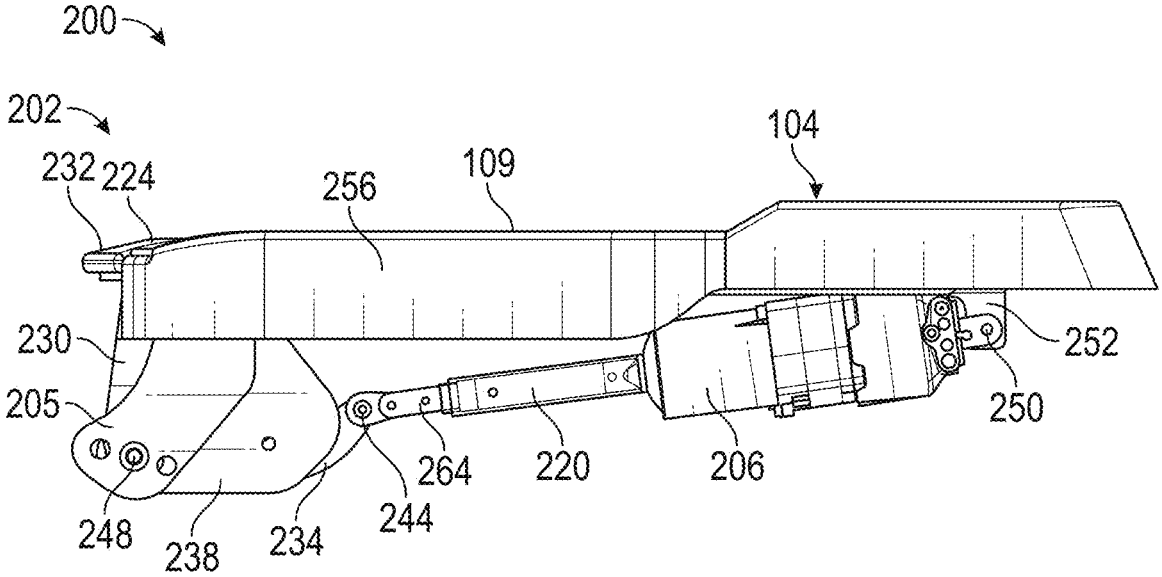
FIG. 11 illustrates another view of the powered swim platform with the platform stowed.
Figure 12:
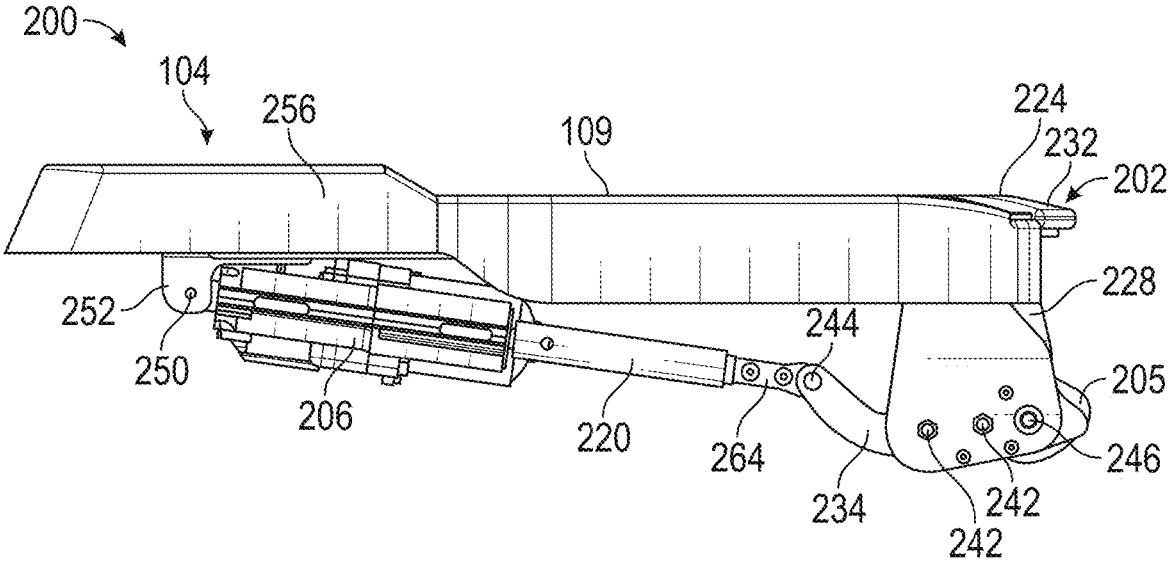
FIG. 12 illustrates another view of the powered swim platform with the platform stowed.

The gear assembly 236 can include a cover 238, as illustrated in FIG. 5. The cover 238 can enclose (e.g., cover), which can include partially enclosing, the one or more gears of the gear assembly 236, such as the first gear 258, second gear 260, and/or third gear 262. The cover 238 can cover, which can include partially covering, the actuating arm 234. In some variants, the cover 238 covers the first gear 258, second gear 260, and third gear 262, while partially covering the actuating arm 234. In some variants, a greater portion of the actuating arm 234 is covered when the platform 202 is in the deployed position compared to when the platform 202 is in the stowed configuration. The cover 238 can prevent objects and/or the user from contacting the first gear 258, second gear 260, third gear 262, and/or actuating arm 234. For example, the cover 238 can prevent hair of the user from being entangled in the first gear 258, second gear 260, third gear 262, and/or actuating arm 234. In some variants, as illustrated in FIG. 11, the cover 238 can be enlarged to cover a larger portion of the actuating arm 234. The cover 238 can be the same size or similar size to the first mount 204. In some variants, the cover 238 can be a smaller or larger size relative to the first mount 204. The cover 238 can cover the entirety or at least majority of the actuating arm 234 when the actuating arm 234 moves in an aft direction to deploy the platform 202.

Returning to FIG. 5, the cover 238 can have a slot (gap, opening) 240 to allow the actuating arm 234 to move while being at least partially covered (enclosed) by the cover 238. The actuating arm 234 can rotate in the slot 240. The slot 240 can allow the actuating arm 234 to move while the cover 238 covers the gears of the gear assembly 236, such as the first gear 258, second gear 260, and/or third gear 262. The slot 240 can be defined between the cover 238, first mount 204, and/or bottom surface 107 of the swim deck 104. The slot 240 can be on a forward side of the cover 238 and/or an upper side of the cover 238.

The actuating arm 234 can be coupled to a shaft (bar, pole, rod) 264 at a joint (pivot) 244. The actuating arm 234 can be coupled to the shaft 264 with a fastener, such as a bolt or the like. The shaft 264 can be monolithic or include several components that are connected together. The shaft 264 can be actuated (moved) by the actuator 206. The actuator 206 can extend and retract the shaft 264. For example, the actuator 206 can extend (move) the shaft 264 in an aft direction to deploy the platform 202. The extension of the shaft 264 can push the actuating arm 234 to rotate the third gear 262 in the first direction, which can rotate the second gear 260 in the second direction, which can rotate the first gear in the first direction, to thereby move the platform 202 from the stowed position (e.g., FIG. 9) to the deployed position (e.g., FIG. 7). The shaft 264 and/or the joint 244 between the shaft 264 and the actuating arm 234 can move toward the swim deck 104 (e.g., upward) due to the rotation of the actuating arm 234 as the shaft 264 extends to deploy the platform 202. The actuator 206 can retract (move) the shaft 264 in a forward (towards the bow of the boat 100) direction to stow the platform 202. The retraction of the shaft 264 can pull the actuating arm 234 to rotate the third gear 262 in the second direction, which can rotate the second gear 260 in the first direction, which can rotate the first gear in the second direction, to thereby move the platform 202 from the deployed position (e.g., FIG. 7) to the stowed position (e.g., FIG. 9). The shaft 264 and/or the joint 244 between the shaft 264 and the actuating arm 234 can move away from the swim deck 104 (e.g., downward) due to the rotation of the actuating arm 234 as the shaft 264 retracts to stow the platform 202.

Figure 8:
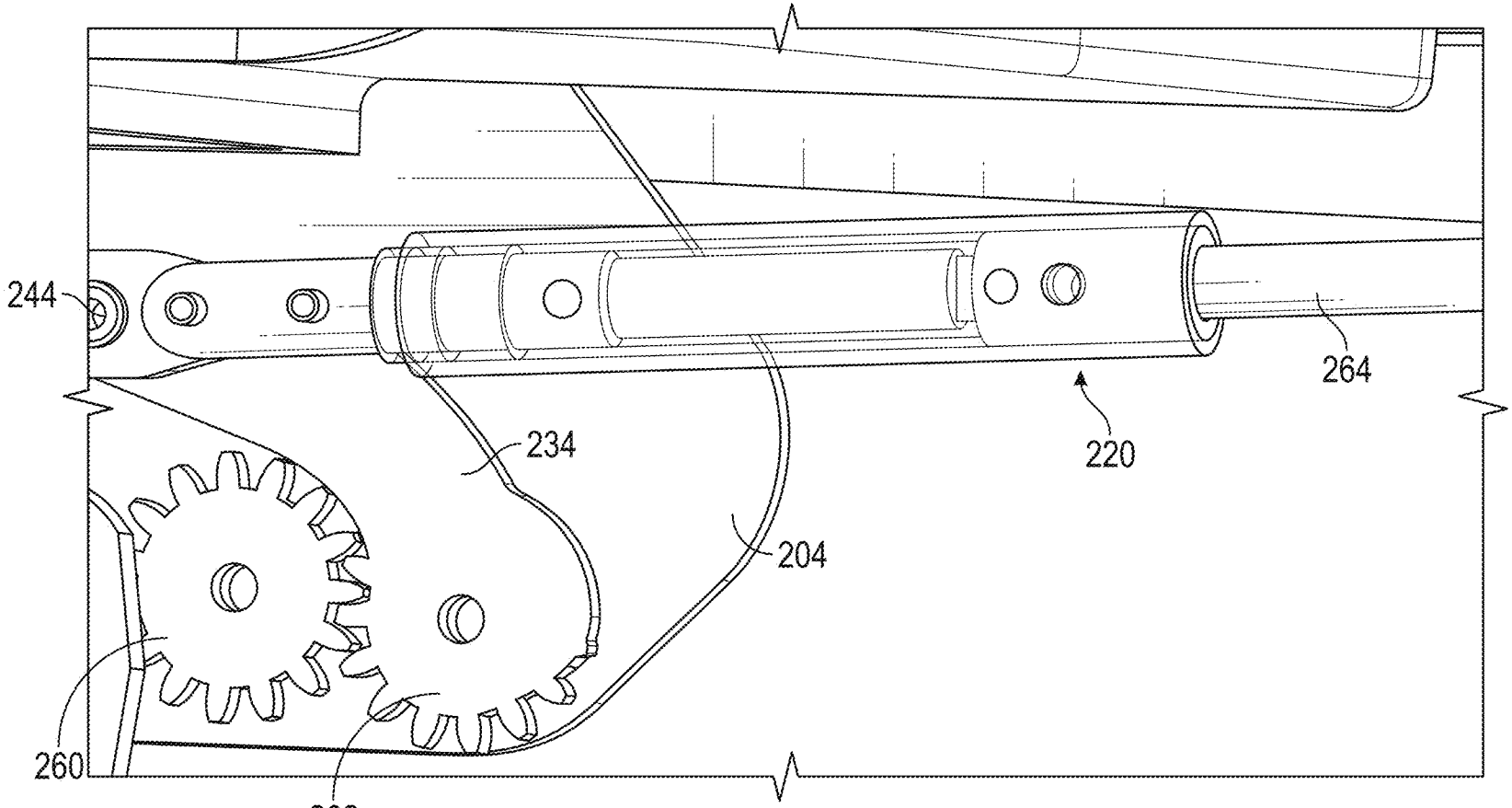
FIG. 8 illustrates an enlarged partial view of the gear assembly and a dampener.

The actuator 206 can include the dampener (shock) 220, shown in FIG. 8. As described herein, the actuator 206 can maneuver (e.g., rotate) the platform 202 through the majority of the range of motion between the deployed and stowed positions (e.g., to proximate the deployed or stowed position) and the dampener 220 can maneuver (e.g., rotate) the platform 202 through the remainder of the range of motion to arrive at the final deployed or stowed position. The dampener 220 can provide a soft stop or finish, which can prevent damage to the powered swim platform 200 if an object interferes with stowing or deploying the platform 202. Accordingly, the actuator 206 can extend/retract the shaft 264 to maneuver (e.g., rotate) the platform 202 through the majority of the range of motion between the deployed and stowed positions while the dampener 220 can provide the remaining extension/retraction to rotate the gears of the gear assembly 236 such that the platform 202 is fully deployed or stowed.

Returning to FIG. 5, the actuator 206, as described elsewhere herein, can be a hydraulic actuator, electric actuator, electric hydraulic actuator, pneumatic actuator, linear actuator, rotary actuator, motor, and/or another suitable actuator. The actuator 206 can be coupled to the swim deck 104, which can include a bottom surface 107 of the swim deck 104. In some variants, the actuator 206 can be coupled to a flange (support, panel) 252 at joint (pivot) 250. The flange 252 can be coupled to the bottom surface 107 of the swim deck 104. The flange 252 can extend away from the bottom surface 107 of the swim deck 104. The actuator 206 can rotate about the joint 250 to enable the shaft 220 to rotate towards and away from the swim deck 104 as the third gear 262 and actuating arm 234 rotate about fastener 242. The actuator 206 can be coupled to the flange 252 at joint 250 by a fastener, such as a bolt or the like.

The second arm 230 of the platform 202 can be coupled to the second mount 205. The second arm 230 can be coupled to the second mount 205 at fastener (e.g., second joint, pivot, bolt, rod, shaft) 248. The second arm 230 can rotate about the fastener 248. In some variants, a second actuator can drive the second arm 230 to rotate about the fastener 248, which can at least include the actuation systems described elsewhere herein.

The second mount 205 can be coupled, which can include attached, fixedly connected, etc., to the swim deck 204. The second mount 205 can be positioned between the receiving region 113 and the outer wall 256 of the swim deck 104. The second mount 205 can extend away from the bottom surface 107 of the swim deck 104. The second mount 205 can be curved and/or angled to extend in an aft direction.

Figure 9:
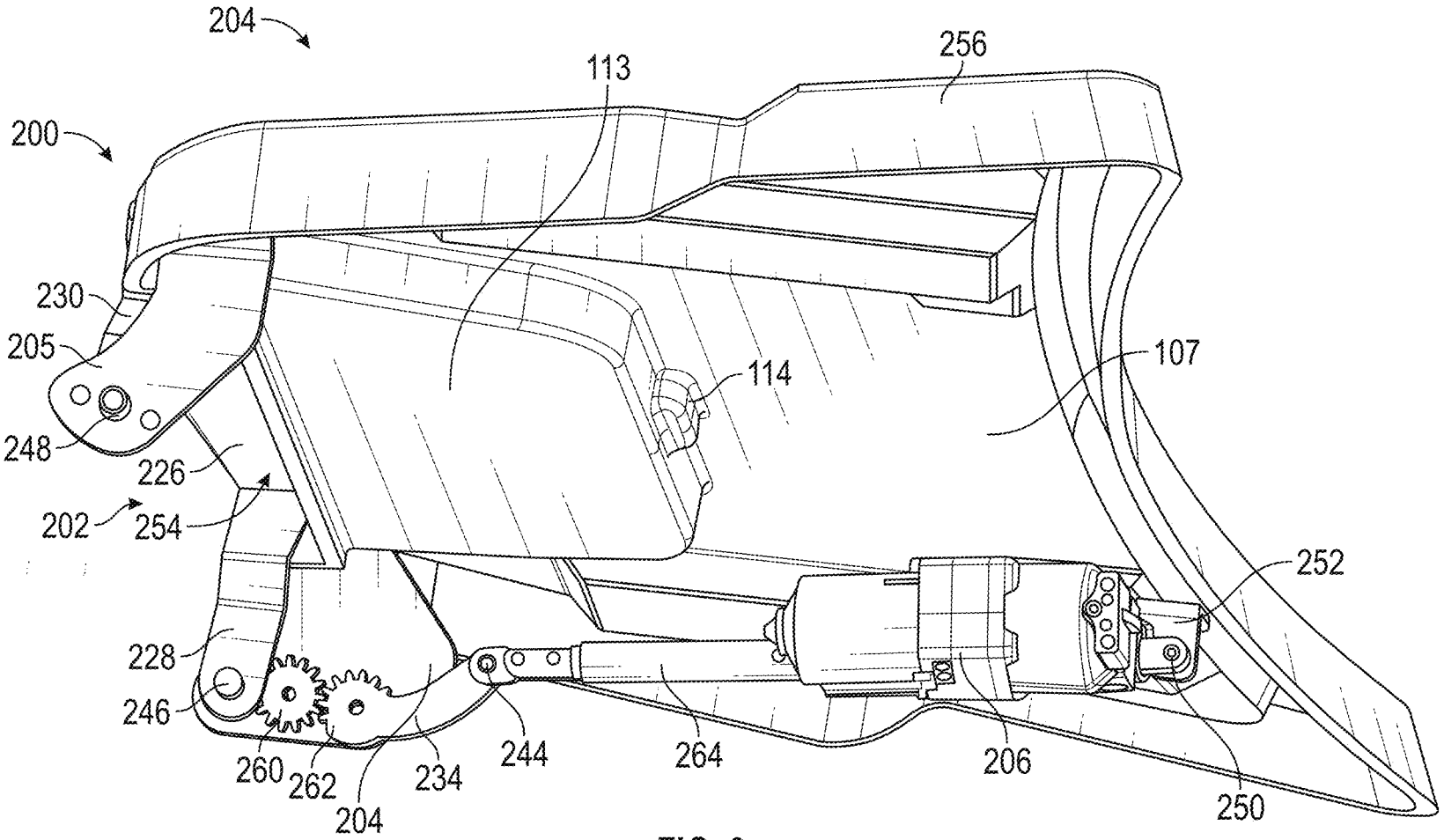
FIG. 9 illustrates the powered swim platform with the platform stowed.
Figure 10:
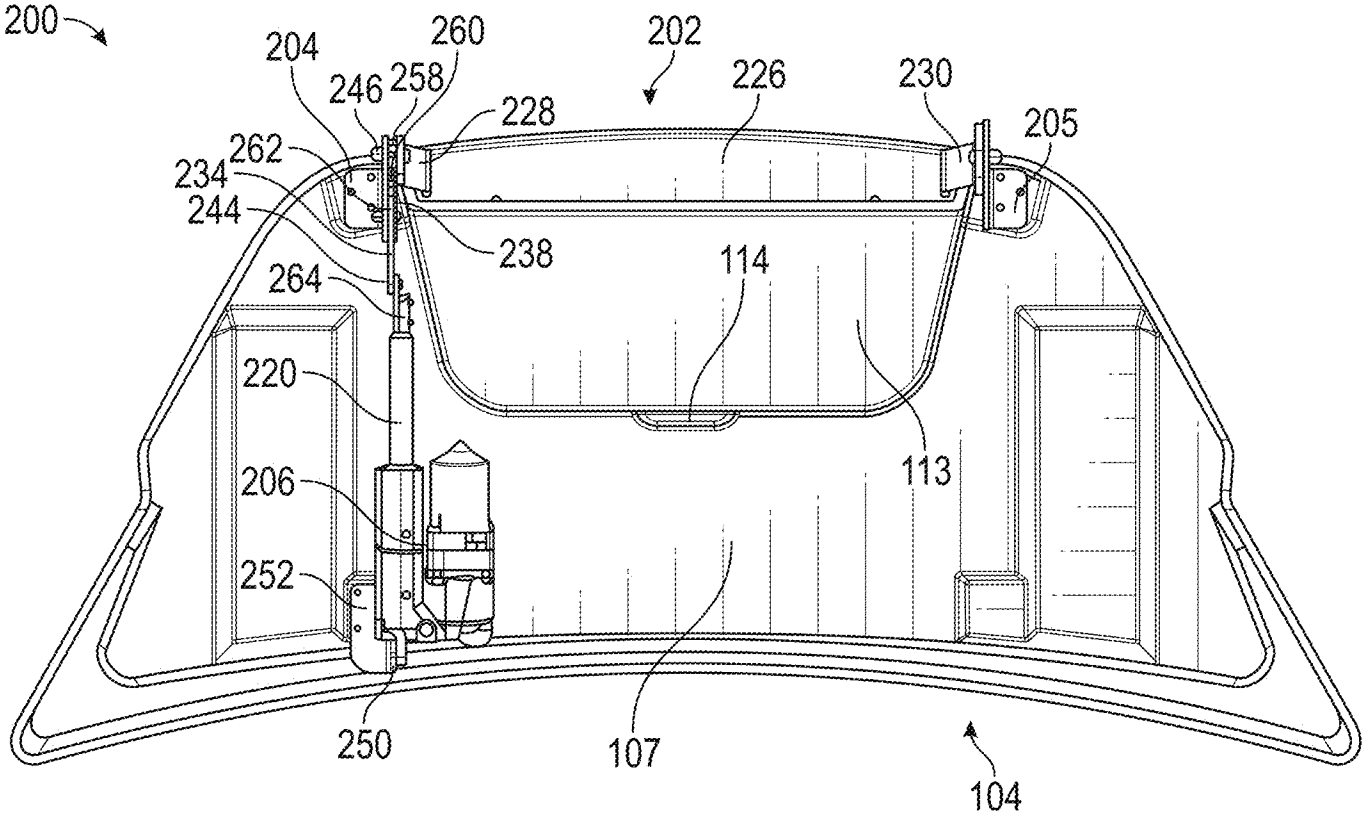
FIG. 10 illustrates another view of the powered swim platform with the platform stowed.

FIGS. 9-12 illustrate an example of the platform 202 in the stowed configuration. As shown in FIG. 9, the shaft 264 is retracted. The retraction of the shaft 264 rotates the actuating arm 234 and third gear 262, causing the platform 202 to rotate to the stowed configuration with the platform 202 positioned within the receiving region 113 of the swim deck 104. As shown, the shaft 264 can be rotated away from the bottom surface 107 of the swim deck 104 (e.g., during deployment of the platform 202). The actuator 206 can be rotated away from the bottom surface 107 of the swim deck 104 (e.g., during deployment of the platform 202).

The first arm 228 and second arm 230 can be positioned within the recess 254 of the swim deck 104 in the stowed configuration. The first side 224 of the platform 202 can be positioned above the second side 226. The second side 226 of the platform 202 can be positioned facing down into the receiving region 113 of the swim deck 104. The first side 224 can be oriented away from the receiving region 113. In some variants, the first side 224 can be coplanar with the upper surface 109 of the swim deck 104, which can enable the user 101 to comfortably walk across the swim deck 104 and the stowed platform 202. The first side 224 can support the user in the stowed configuration.

The receiving region 113 can have a pocket 114. The pocket 114 can enable the user 101 to firmly grasp the platform 202 for manual deployment when stowed. For example, the user 101 can manipulate the release mechanism 222 of the actuator 206 (e.g., open the pressure-release valve 222 of the electric hydraulic actuator 206) and grab the platform 202 via the pocket 114 to manually rotate the platform 202. In some variants, the platform 202 cannot be manually deployed without manipulating the release mechanism 222.

Figure 13:
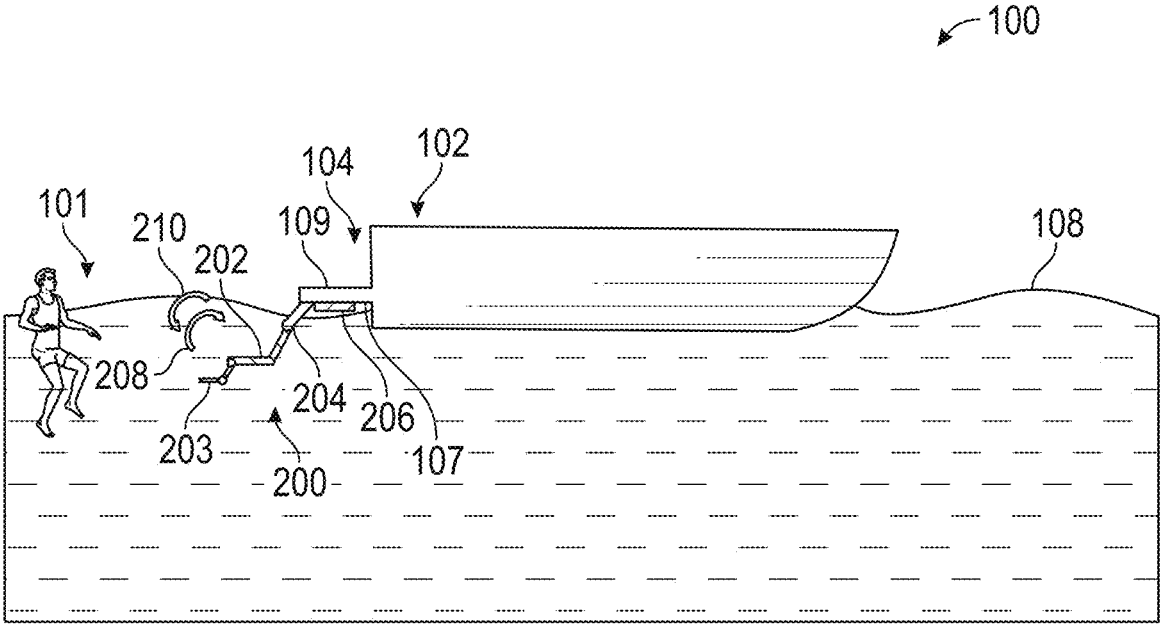
FIG. 13 illustrates a powered swim platform with multiple platforms.

FIG. 13 illustrates the powered swim platform 200 with a second platform 203. The second platform 203 can assist the user 101 in using (e.g., mounting/dismounting) the deployed platform 202. The second platform 203 can be coupled to the platform 202 and rotate relative thereto. The second platform 203 can be rotated to a stowed position, which can be in the platform 202 such as a recess thereof. The second platform 203 can be rotated to a deployed position, as shown in FIG. 13, such that the second platform 203 is at a lower position (elevation, height) relative to the platform 202. The second platform 203 can be manually rotated between the stowed and deployed positions. In some variants, an actuator system, which can include the actuator systems disclosed herein, can rotate the second platform 203 between the stowed and deployed positions. The second platform 203 can include soft grip surfaces on one or both sides thereof, increased surface area surfaces, etc., as described in reference to the platform 202.

In some variants, the powered swim platform 200 can be used with the water-sports boat 100 out of water. For example, the powered swim platform 200 can be used with the water-sports boat 100 loaded onto a trailer to enable an operator to more easily ingress/egress the water-sports boat 100.

Figure 14:
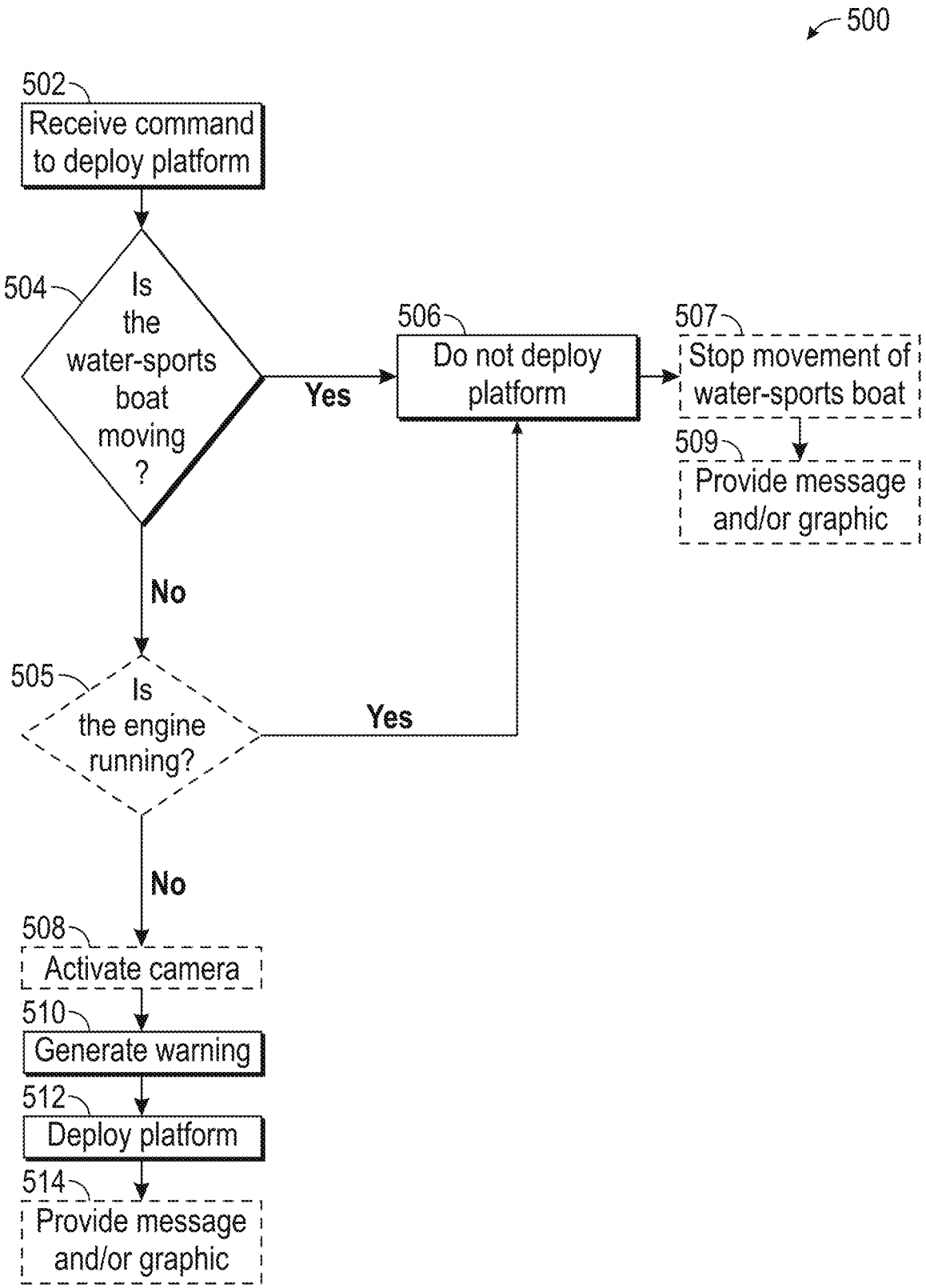
FIG. 14 is a flowchart of an example method for deploying a platform.

FIG. 14 shows an example method 500 for deploying a platform. At block 502, the controller 301 or control system 300 can receive via the user interface 302 a command to deploy the platform 202. The operator or user can provide operator input 308 commanding deployment via the display(s) 304 (e.g., touchscreen), remote 310, switch 312, phone 356, and/or switch 218, or other user input element. As detailed herein, the operator input 308 can be input via a portable device, such as an app on an operator's or user's phone 356.

At block 504, the controller 301 or control system 300 can determine whether the water-sports boat 100 is moving. The controller 301 or control system 300 can use watercraft configuration information 328, sensor(s) 352, GPS 354, engine(s) 322, and/or other features to make the determination. If the water-sports boat 100 is moving, the process can proceed to block 506 and not deploy the platform 202 (e.g., may not command the actuator 206 to actuate). In some variants, the controller 301 or control system 300 determines whether the water-sports boat 100 is moving at or above a predetermined speed to determine if the platform 202 can be deployed (e.g., if below the predetermined speed, the platform 202 can be deployed). In some variants, the process can optionally proceed to block 507 and stop movement of the water-sports boat 100 (e.g., command the engine 322 to stop propelling the water-sports boat 100). In some variants, the process can optionally proceed to block 509 and provide a message and/or graphic to the operator, which can include indicating that the platform 202 will not deploy because the water-sports boat 100 is moving. The message and/or graphic can be displayed on the display(s) 304 and/or phone(s) 356. In some embodiments, the system does not stop movement of the boat, but does provide the message of Block 509.

If the water-sports boat 100 is not moving, the process can optionally proceed to block 505. At block 505, the controller 301 or control system 300 can determine whether the engine 222 is running. The controller 301 or control system 300 can reference the watercraft configuration information 328 and/or engine 322 to make the determination. If the engine is running, the process can proceed to block 506 and not deploy the platform 202. In some variants, the platform 202 can be deployed with the engine 322 running.

If the engine is not running, the process can optionally proceed to block 508. At block 508, the camera(s) 324 can be activated. The camera(s) 324 can capture a view of the swim deck 104, platform 202, stern portion 102, and/or sternward of the water-sports boat 100. The captured view of camera(s) 324, such as a video, can be displayed on the display(s) 304, which can at least be positioned on a console of the water-sports boat 100 (e.g., proximate the steering controls), on an operator's portable device (such as a phone(s) 356), and/or other convenient locations. At block 510, the controller 301 or control system 300 can generate a warning or alert via the light(s), speaker(s) 336, display(s) 304, phone(s) 356, and/or other feature, indicating that the platform 202 is about to deploy and/or is deploying. At block 512, the controller 301 or control system 300 can command the platform 202 to deploy, which can include actuating the actuator 206 to extend the shaft 264 to rotate the gears of the gear assembly 236. In some variants, the process can optionally proceed to block 514 and the controller or control system 300 can provide a message and/or graphic indicating that the platform 202 is deploying and/or is deployed, which can be provided via the light(s) 334, speaker(s) 336, display(s) 304, phone(s) 356, and/or other feature.

Figure 15:
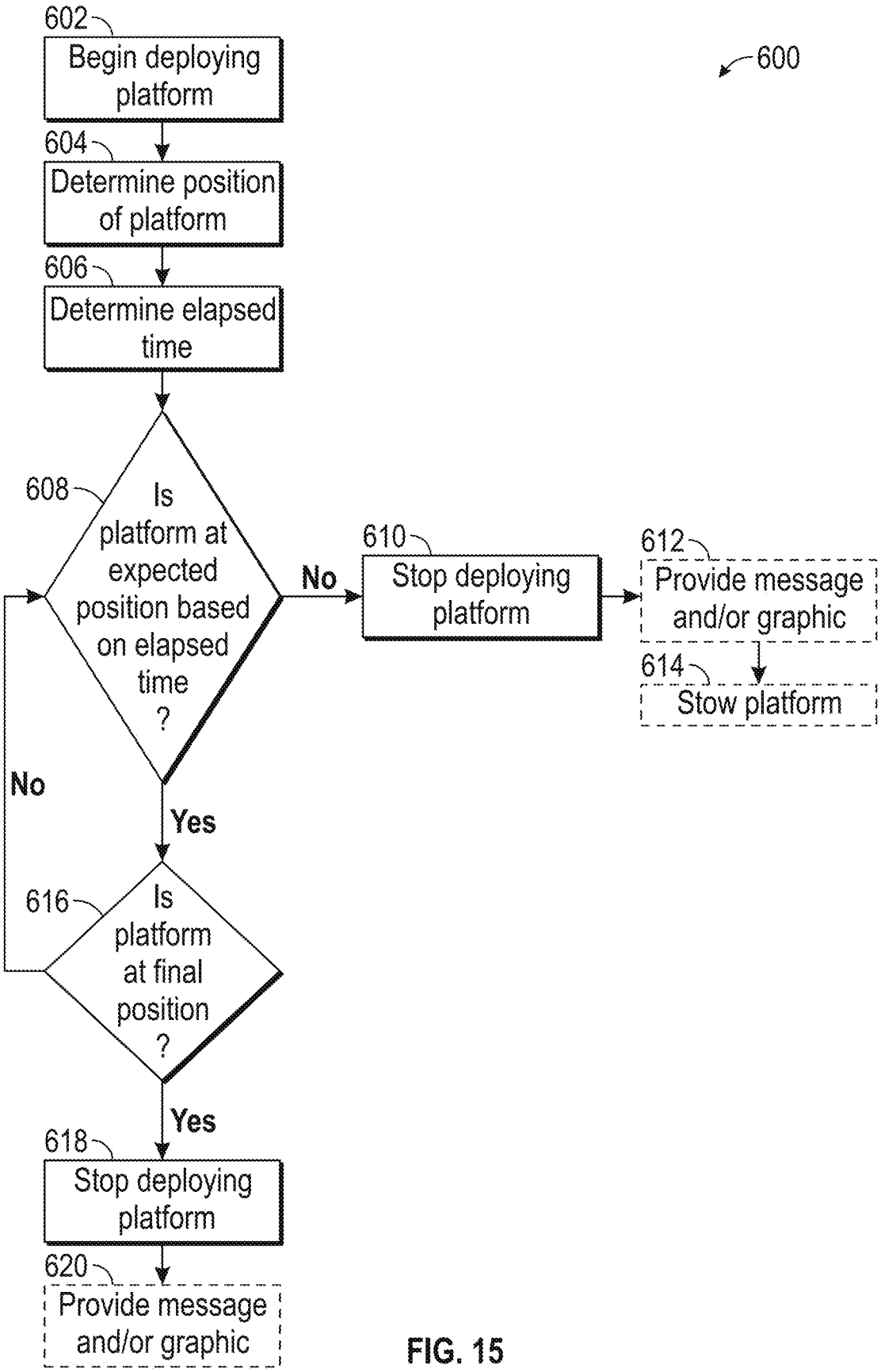
FIG. 15 is a flowchart of an example method for controlling the deployment of a platform.

FIG. 15 shows an example method 600 for controlling the deployment of a platform. At block 602, the controller 301 or control system 300 can command the actuator 206 to rotate (deploy) the platform 202. The actuator 206 can extend the shaft 264 to rotate the gears of the gear assembly 236, causing the platform 202 to rotate toward the deployed position. At block 604, the controller 301 or control system 300 can determine the position of the platform 202. The controller 301 or control system 300 can access powered swim platform position information 330 indicating the position (e.g., angle) of the platform 202. The controller 301 or control system 300 can determine the position (e.g., angle) of the platform 202 via the position sensor 214. At block 606, the controller 301 or control system 300 can determine the elapsed time since the platform 202 began deployment at block 602. The controller 301 or control system 300 can determine the elapsed time via the timer 332 and/or timer 216.

At block 608, the controller 301 or control system 300 can determine if the platform 202 is at the expected position (e.g., angle) based on the elapsed time. For example, after a given amount of time, the platform 202 should be at a specific position (e.g., angle). In some variants, there is a range of expected platform 202 positions (e.g., angles) to allow for varying operating conditions. If the platform 202 is not at the expected position based on the elapsed time, the process can proceed to block 610 and the deployment of the platform 202 can be stopped. This can be an indication that an object(s) is prohibiting movement of the platform 202. In some variants, the process can optionally proceed to block 612 and the controller 301 or control system 300 can provide a message and/or graphic, which can indicate that deployment has stopped and/or there is an issue. In some variants, the message and/or graphic can be provided via the light(s) 334, speaker(s) 336, display(s) 304, phone(s) 356, and/or other feature. In some variants, the process can optionally proceed to block 614 and the controller or control system 300 can stow the platform 202.

If the platform 202 is at the expected position based on the elapsed time, the process can proceed to block 616 and the controller 301 or control system 300 can determine if the platform 202 is at the final deployed position. The controller 301 or control system 300 can determine if the platform 202 is at the final deployed position by referencing the powered swim platform position information 330 and/or based on the position of the platform 202 detected by the position sensor 214. If the platform 202 is not at the final position, the process can return to block 608. If the platform 202 is at the final position, the process can proceed to block 618 and stop deployment of the platform 202. In some variants, the process can optionally proceed to block 620 and the controller 301 or control system 300 can provide a message and/or graphic that the platform 202 is deployed, which can be provided via the light(s) 334, speaker(s) 336, display(s) 304, phone(s) 356, and/or other feature.

Figure 16:
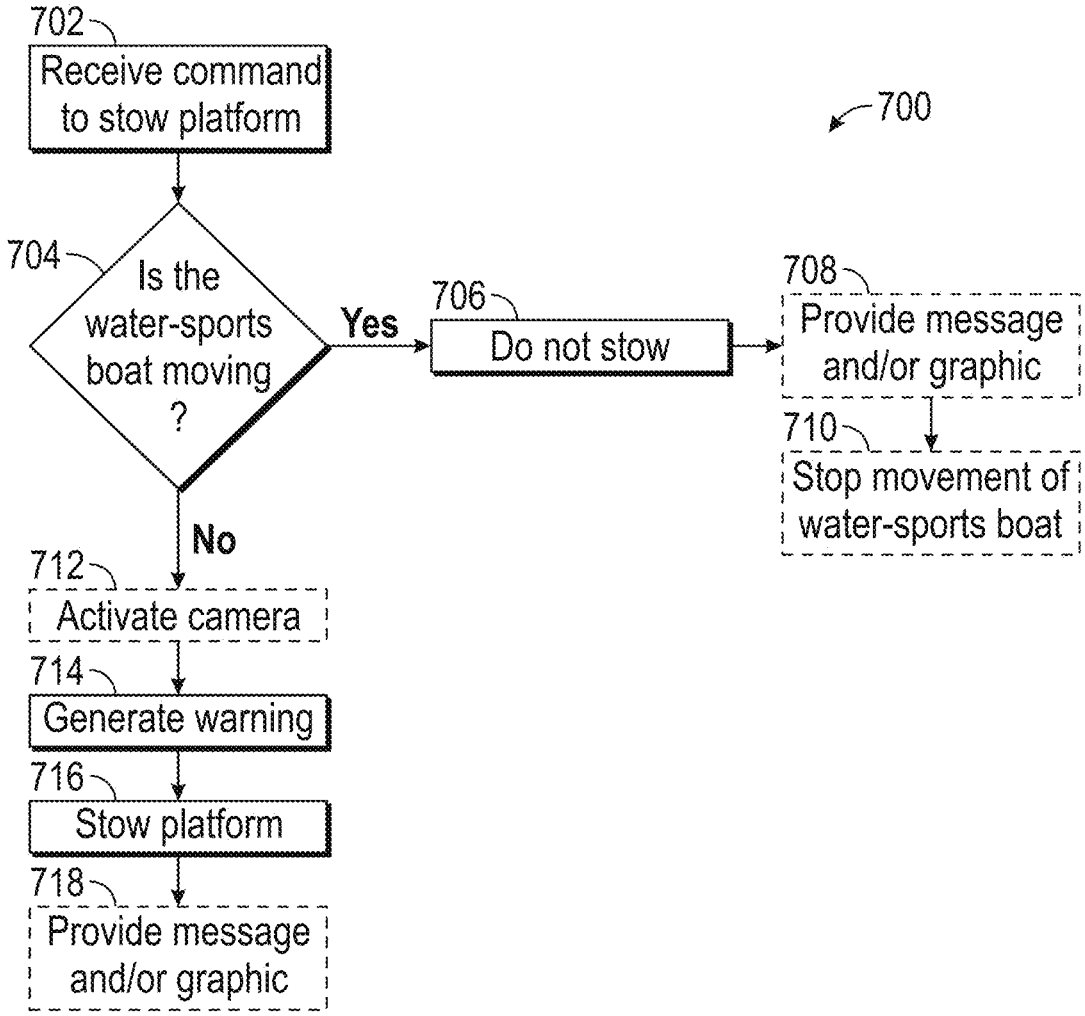
FIG. 16 is a flowchart of an example method for stowing a platform.

FIG. 16 shows an example method 700 for stowing a platform. At block 702, the controller 301 or control system 300 can receive via the user interface 302 a command to stow the platform 202. The operator or user 101 can provide operator input 308 commanding stowage via the display(s) 304 (touchscreen), remote 310, switch 312, and/or switch 218, or other user input element. As detailed elsewhere herein, the operator input 308 can be via a portable device, such as an application on phone(s) 356. In some variants, the controller 301 or control system 300 can command the platform 202 to stow if the boat 100 is commanded to move or the boat 100 is not within water of at least a predetermined depth.

At block 704, the controller 301 or control system 300 can determine whether the water-sports boat 100 is moving. The controller 301 or control system 300 can use watercraft configuration information 328, sensor(s) 352, GPS 354, and/or other features to make the determination. If the water-sports boat 100 is moving, the process can proceed to block 706 and not stow the platform 202 (e.g., may not command the actuator 206 to actuate). In some variants, the process can optionally proceed to block 708 and provide a message and/or graphic to the operator, which can include indicating that the platform 202 will not stow because the water-sports boat 100 is moving. The message and/or graphic can be displayed on the display(s) 304 and/or phone(s) 356. In some variants, the process can optionally proceed to block 710 and stop movement of the water-sports boat 100 (e.g., command the engine 322 to stop propelling the water-sports boat 100). In some embodiments, the system does not stop movement of the boat, but does provide the message of block 708. In some embodiments, if the platform is stuck in the deployed position, the system can transition the boat to a limp-home-mode, where the speed of the boat, engine RPMs, or other operations of the boat are limited until the concern is resolved.

If the water-sports boat 100 is not moving, the process can optionally proceed to block 712. At block 712, the camera(s) 324 can be activated. The camera(s) 324 can capture a view of the swim deck 104, platform 202, stern portion 102, and/or sternward of the water-sports boat 100. The captured view of camera(s) 324, such as a video, can be displayed on the display(s) 304, which can at least be positioned on a console of the water-sports boat 100 (e.g., proximate the steering controls), on an operator's portable device (such as a phone 356), and/or other convenient locations. At block 714, the controller 301 or control system 300 can generate a warning or alert via the light(s) 334, speaker(s) 336, display(s) 304, and/or phone(s) 356, which can indicate that the platform 202 is about to stow and/or is stowing. At block 716, the controller 301 or control system 300 can command the platform 202 to stow, which can include actuating the actuator 206 to retract the shaft 264 to rotate the gears of the gear assembly 236. In some variants, the process can optionally proceed to block 718 and the controller or control system 300 can provide a message and/or graphic indicating that the platform 202 is stowing and/or is stowed, which can be provided via the light(s), speaker(s) 336, display(s) 304, phone(s) 356, and/or other feature.

Figure 17:
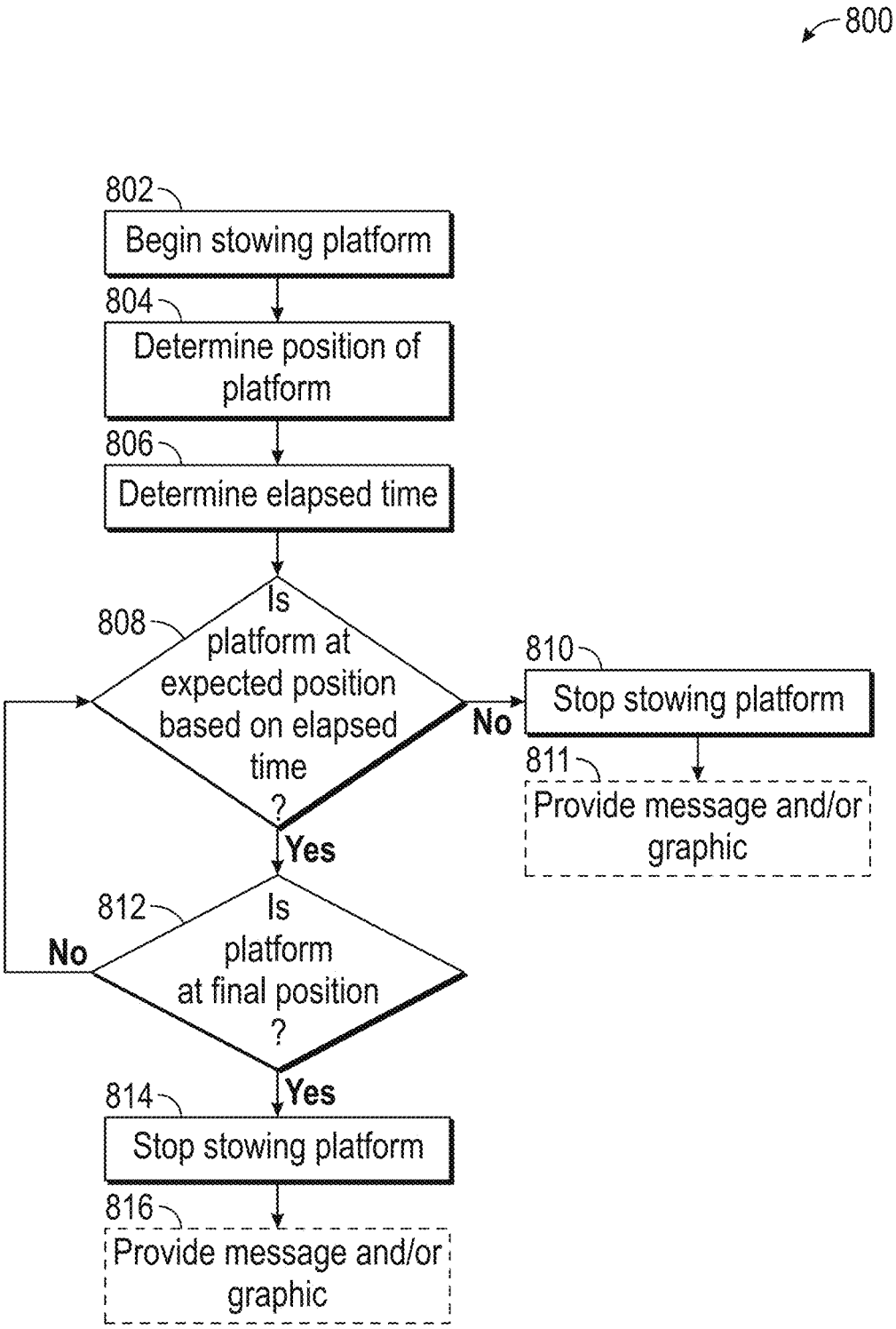
FIG. 17 is a flowchart of an example method for controlling the stowage of a platform

FIG. 17 shows an example method 800 for controlling the stowage of a platform. At block 802, the controller 301 or control system 300 can command the actuator 206 to rotate (stow) the platform 202. The actuator 206 can retract the shaft 264 to rotate the gears of the gear assembly 236, causing the platform 202 to rotate toward the stowed position in the receiving region 113 of the swim deck 104. At block 804, the controller 301 or control system 300 can determine the position of the platform 202. The controller 301 or control system 300 can access powered swim platform position information 330 indicating the position (e.g., angle of the platform 202). The controller 301 or control system 300 can determine the position (e.g., angle) of the platform 202 via the position sensor 214. At block 806, the controller 301 or control system 300 can determine the elapsed time since the platform 202 began deployment at block 802. The controller 301 or control system 300 can determine the elapsed time via the timer 332 and/or timer 216.

At block 808, the controller 301 or control system 300 can determine if the platform 202 is at the expected position (e.g., angle) based on the elapsed time. For example, after a given amount of time, the platform 202 should be at a specific position (e.g., angle). In some variants, there is a range of expected platform 202 positions (e.g., angles) to accommodate for varying operating conditions. If the platform 202 is not at the expected position based on the elapsed time, the process can proceed to block 810 and the stowage of the platform 202 can be stopped. This can be indicative that an object(s) is impeding movement of the platform 202. In some variants, the process can optionally proceed to block 811 and the controller 301 or control system 300 can provide a message and/or graphic, which can indicate that stowage has stopped and/or there is an issue. In some variants, the message and/or graphic can be provided via the light(s), speaker(s) 336, display(s) 304, phone(s) 356, and/or other feature.

Figure 18:
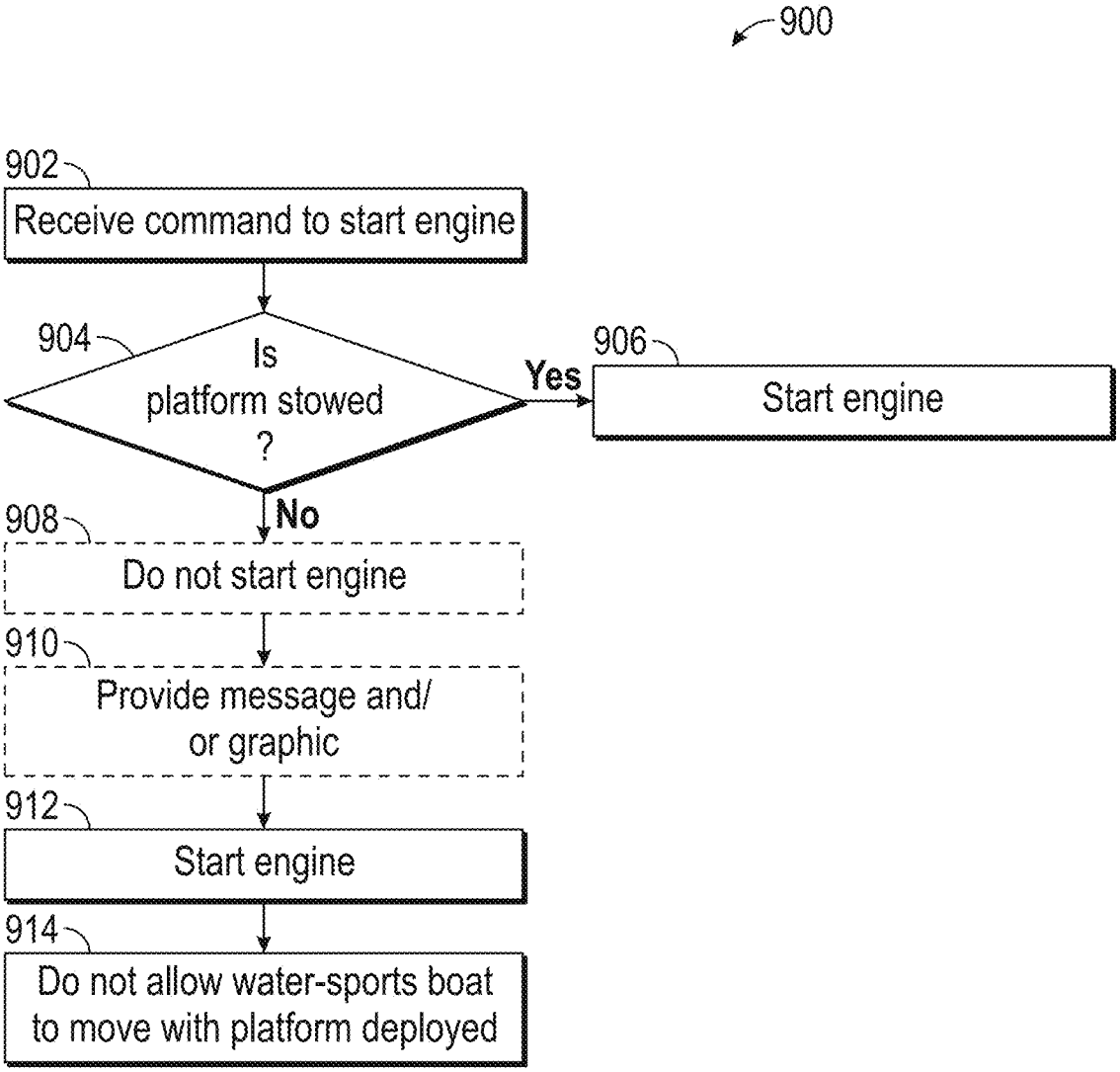
FIG. 18 is a flowchart of an example method for controlling an engine based on platform position.

If the platform 202 is at the expected position based on the elapsed time, the process can proceed to block 812 and the controller 301 or control system 300 can determine if the platform 202 is at the final stowed position. The controller 301 or control system 300 can determine if the platform 202 is at the final stowed position by referencing the powered swim platform position information 330 and/or based on the position of the platform 202 detected by the position sensor 214. If the platform 202 is not at the final position, the process can return to block 808. If the platform 202 is at the final position, the process can proceed to block 814 and stop deployment of the platform 202. In some variants, the dampener 220 can move the platform 202 through the last portion of the stowage process, as described elsewhere herein. In some variants, the process can optionally proceed to block 816 and the controller 301 or control system 300 can provide a message and/or graphic that the platform 202 is stowed, which can be provided via the light(s), speaker(s) 336, display(s) 304, phone(s) 356, and/or other feature FIG. 18 shows an example method 900 for controlling an engine based on platform position. At block 902, the controller 301 or control system 300 can receive via the user interface 302 and/or other feature a command to start the engine 322. At block 904, the controller 301 or control system 300 can determine if the platform 202 is stowed. Stated differently, at block 904, the controller 301 or control system 300 can determine if the platform 202 is deployed, deploying, or stowing. The controller 301 or control system 300 can access powered swim platform position information 330 indicating the position (e.g., angle) of the platform 202. The controller 301 or control system 300 can determine the position (e.g., angle) of the platform 202 via the position sensor 214. If the platform 202 is stowed (i.e., not deployed, deploying, or stowing), the process can proceed to block 906 and allow the engine 322 to start. If the platform 202 is not stowed (i.e., is deployed, deploying, or stowing), the process can optionally proceed to block 908 and not start the engine 322. In some variants, the process can optionally proceed to block 910 and the controller 301 or control system 300 can provide a message and/or graphic at block 910 that the platform 202 is not stowed (i.e., is deployed, deploying, or stowing), which can be provided via the light(s), speaker(s) 336, display(s) 304, phone(s) 356, and/or other feature. At block 912, the controller 301 or control system 300 can start the engine 322. At block 914, the controller 301 or control system 300 can prevent the water-sports boat 100 from moving with the platform 202 deployed, which can include preventing the engine 322 from propelling the boat 100.

Figure 19:
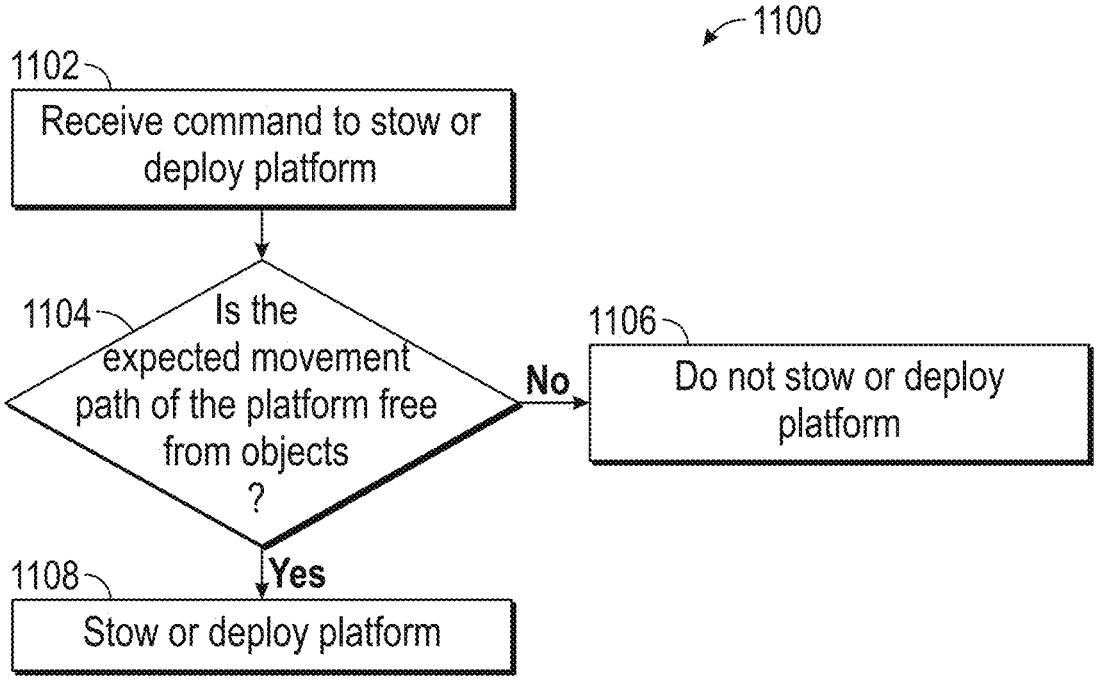
FIG. 19 is a flowchart of an example method for controlling deployment/stowage of a platform based on an expected movement path being free of object(s).

FIG. 19 shows an example method 1100 for controlling deployment/stowage of a platform based on an expected movement path being free of object(s). At block 1102, the controller 301 or control system 300 can receive via the user interface 302 a command to deploy or stow the platform 202. The operator or user can provide operator input 308 commanding stowage/deployment via the display(s) 304 (touchscreen), remote 310, switch 312, and/or switch 218. As detailed elsewhere herein, the operator input 308 can be via a portable device, such as an application on phone(s) 356. In some variants, the controller 301 or control system 300 can command the automatic stowage or deployment of the platform 202 based on the status of the engine 322, depth of water, and/or movement of the water-sports boat 100. At block 1104, the controller 301 or control system 300 can determine if the expected movement path of the platform 202 is free of object(s). The controller 301 or control system 300 can receive data from the camera(s) 324 and/or another sensor(s) that is indicative of the presence and/or absence of object(s) in the expected movement path of the platform 202. If movement path of the platform 202 is not free from object(s), the process can proceed to block 1106 and the controller 301 or control system 300 may not stow or deploy the platform 202. In some variants, the controller 301 or control system 300 can generate an alert, which can be provided via the light(s) 334, speaker(s) 336, display(s) 304, phone(s) 356, and/or other feature, that the platform 202 will not stow or deploy because an object(s) is in the movement path of the platform 202. If movement path of the platform 202 is free from object(s), the process can proceed to block 1108 and the controller 301 or control system 300 may stow or deploy the platform 202.

Figure 20:
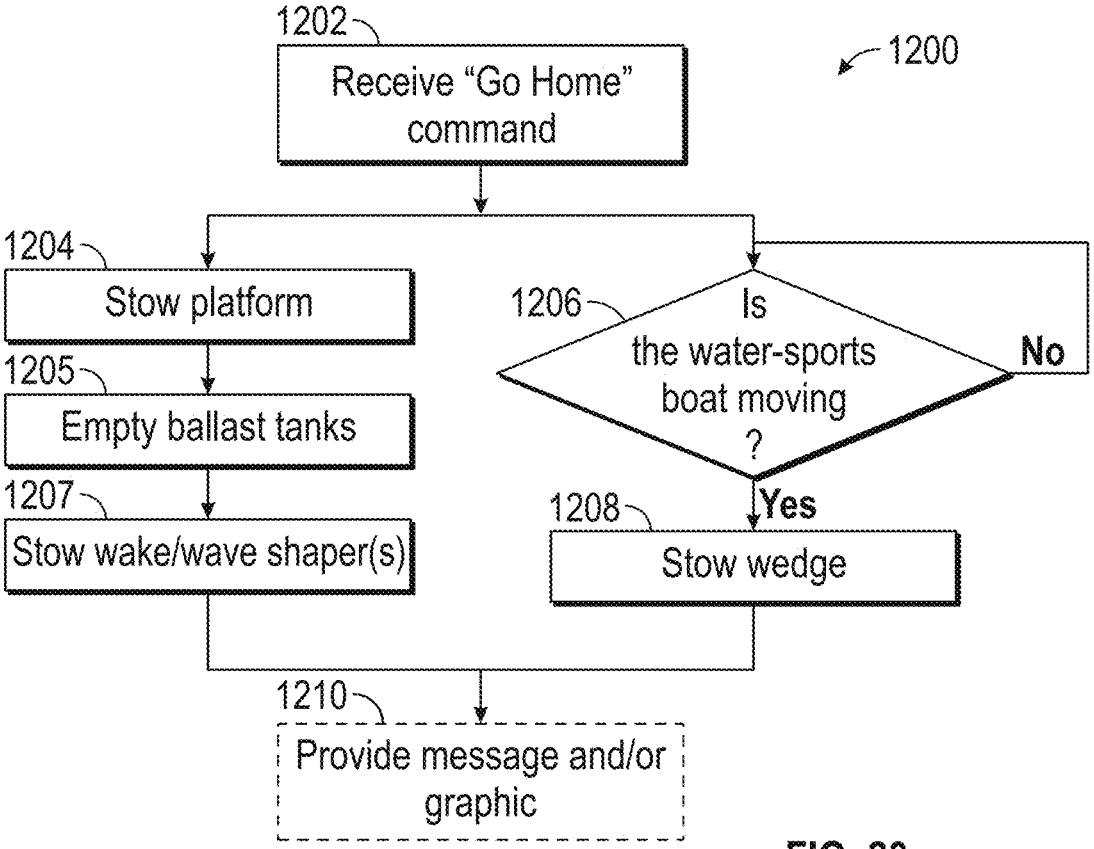

FIG. 20 shows an example method 1200 for automatically preparing the water-sports boat 100 for docking, loading onto a trailer, navigating quickly to a destination, and/or the like. It can be desirable to quickly and consistently prepare the boat 100 for navigating to a destination, docking the boat 100, and/or loading the boat 100 onto a trailer after a day of water sports and related boating activities. There can be multiple systems, however, that can be commanded to prepare the boat 100. It can take significant time for the operator to command each system to prepare the boat 100 or the operator may even forget one or more. Accordingly, the method 1200 describes a method in which the operator may provide the control system 300 with a single command for preparing multiple systems of the boat 100.

At block 1202, the controller 301 or control system 300 can receive via the user interface 302 a "go home" command or the like to prepare the water-sports boat 100 for docking, loading onto a trailer, navigating quickly to a destination, and/or the like. The operator or user 101 can provide operator input 308 with the "go home" command via the display(s) 304 (touchscreen), remote 310, switch 312, and/or switch 218. As detailed elsewhere herein, the operator input 308 can be via a portable device, such as an application on phone(s) 356. At block 1204, the controller 301 or control system 300 can stow the platform 202 by commanding the actuator 206 to rotate (stow) the platform 202. The actuator 206 can retract the shaft 264 to rotate the gears of the gear assembly 236, causing the platform 202 to rotate toward the stowed position in the receiving region 113 of the swim deck 104. At block 1205, the controller 301 or control system 300 can command emptying of the tanks 318 of the ballast system 314. At block 1207, the controller 301 or control system 300 can stow the wake/wave shaper(s) 268, 270. At block 1206, the controller 301 or control system 300 can determine whether the water-sports boat 100 is moving. The controller 301 or control system 300 can use watercraft configuration information 328, sensor(s) 352, GPS 354, and/or other features to make the determination. If the water-sports boat 100 is not moving, the process remains at block 1206 and the controller 301 or control system 300 can determine if the water-sports boat 100 is moving. If the water-sports boat 100 is moving, the process can proceed to block 1208 and the controller 301 or control system 300 can stow the wedge 272. In some variants, the wedge 272 can be stowed without movement of the water-sports boat 100. In some variants, the process can optionally proceed to block 1210 and the controller 301 or control system 300 can provide a message and/or graphic indicating that the water-sports boat 100 has completed the "Go Home" process and/or display the status of one or more systems/features.

Figure 21A:
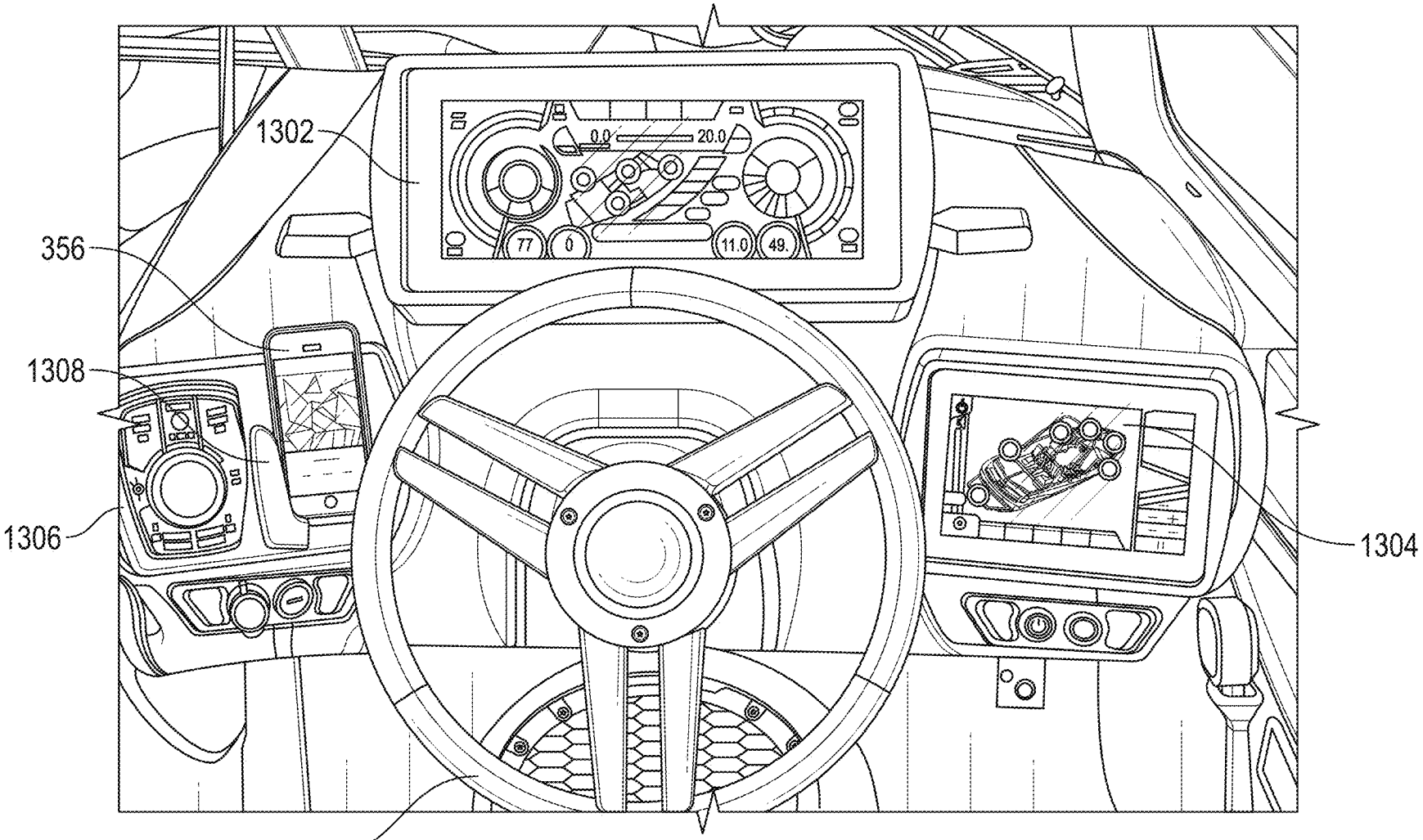
FIGS. 21A-21D illustrate example cockpits with steering and system controls.

FIGS. 21A-21D illustrate cockpit (control center) variants of the water-sports boat 100. Turning to FIG. 21A, the water-sports boat 100 can include a steering wheel 1300, portable device interface (phone interface) 1308, primary multipurpose graphic display 1302, secondary multipurpose graphic display 1304, and/or wake controls 1306. The portable device interface 1308 can receive the phone 356 of the operator. In some variants, the portable device interface 1308 can facilitate holding and/or charging the phone 356. In some variants, the control system 300 can connect wirelessly (e.g., Bluetooth) or via a wired connection to the phone 356. The primary multipurpose graphic display 1302 and/or secondary multipurpose graphic display 1304 can display information and/or graphics to the operator regarding various systems, configurations, and/or features of the boat 100. In some variants, the primary multipurpose graphic display 1302 and/or secondary multipurpose graphic display 1304 can be touchscreen(s) that can receive user input. In some variants, the operator can control and/or view the status of the powered swim platform 200 via the primary multipurpose graphic display 1302 and/or secondary multipurpose graphic display 1304. The wake controls 1306 can control different wake manipulating systems and/or features of the boat 100, which can include the wave/wake shapers 268, 270, wedge 372, and/or other features.

Figure 21B:
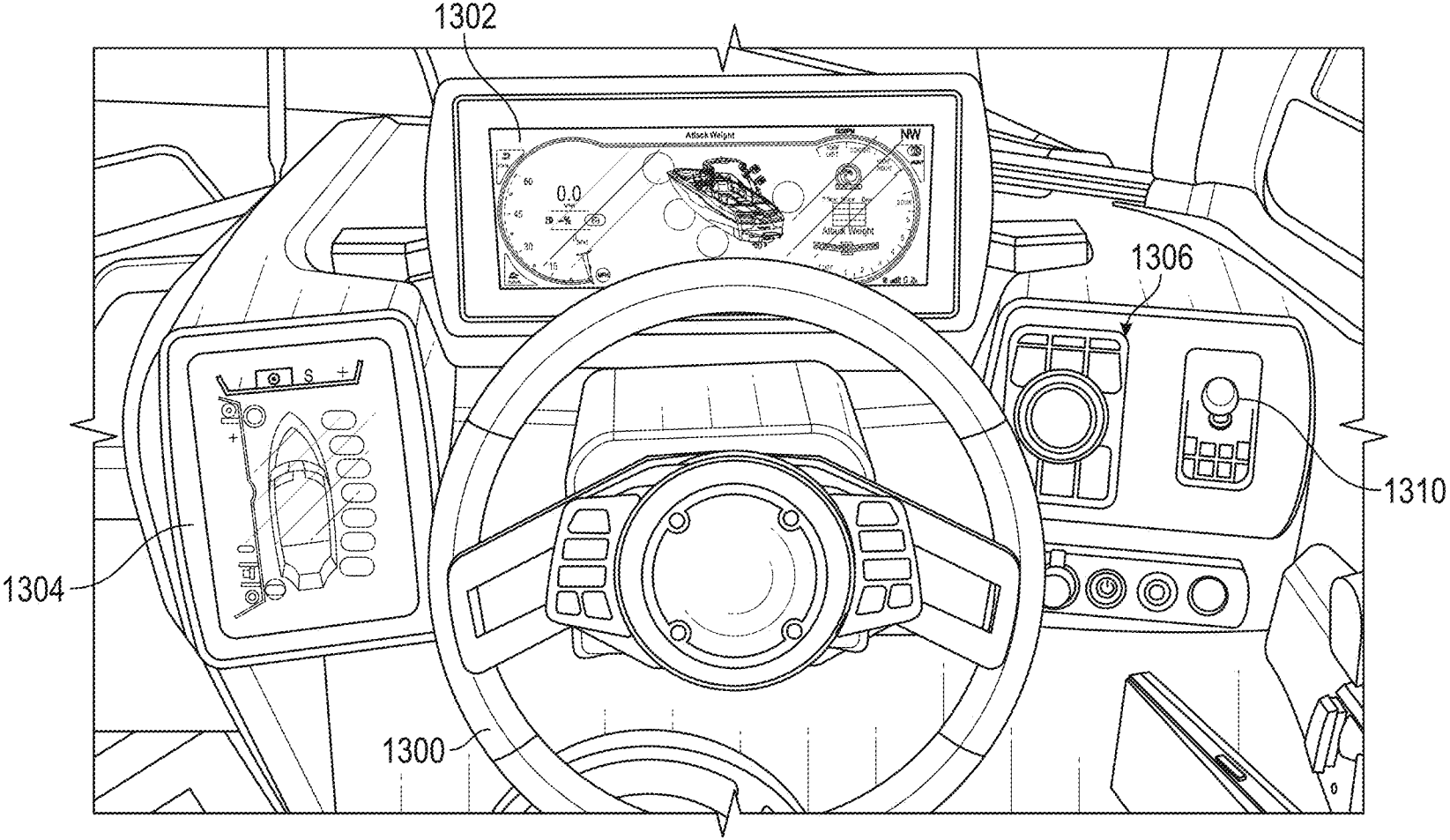

Turning to FIG. 21B, the water-sports boat 100 can include a steering wheel 1300, primary multipurpose graphic display 1302, secondary multipurpose graphic display 1304, wake controls 1306, and/or switch (lever, joystick) 1310. In some variants, the switch 1310 can be the same as switch(es) 312. In some variants, the switch 1310 can be manipulated by the operator to control the powered swim platform 200. For example, manipulating the switch 1310 up can move the platform 202 toward the stowed configuration, while manipulating the switch 1310 down can move the platform 202 toward the deployed configuration.

Figure 21C:
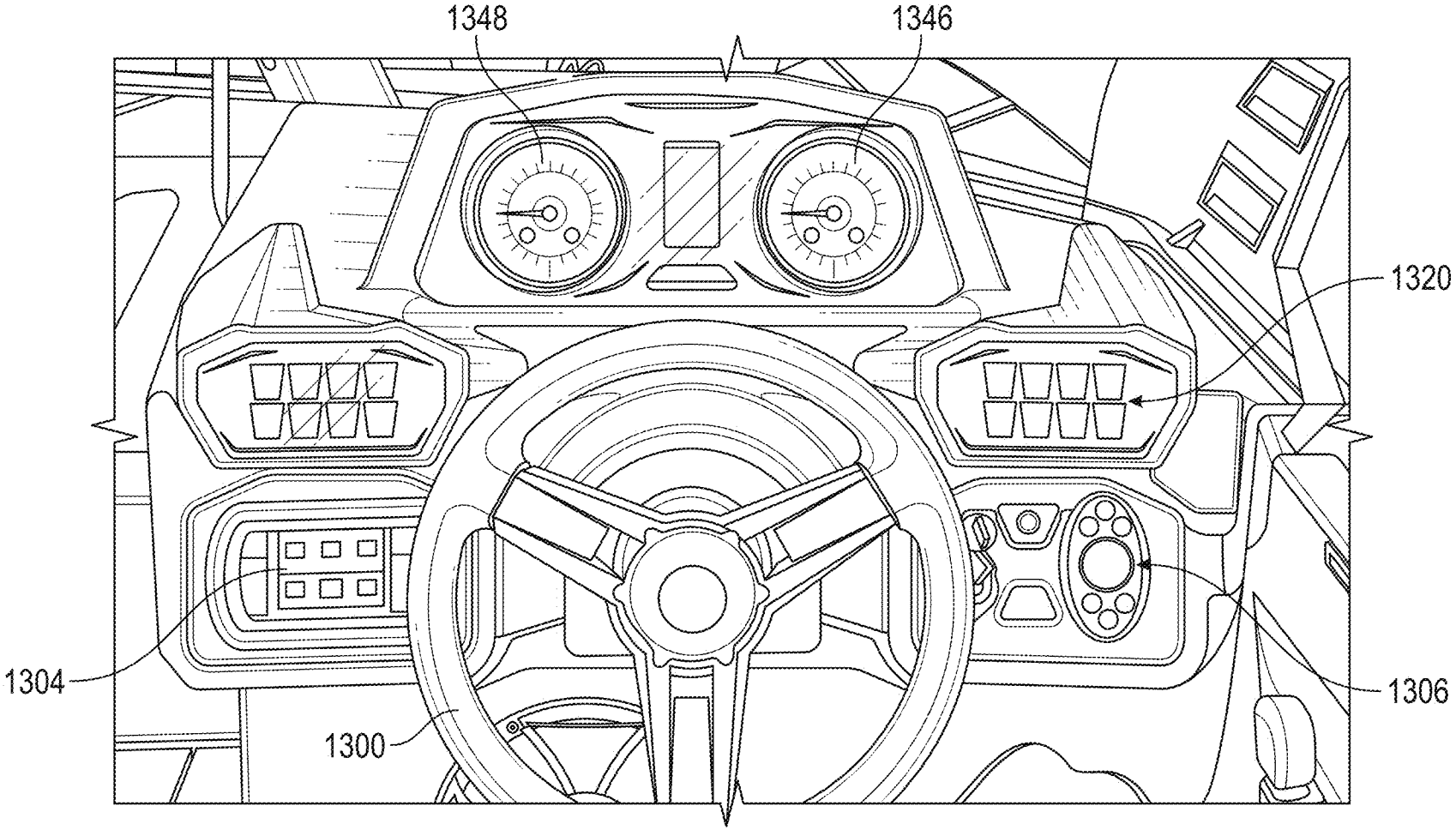

Turning to FIG. 21C, the water-sports boat 100 can include a steering wheel 1300, instrument panel bearing a tachometer 1348 and/or speedometer 1346, wake controls 1306, secondary multipurpose graphic display 1304, and/or a plurality of switches 1320. The plurality of switches 1320 can be the same as the switch(es) 312. In some variants, the plurality of switches 1320 can be manipulated by the operator to control the powered swim platform 200. For example, one switch of the plurality of switches 1320 may be manipulated to command the powered swim platform 200 to deploy the platform 202, while another switch of the plurality of switches 1320 may be manipulated to command the powered swim platform 200 to stow the platform 202.

Figure 21D:
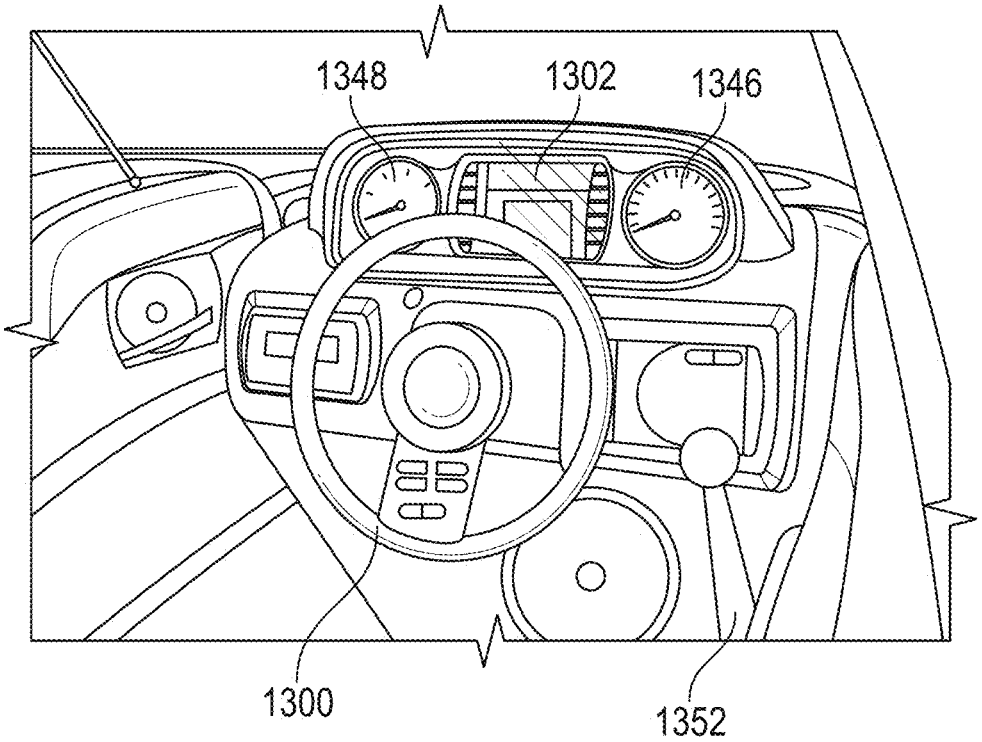

Turning to FIG. 21D, the water-sports boat 100 can include a steering wheel 1300, throttle control 1352, instrument panel bearing a tachometer 1348 and/or speedometer 1346, and/or primary multipurpose graphic display 1302, which can display and/or receive input from the operator.

Figure 22:
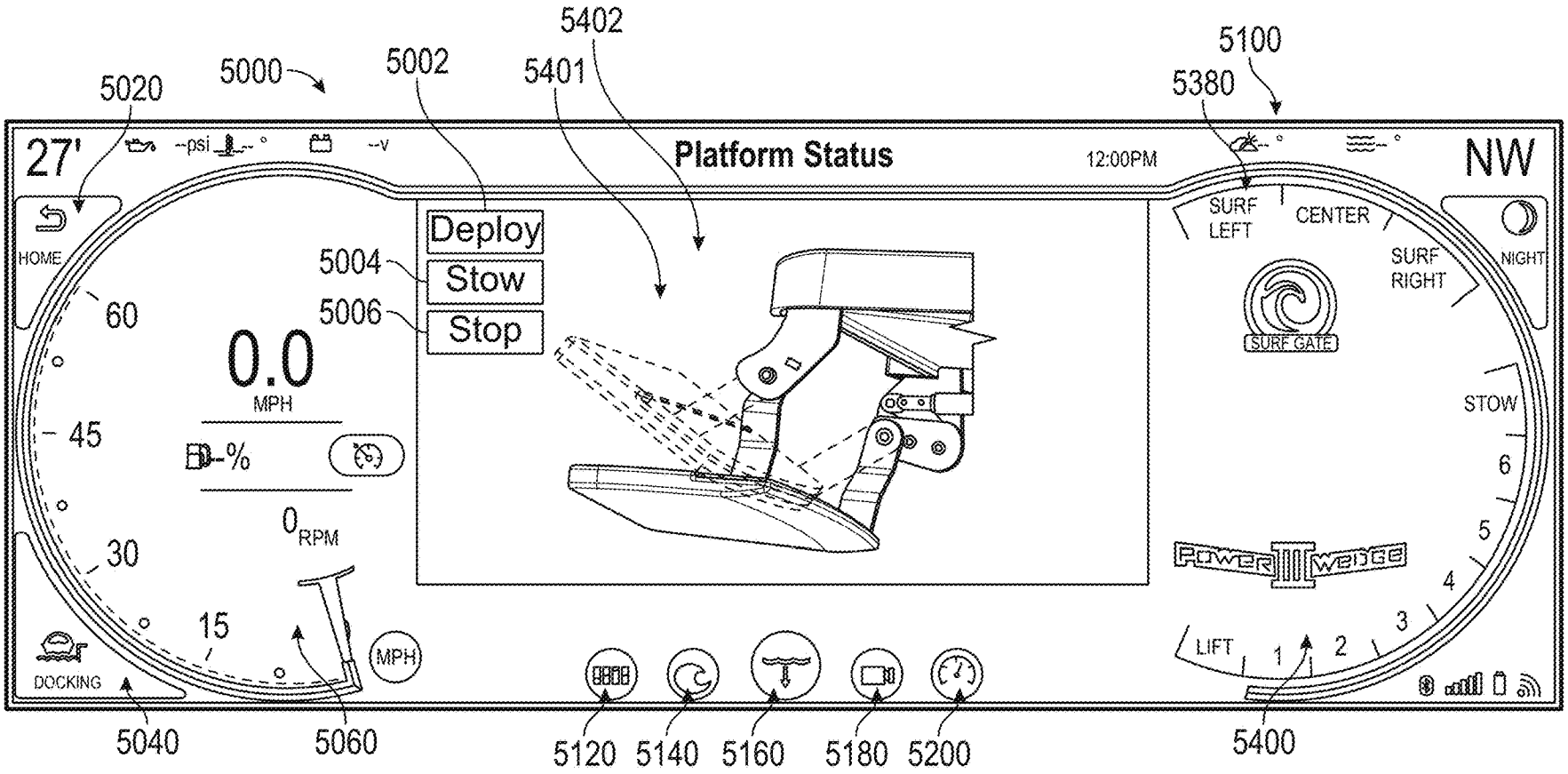
FIG. 22 illustrates an example driver user interface.

FIG. 22 illustrates an example driver user interface 5000 that can be displayed on the primary multipurpose graphic display 1302. In some variants, the driver user interface 500 can be displayed on the secondary multipurpose graphic display 1304 and/or other displays referenced herein. The driver user interface 500 can include a speedometer 5060. The driver user interface 5000 can include a home button 5020, which can be virtual, that can be manipulated to command the controller 301 and/or controller 300 to perform all and/or a portion of the method 1200. The driver user interface 5000 can include a docking button 5040, which can be virtual, that can be manipulated to make the throttle sensitivity more controlled. In some variants, manipulation of the docking button 5040, can command the controller 301 and/or controller 300 to prepare the boat 100 for docking and/or perform automatic docking of the boat 100.

The driver user interface 5000 can include a variable display area 5402. The variable display area 5402 can be positioned between the speedometer 5060 and a ballast/flow indicators area 5100. In some variants, the ballast/flow indicators area 5100 and speedometer 5060 remain consistently displayed in the driver user interface 5000, while the variable display area 5402 changes. The variable display area 5402 can display varying pages with different information and/or input options. The operator can change the page displayed in the variable display area 5402 by selecting the ballast page 5120, preset page 5140, depth page 5160, media page 5180, and/or gauges page 5200.

The variable display area 5402 can show a graphic (illustration) 5401 of the platform 202, as illustrated in FIG. 22. The graphic 5401 can represent the current status of the platform 202. For example, as shown, the graphic 5401 shows a representation of the platform 202 in the deployed configuration. The graphic 5401 can show the position of the platform 202 as the platform 202 is rotated between deployed and stowed configurations. For example, the dashed outline of the platform 202 can indicate where the platform 202 would be positioned in the graphic 5401 as the platform 202 is rotated between deployed and stowed configurations. The variable display area 5402 can display deploy button 500, stow button 5004, and/or stop button 5006, all of which can be virtual. The operator can select the deploy button 5002 to deploy the platform 202. The operator can select the stow button 5004 to stow the platform 202. The operator can select the stop button 5006 to stop the deployment or stowage of the platform 202.

A wake shaper input 5380 can enable the operator to select between at least three options: surf left, center, and/or surf right. The surf left and surf right options, upon selection, can actuate the port and/or starboard wave shaper(s) 268, 270 to form a suitable wake surfing wave on the port-side portion 107 or starboard-side portion 106 of the wake 105. In some variants, the port and/or starboard wave shaper(s) 268, 270 actuate between stowed/deployed positions. In some variants, the port and/or starboard wave shaper(s) 268, 270 can be positioned in one of a continuum of positions between stowed and deployed. The center option can position the port and/or starboard wave shaper(s) 268, 270 in a neutral position and/or stowed position to not shape the wake 105. The wake shaper input 5380 can display an indication of the configuration of the wake shaper(s).

A wedge input 5400 can enable the operator to select different configurations for the wedge 272, which can include one or more lift configurations, one or more downward force configurations, and/or a stowed configuration. The wedge input 5400 can display an indication of the configuration of the wedge 272.

Figure 23:
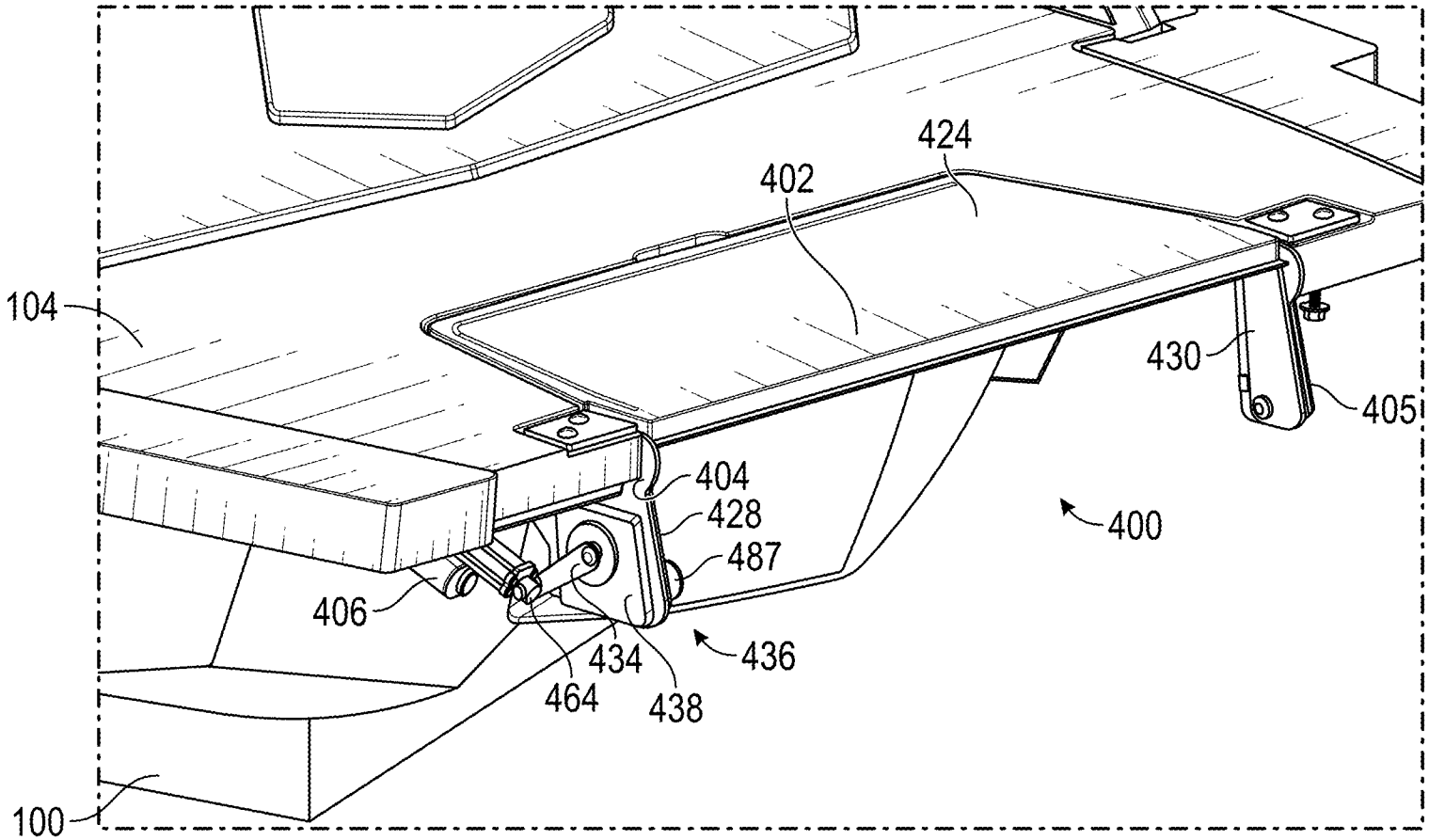
FIG. 23 shows an example embodiment of a movable platform in a stowed position.
Figure 24:
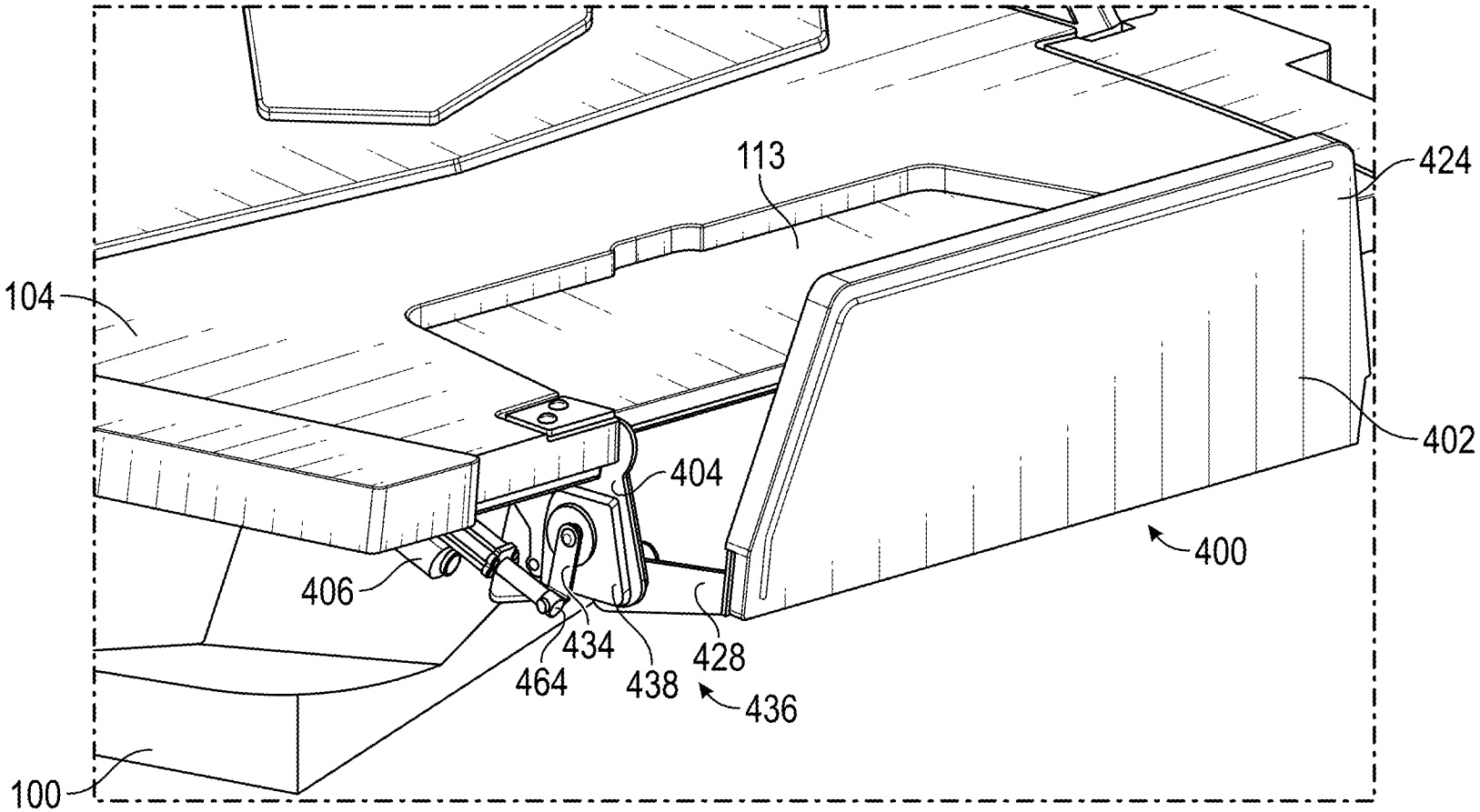
FIG. 24 shows an example embodiment of a movable platform between a stowed position and a deployed position.
Figure 25:
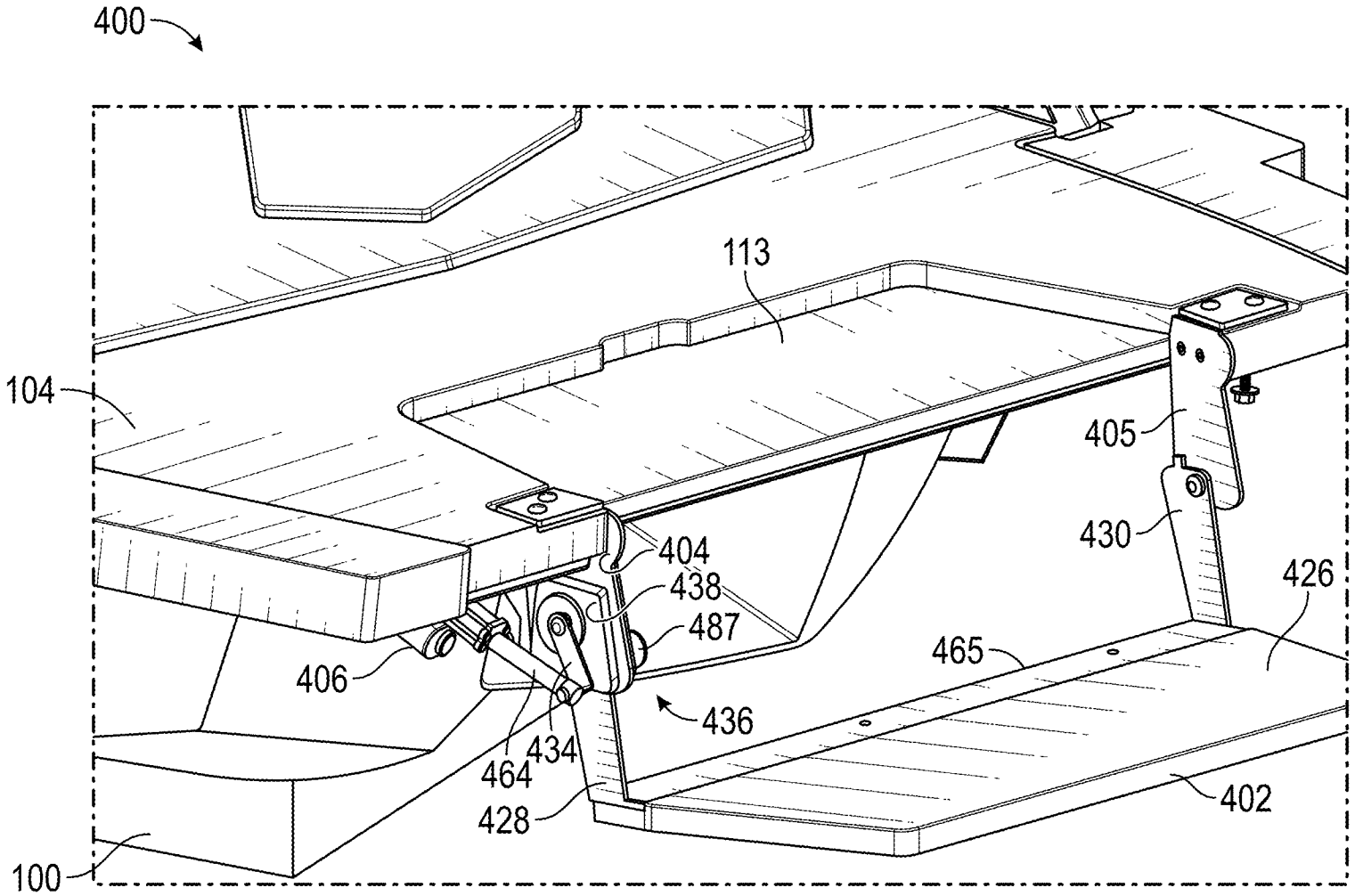
FIG. 25 shows an example embodiments of a movable platform in a deployed position.

FIGS. 23-25 show another embodiment of a powered swim platform 400, which can have features that are the same as, or similar to, the powered swim platform 200 or other embodiments disclosed herein. The discussion of the powered swim platform 400 will focus on differences from the other embodiments, and many features of the other embodiments can be incorporated into the powered swim platform 400 and vice versa. The swim deck 104 and/or platform 402 can be used in connection with a water-sports boat, or with other types of boats (cruisers, runabouts, pontoon boats, etc.), or with other watercraft.

The boat 100 can have a swim deck 104 and a movable platform 402, which can be moved (e.g., pivoted) between a stowed position and a deployed position. FIG. 23 shows the platform 402 in the stowed position. FIG. 24 shows the platform 402 in an intermediate position between the stowed and deployed positions. FIG. 25 shows the platform 402 in the deployed position. A first side 424 of the platform can face generally upward, and a second side 426 of the platform 402 can face generally downward, when the platform 402 is in the stowed position. The first side 424 of the platform can face generally downward, and the second side 426 of the platform 402 can face generally upward, when the platform 402 is in the deployed position. The boat can have a receiving portion (e.g., a recess) 113, and the platform 402 can fit into the receiving portion 113 when in the stowed position. When in the stowed position, the first surface 424 of the movable platform 402 can be substantially flush with the top surface of the swim deck 104.

An actuator 406 can move the platform 402 between the stowed and deployed positions, such as by rotating the platform 402. The actuator 406 can move a shaft 464, which can be coupled to an actuating arm 434. The actuating arm 434 can be coupled to a gear assembly 436, which can be configured to pivot the platform 402. For example, the gear assembly 436 can be coupled to a first arm 428 that supports a first side of the platform 402 so that rotation of the gears in the gear assembly 436 applies a rotational force to the first arm 428. The first arm 428 can be rotationally coupled to a first mount 404, which can be mounted to the swim deck 104 (e.g., rigidly). A second arm 430 can support a second side of the platform 402 and can be rotationally coupled to a second mount 405, which can be mounted to the swim deck 104 (e.g., rigidly). In some cases a cross member 465 can extend between the first arm 428 and the second arm 430. The main body of the platform 402 can be coupled to the cross member 465.

Figure 26:
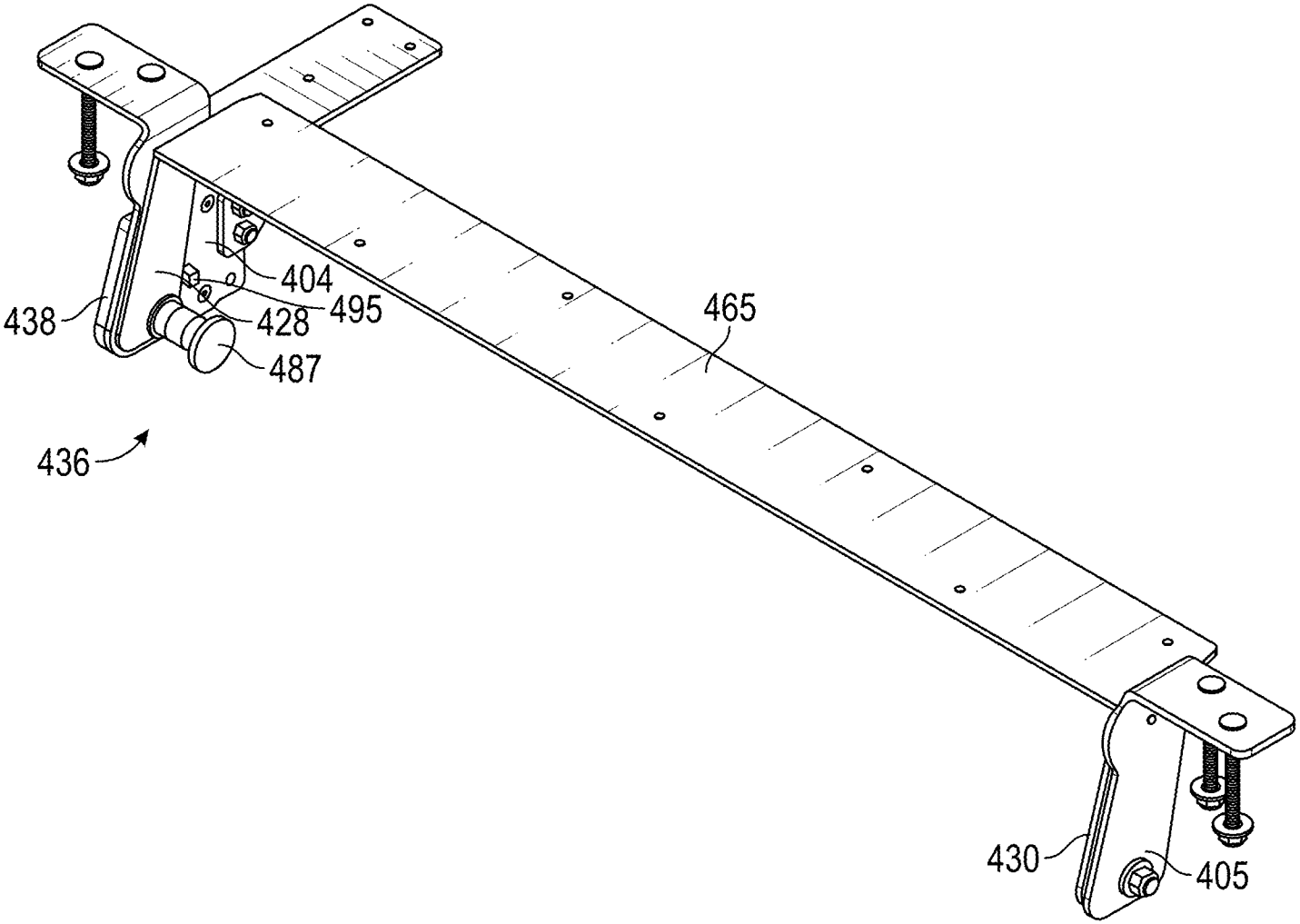
FIG. 26 shows certain components of an example embodiment of the movement mechanism for a movable platform.
Figure 27:
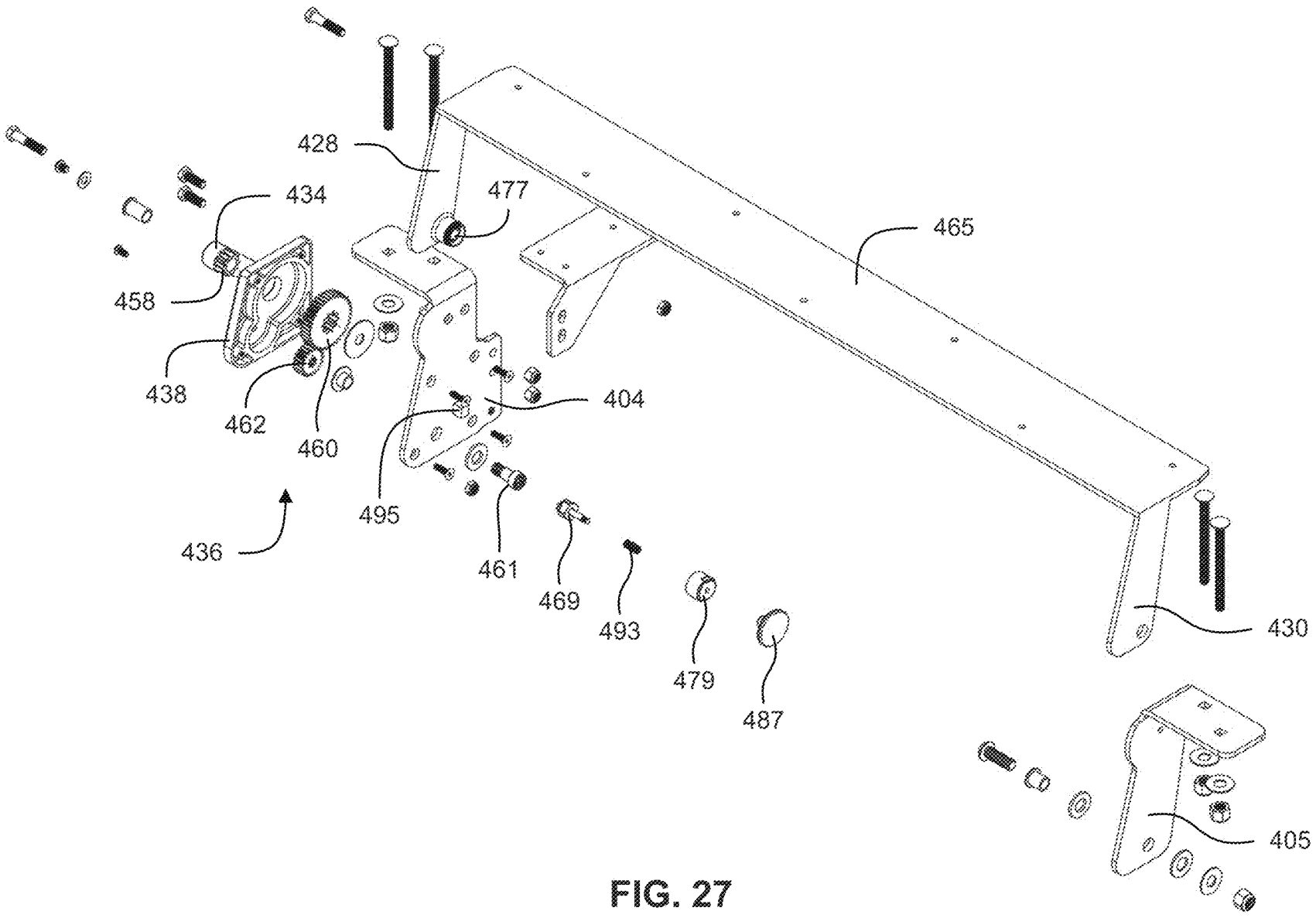
FIG. 27 is an exploded view showing certain components of an example embodiment of the movement mechanism for a movable platform.

The powered swim platform 400 can have a different gear assembly 436 than the powered swim platform 200. An example embodiment of certain mechanisms for moving the platform 402 are shown in FIG. 26 in an assembled configuration, and in FIG. 27 in an exploded view. FIG. 27 shows the gears of the gear assembly 436. The platform 402, the boat 100, the swim deck 104, the actuator 406, and various other components are omitted from view in FIGS. 26 and 27. The actuating arm 434 can have a first gear 458. For example, a first end of the actuating arm 434 can couple to the shaft 464 (e.g., using a pivoting joint), and a second end of the actuating arm 434 (e.g., opposite the first end) can have the first gear 458 (e.g., with outwardly facing teeth). A second gear 460 can engage the first gear 458. For example, the second gear 460 can have inwardly facing teeth that are configured to engage the outwardly facing teeth of the first gear 458. The second gear can also have outwardly facing teeth, which can engage with a third gear 462. The third gear 462 can have outwardly facing teeth for engaging the second gear 460.

The third gear 462 can have smaller diameter than the second gear 460. The third gear 462 can have fewer outer teeth than the second gear 460. The second and third gears 460 and 462 can be configured to increase the angle of rotation of the platform 402 (e.g., and the first arm 428) as compared to an angle of rotation of the actuating arm 434. By way of example the actuator 406 can rotate the actuating arm 434 (including the first gear 458) by an angle (e.g., about 90 degrees). The second gear 460 can also rotate by the same angle (e.g., about 90 degrees). Because the third gear 462 is smaller than the second gear 460, the third gear 462 can rotate by a larger angle (e.g., about 180 degrees) than the second gear 460. Thus, the gear assembly 436 can amplify a small amount of movement from the actuator 406 (e.g., to conserve space) in order to provide sufficient movement to transition the platform 402 between the stowed position (FIG. 23) and the deployed position (FIG. 25). The ratio between the size (e.g., diameter), number of teeth, and/or rotational movement of the second gear 460 to the third gear 462 can be about 1:1, about 1:1.25, about 1:1.5, about 1:1.75, about 1:2, about 1:2.25, about 1:2.5, about 1:2.75, about 1:3, about 1:3.5, about 1:4, or any ranges or values therebetween, although other configurations are also possible.

The second gear 460 can have the effect of increasing the size of the first gear 458. In some embodiments, the larger second gear 460 can be integrated with the actuating arm 434, and the first gear 458 can be omitted. In some cases, since the first gear 458 and the second gear 460 rotate together, they can be considered a single gear element. A cover 438 can cover some or all of the gears of the gear assembly 436. The cover 438 can have a hole or opening that a portion of the actuating arm 434 can extend through. Thus, a portion of the actuating arm 434 (e.g., including the end that couples to the shaft 464) can be outside the cover 438, and a portion of the actuating arm 434 (e.g., including the first gear 458) can be inside the cover 438. The third gear 462 can pivot about the same axis of rotation as the platform 402, the first arm 428, the second arm 430, and/or the cross member 465. The second gear 460 can pivot about the same axis of rotation as the actuating arm 434. The axis of rotation for the first gear 458 and/or the second gear 460 can be substantially parallel to the axis of rotation for the third gear 462.

Figure 28:
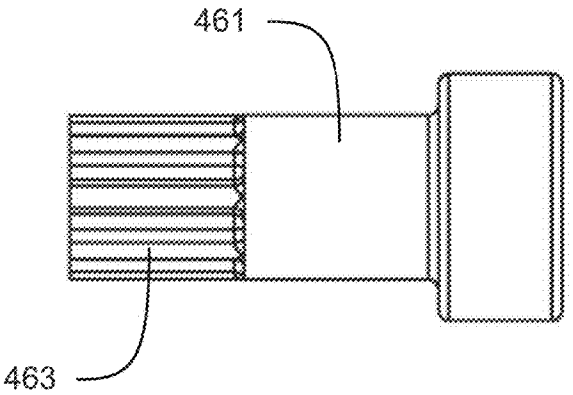
FIG. 28 shows an example embodiments of a rotation bolt.
Figure 30:
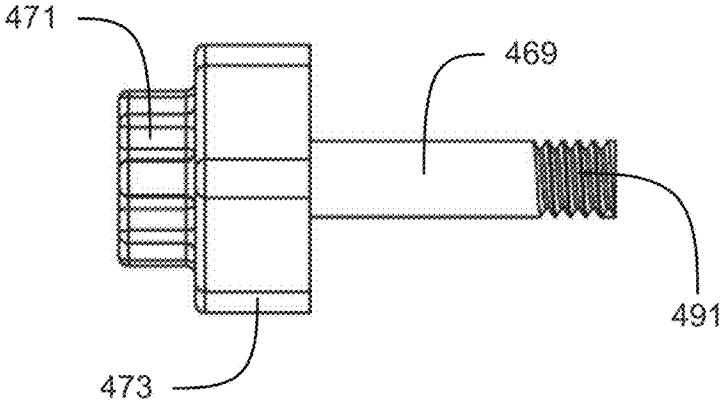
FIG. 30 shows an example embodiment of a release bolt.
Figure 29:
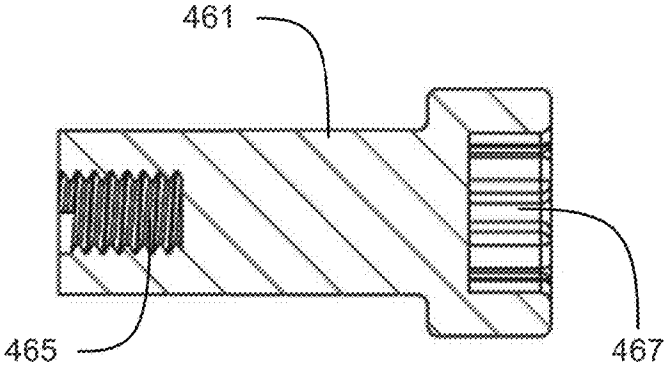
FIG. 29 is a cross-sectional view of an example embodiment of a rotation bolt.
Figure 31:
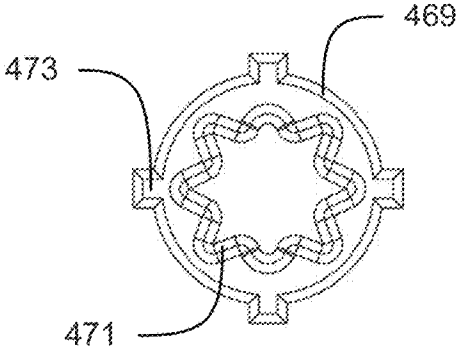
FIG. 31 shows another orientation of the release bolt.
Figure 33:
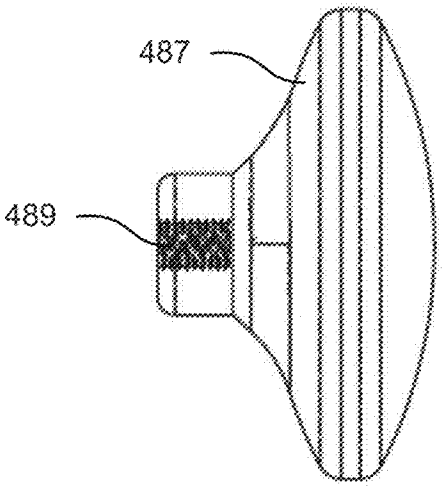
FIG. 33 shows an example embodiment of a knob.
Figure 35:
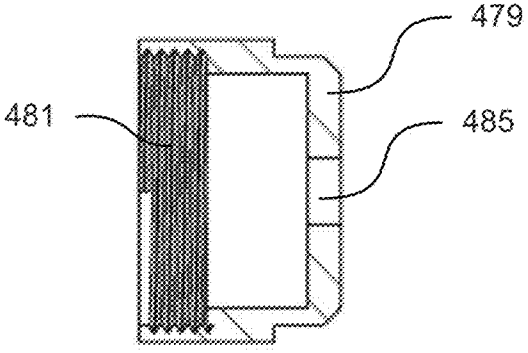
FIG. 35 shows a cross-sectional view of the cap.
Figure 32:
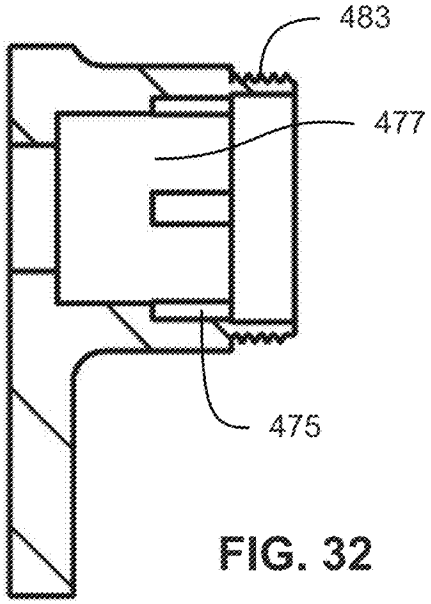
FIG. 32 is a cross-sectional view of a portion of a support arm for a movable platform.
Figure 34:
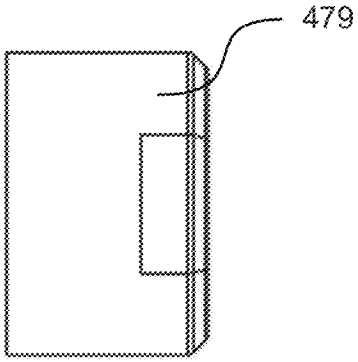
FIG. 34 shows an example embodiment of a cap.

The third gear 462 can have internal teeth, which can engage a rotation bolt 461. FIG. 28 shows a side view of the rotation bolt 461, and FIG. 29 shows a cross-sectional view of the rotation bolt 461. The rotation bolt 461 can include outwardly facing teeth 463, which can engage the inwardly facing teeth on the third gear 462, so that the rotation bolt 461 rotates with the third gear 462. In some cases, the teeth 463 on the rotation bolt 461 can be considered a fourth gear. The rotation bolt 461 can have a shaft that includes the outwardly facing teeth 463, and a head that is wider than the shaft. The shaft can extend through a hole or opening in the first arm 428 and a hole or opening in the first mount 404. The rotation bolt 461 can couple the first arm 428 to the first mount 404, and can provide a pivoting joint for the first arm 428 (and the attached platform 402) to rotate or pivot relative to the first mount 404. The portion of the rotation bolt 461 with the teeth 463 can extend into the area covered by the cover 438. The wider head of the rotation bolt 461 can impede the rotation bolt 461 from passing through the holes or openings. The end of the shaft of the rotation bolt 461 can include a threaded hole 465, which can receive a corresponding threaded screw or bolt. The screw or bolt can pass through a hole or opening in the cover 438 and engage the threaded hole 465 on the rotation bolt 461 to position the rotation bolt 461. When assembled, the rotation bolt 461 can rotate about its longitudinal axis, but is impeded from moving axially.

The rotation bolt 461 can have teeth 467 that engage with corresponding teeth 471 on a release bolt 469. The release bolt 469 can be part of a release mechanism to decouple the platform 402 from the actuator 406, as disclosed herein. The release bolt 469 can have a shaft and a wider head. The teeth 471 on the release bolt 469 can be outwardly facing teeth on a protrusion that extends axially from the head of the release bolt 469, and the corresponding teeth 467 on the rotation bolt 461 can be inwardly facing teeth formed in a recess in the head of the rotation bolt 461, although the opposite configuration could also be used, as well as various other types of engagement elements. The release bolt 469 can move axially (e.g., in response to action by a user), as discussed herein. When the release bolt 469 moves axially towards the rotation bolt 461, the corresponding teeth 467 and 471 can engage so that the release bolt 469 rotates with the rotation bolt 461. The engaged configuration can couple the platform 402 to the actuator 406. When the release bolt 469 is moved axially away from the rotation bolt 461, the corresponding teeth 467 and 471 can disengage. In the disengaged configuration, the rotation bolt 461 can rotate without causing corresponding rotation of the release bolt 469. The disengaged configuration can decouple the platform 402 from the actuator 406, such as for manual operation or in the event of a malfunction or emergency.

The head of the release bolt 469 can have engagement features 473 that are keyed to engage corresponding engagement features 475 on the first arm 428. The first arm 428 can include a recess 477 (e.g., formed by a shroud), and the recess 477 can contain the head of the rotation bolt 461 and the head of the release bolt 469. The wall of the recess 477 (e.g., inside of the shroud) can have the engagement features 475, which can be recesses configured to receive the protrusions on the head of the release bolt 469, although other engagement features can be used. In some cases, the engagement features 473 and 475 can be configured to enable the release bolt 469 to selectively engage and disengage the first arm 428. For example, when the release bolt 469 is moved axially towards the rotation bolt 461, the engagement features (e.g., 4 protrusions) 473 on the release bolt 469 can engage the corresponding engagement features (e.g., 4 recesses) 475 on the first arm 428. This engaged configuration can cause the first arm 428 (e.g., and the platform 402) to rotate with the release bolt 469 (e.g., driven by the actuator 406). When the release bolt 469 is moved axially away from the rotation bolt 461, the engagement features (e.g., 4 protrusions) 473 on the release bolt 469 can disengage from the corresponding engagement features (e.g., 4 recesses) 475 on the first arm 428. This disengaged configuration can decouple movement of the first arm 428 (e.g., and the platform 428) from rotation of the release bolt 469, which can decouple the platform 402 from the actuator 406.

In some embodiments, movement of the release bolt 469 to the disengaged position (e.g., axially away from the rotation bolt 461) can disengage the release bolt 469 from the rotation bolt 461 (e.g., and the actuator 406), and can also disengage the release bolt 469 from the first arm 428 (e.g., and the platform 402). Accordingly, the system can have two levels of disengagement between the actuator 406 and the platform 402, when disengaged.

In some embodiments, the release bolt 469 can remain engaged with the first arm 428 regardless of whether the platform 402 is coupled or decoupled from the actuator 406. For example, the release mechanism feature can be provided by disengagement of the teeth 471 of the release bolt 469 from the teeth 467 of the rotation bolt 461. The engagement features (e.g., recesses) 475 on the first arm 428 can be long enough that the engagement features (e.g., the protrusions) 473 on the release bolt 469 can remain engaged therewith while the release bolt 469 moves axially between the positions that engage and disengage from the rotation bolt 461.

In some embodiments, the rotation bolt 461 and the release bolt 469 can remain engaged regardless of whether the platform 402 is coupled or decoupled from the actuator 406. For example, the release mechanism feature can be provided by disengagement of the engagement features 473 of the release bolt 469 from the engagement features 475 of the first arm 428. In some cases, the rotation bolt 461 and the release bolt 469 can move axially together, or can be incorporated into a single unitary part.

A cover or cap 479 can cover the recess 477 on the first arm 428. The cap 479 can have a threaded (e.g., inner) side wall 481 that can engage a threaded (e.g., outer) sidewall 483 of the shroud that defines the recess 477, although other engagement mechanism can be used, such as snap fit, crimping, adhesive, bolts, etc. The cap 479 can have a hole or opening 485 that the shaft of the release bolt 469 can extend through. The shaft of the release bolt 469 can be coupled to a knob 487. The knob 487 can have a threaded hole 489, which can receive a corresponding threaded portion 491 of the shaft of the release bolt 469. The body of the knob 487 can be configured for a use to grip, such as to pull on the knob 487 to disengage the platform 402 from the actuator 406, and/or to push on the knob 487 to engage the platform 402 with the actuator 406, as discussed herein. In some cases, a spring or other biasing mechanism 493 can be in the recess 477. The spring 493 can bias the release bolt 469 towards the rotation bolt 461. Accordingly, the platform 402 can be normally engaged with the actuator 406, unless a user intervenes to pull the knob 487 and decouple the platform 402 form the actuator 406. Various other types of user actuation elements can be used in place of the knob 487, such as a lever, a button, or a switch, etc. to couple and decouple the platform 402 from the actuator 406. The axial movement of the knob 487 and/or the release bolt 469 can be substantially co-axial with a pivot axis of the platform 402. The third gear 462 can also be substantially co-axial with the knob 487. The rotational axes of the knob 487, cap 479, release bolt 469, rotation bolt 461, and/or third gear 462 (or any combination thereof) can be substantially co-axial with each other, and/or can be substantially co-axial with the pivot axis of the platform 402.

In some cases, the first mount 404 can have a stopper 495, which can impede over-rotation of the platform 402. When the platform 402 moves to the stowed position, the first arm 428 can abut against the stopper 495 to prevent the first arm 428 (e.g., and the platform) from rotating further. In some cases, the stopper 495 can have a contact sensor (e.g., a momentary switch) that can detect whether the first arm 428 is abutting the stopper 495, which can provide an electrical signal as indication of whether the platform 402 is in the stowed position.

Many variations are possible. Various different types of coupling mechanisms can be used. Rather than circumferential teeth on the actuating handle 434, inside of the gears 460 and 462, the rotation bolt 461, and the release bolt 469, etc. the corresponding components can be keyed to fit together or otherwise have corresponding engagement features (e.g., recesses and protrusions) so that the corresponding components rotate together when engaged. In some cases the release mechanism can be omitted. For example, the head of the rotation bolt 461 can be keyed to engage the engagement features 475 on the first arm 428. In some embodiments, a similar actuator and gear mechanism etc. can be used to drive the second arm 430 as well as the first arm 428.

The top surface of the deployed platform 202 or 402 can be more below the top surface of the swim deck 104 by about 5 inches, about 7 inches, about 10 inches, about 12 inches, about 15 inches, about 20 inches, about 25 inches, about 30 inches, or more, or any values or ranges therebetween, although other configurations are possible. These distances can also apply to the difference of vertical movement of the platform 202 or 402 between the stowed and deployed positions.

In some embodiments, a rotary actuator (e.g., a rotary servo motor) can be coupled to the movable platform assembly. In some cases, the gear assembly can be omitted. The rotary actuator can be positioned at the pivot point and can be coupled directly to the movable platform assembly so that rotation of the rotary actuator produces a one-to-one corresponding rotation of the moveable platform assembly. For example, both the rotary actuator and the platform assembly can rotate about 160 to 200 degrees, or about 180 degrees, or any other values therebetween.

Figure 36:
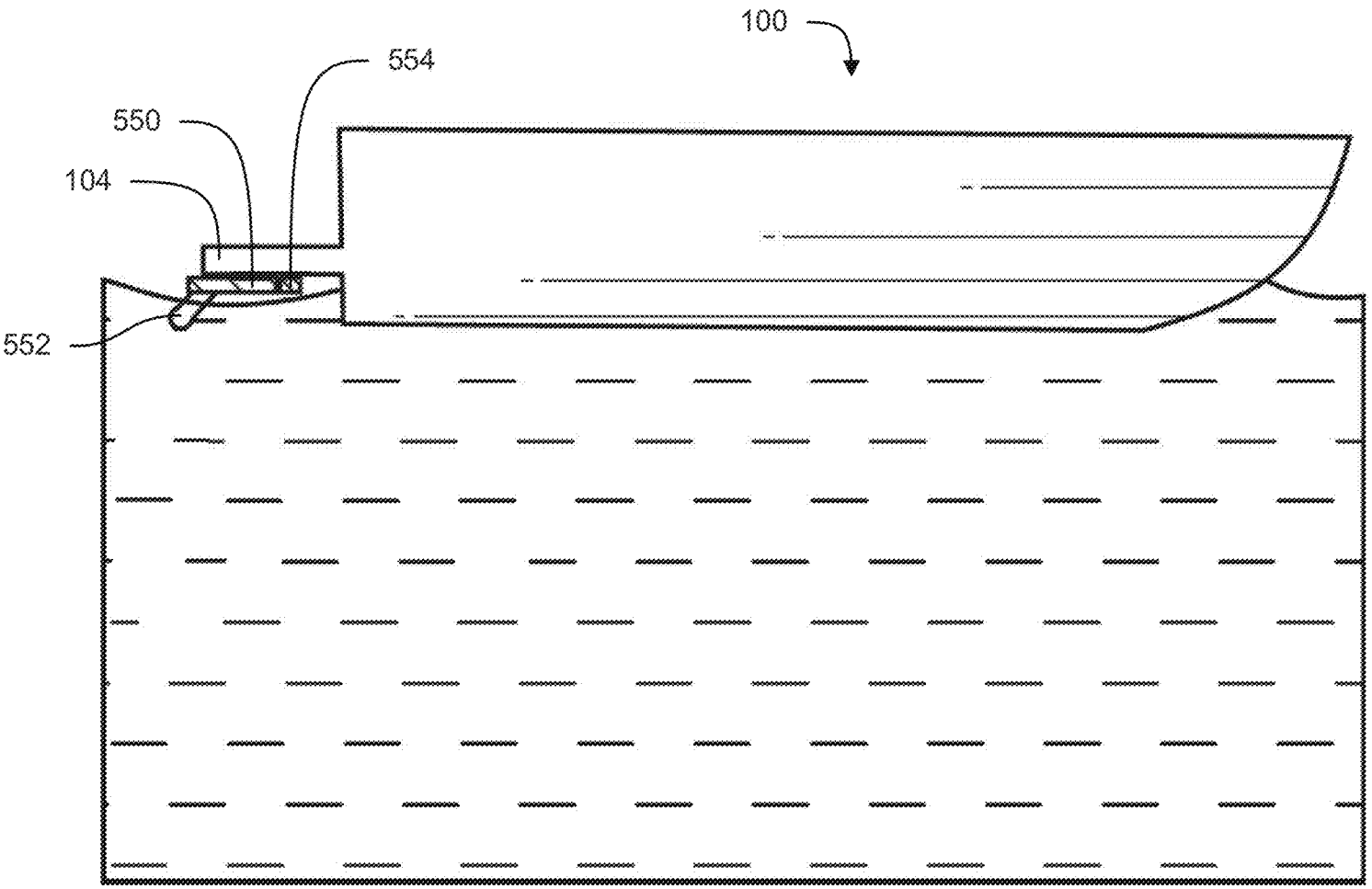
FIG. 36 shows an example embodiment of a boat with a movable platform in a stowed position.
Figure 37:
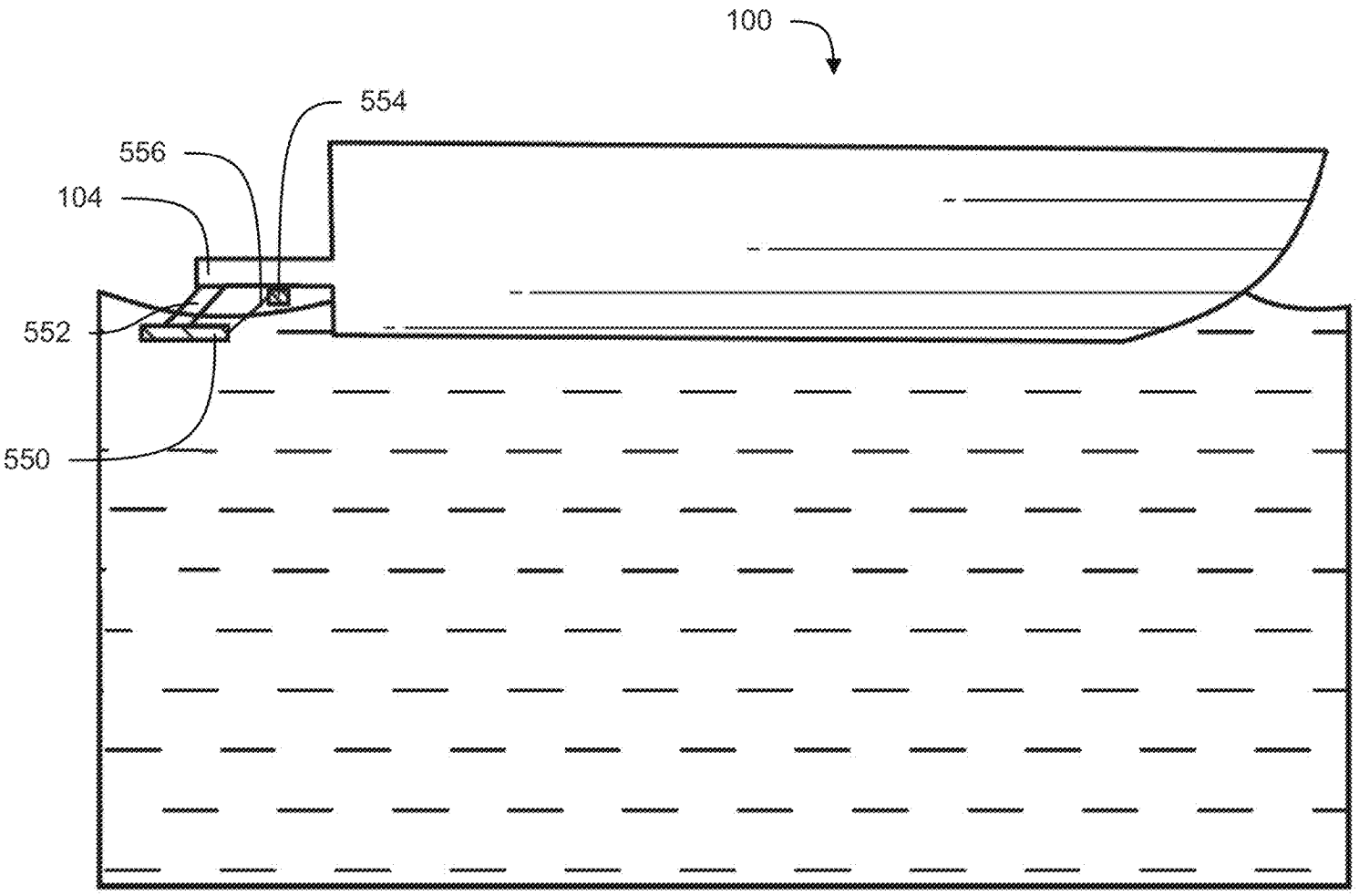
FIG. 37 shows an example embodiment of a boat with a movable platform in a deployed position.

In some configurations, the movable platform does not flip or rotate to move between the stowed position and the deployed position. FIGS. 36 and 37, show an example embodiment of a boat 100 with a movable platform 550 that moves linearly between a stowed position (e.g., FIG. 36) and a deployed position (e.g., FIG. 37). The boat 100 can have a swim deck 104. The movable platform 550 can be under the swim deck 104 when in the stowed position. The movable platform 550 can be coupled to one or more guides 552, which can extend downward and rearward, for example. An actuator 554 (e.g., a hydraulic actuator, electric actuator, electric hydraulic actuator, pneumatic actuator, linear actuator, stepper motor, electric motor, and/or another suitable actuator) can be coupled to the platform 550 so that the actuator 554 can move the platform 550 (e.g., linearly) along the one or more guides 552 between the stowed and deployed positions. The actuator 554 can include a shaft 556 that extends to push the platform 550 toward the deployed position. The shaft 556 can retract to pull the platform toward the stowed position. The actuator 554 can be rotatably coupled to the boat 100 (e.g., to the hull or swim deck 104 other suitable portion), and the actuator can be rotatably coupled to the platform 550, so that the orientation of the actuator 554 can shift as the platform 550 moves. For example, as the platform 550 move towards the deployed position, the actuator can pivot (e.g., away from the swim deck 104) due the change in the position of the platform 550 relative to the coupling between the actuator 554 and the boat 100. As the platform 550 move towards the stowed position, the actuator 554 can pivot (e.g., towards the swim deck 104) due to the change in the position of the platform 550 relative to the coupling between the actuator 554 and the boat 100.

Figure 38:
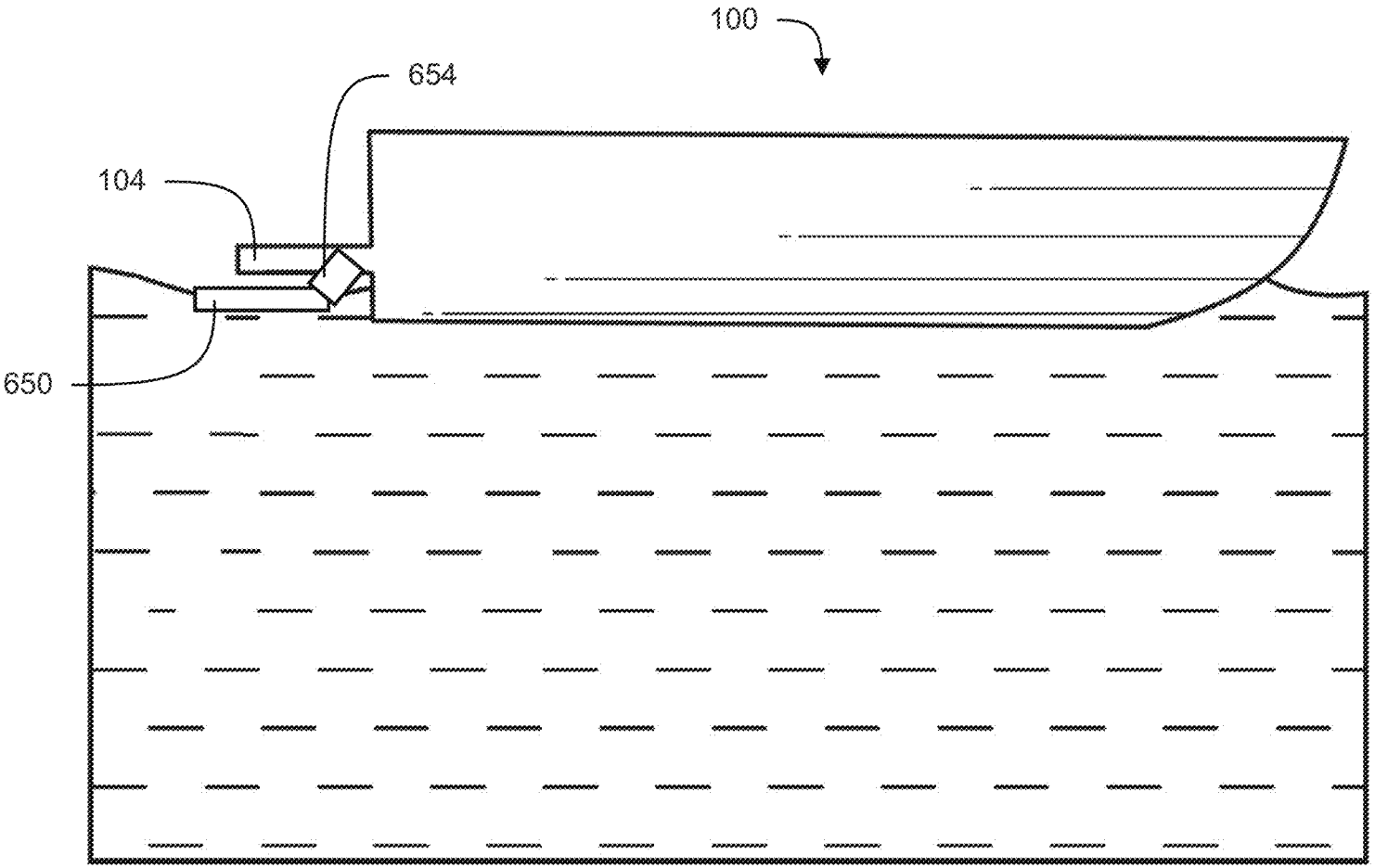
FIG. 38 shows an example embodiment of a boat with a movable platform in a stowed position.
Figure 39:
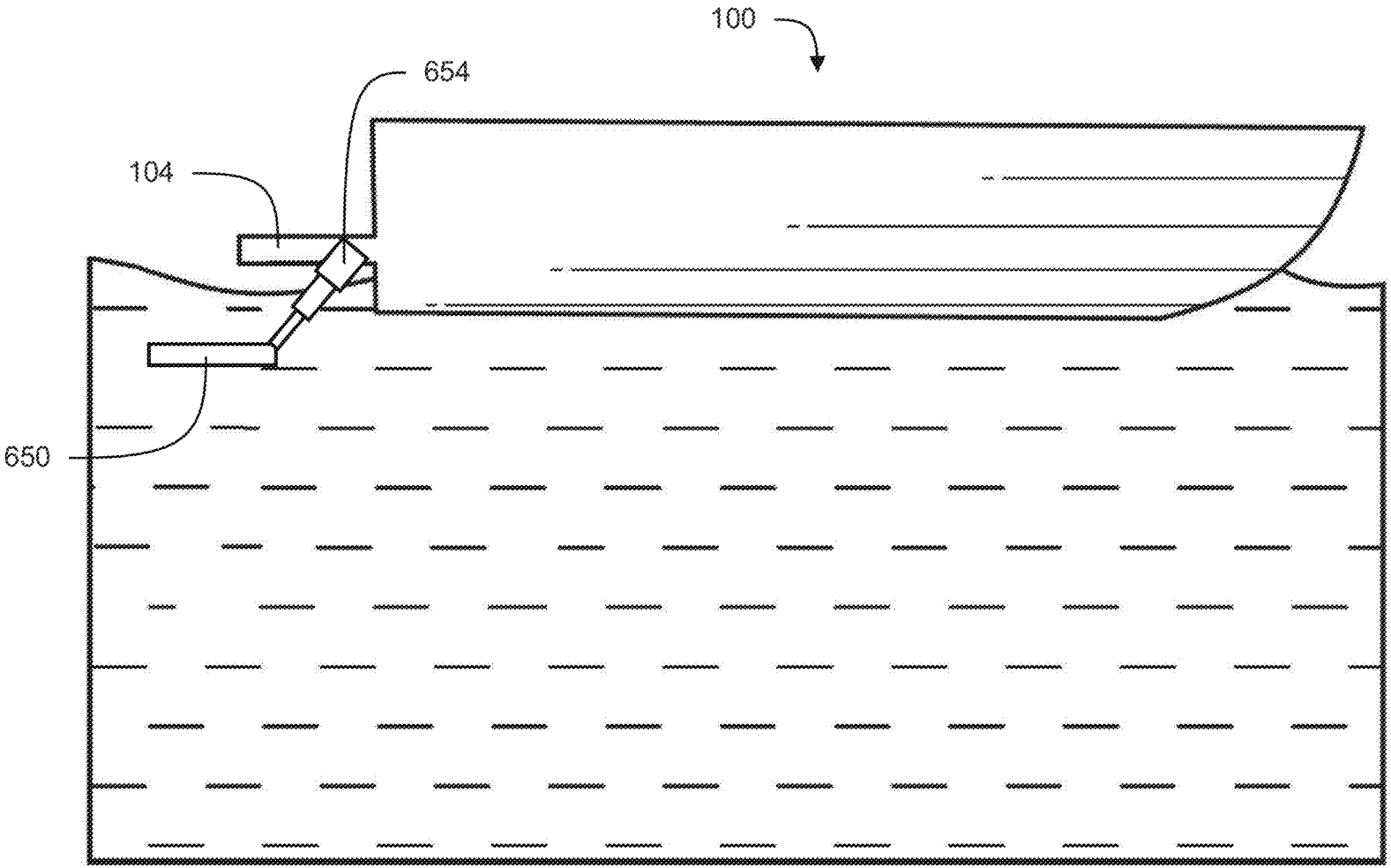
FIG. 39 shows an example embodiment of a boat with a movable platform in a deployed position.

With reference to FIGS. 38 and 39, in some embodiments, the boat 100 can include a movable platform 650 that can be moved by a telescoping actuator 654. The platform 650 can be in the stowed position under the swim deck 104 (e.g., as shown in FIG. 38). The telescoping actuator 654 can be retracted to position the platform 650 in the stowed position. The telescoping actuator 654 can extend to move the platform 650 to the deployed position (e.g., as shown in FIG. 39). The telescoping actuator 654 can be coupled to the boat 100 (e.g., to the hull or to the swim deck 104), such as at a fixed angle, so that the platform 650 moves linearly between the stowed and deployed positions. In some embodiments, the boat 100 can include one or more guides (e.g., similar to the guides 552 of FIGS. 36-37) for guiding the platform 650 along the path between the stowed and deployed positions. In some configurations, the guides 552 can be omitted.

FIGS. 40A-41C show another embodiment of a powered swim platform 700, which can have features that are the same as, or similar to, the powered swim platform 200, powered swim platform 400, and/or other embodiments disclosed herein. The discussion of the powered swim platform 700 will focus on differences from the other embodiments, and many features of the other embodiments can be incorporated into the powered swim platform 700 and vice versa. The swim deck 104 and/or platform 702 can be used in connection with a water-sports boat, or with other types of boats (cruisers, runabouts, pontoon boats, etc.), or with other watercraft.

Figure 40A:
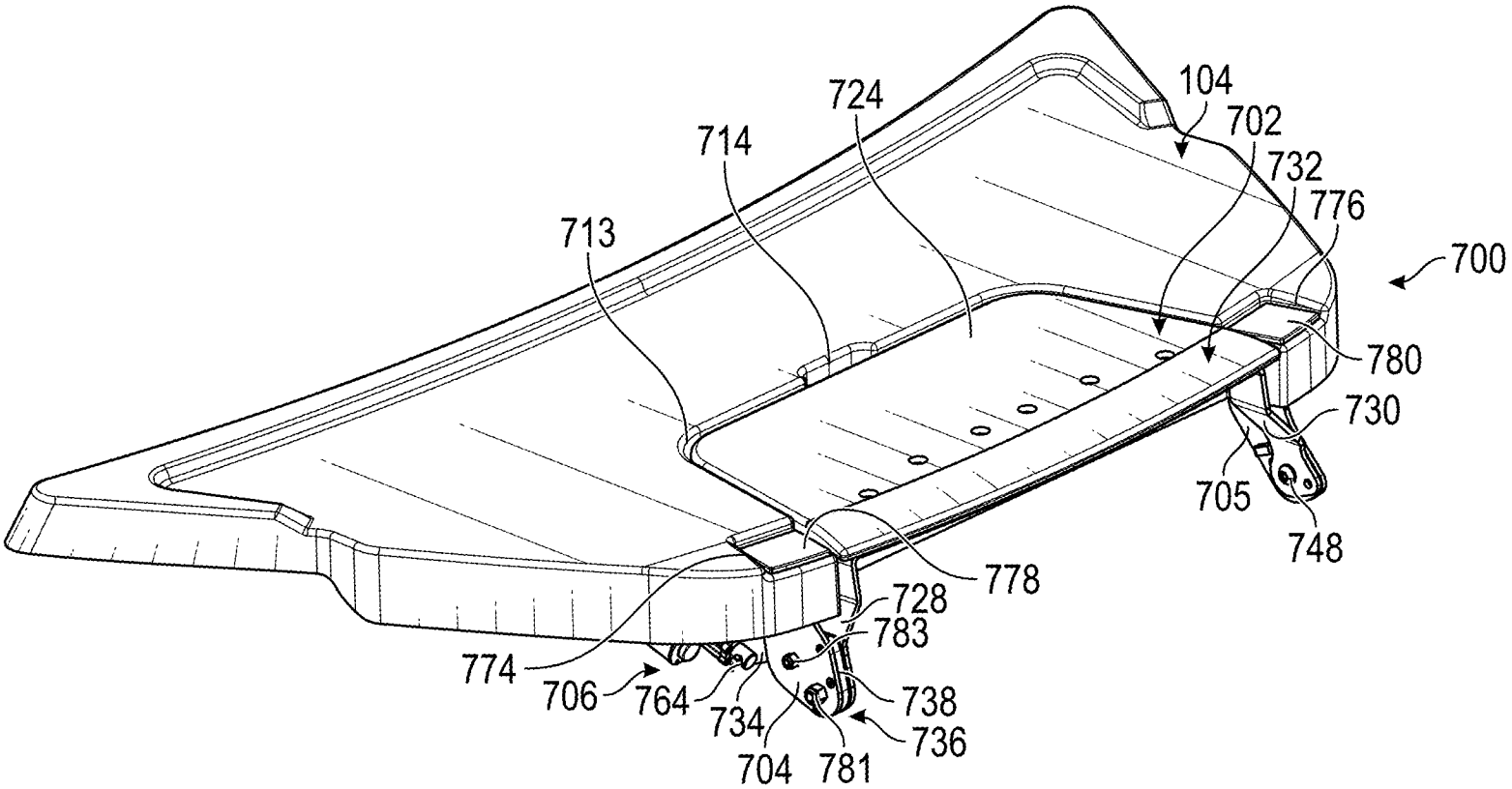
FIG. 40A shows an example embodiment of a movable platform in a stowed configuration.
Figure 40B:
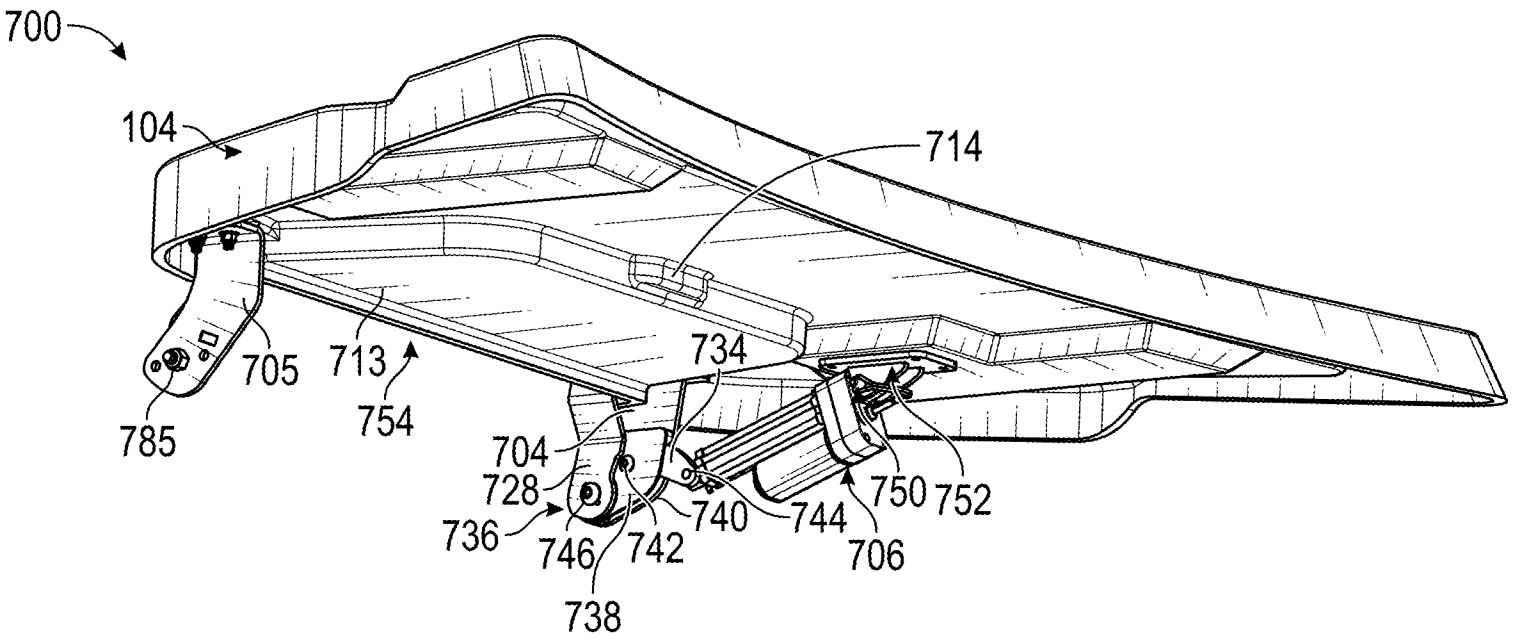
FIG. 40B shows another view of the movable platform in the stowed configuration.
Figure 41A:
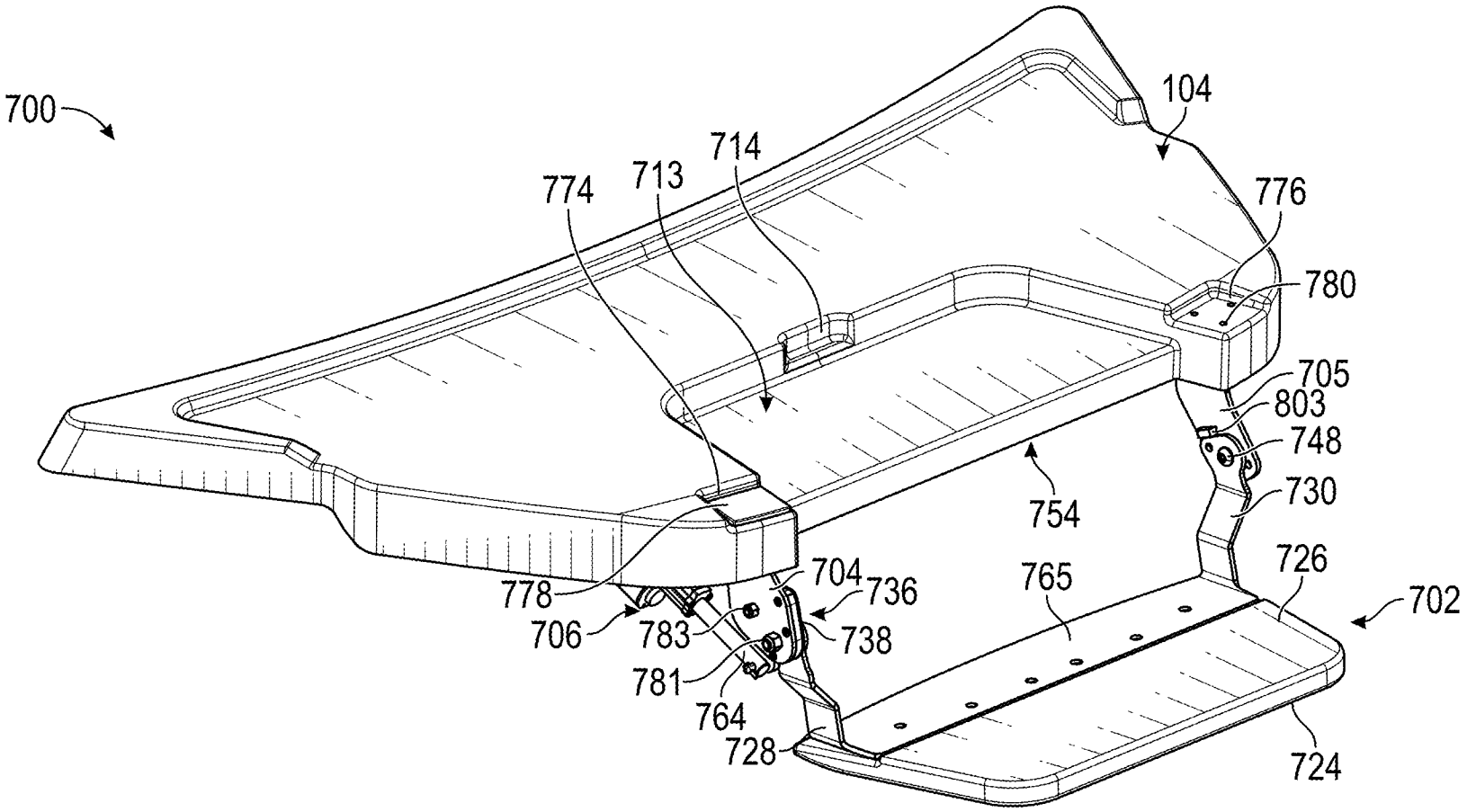
FIG. 41A shows an example embodiment of a movable platform in a deployed configuration.
Figure 41B:
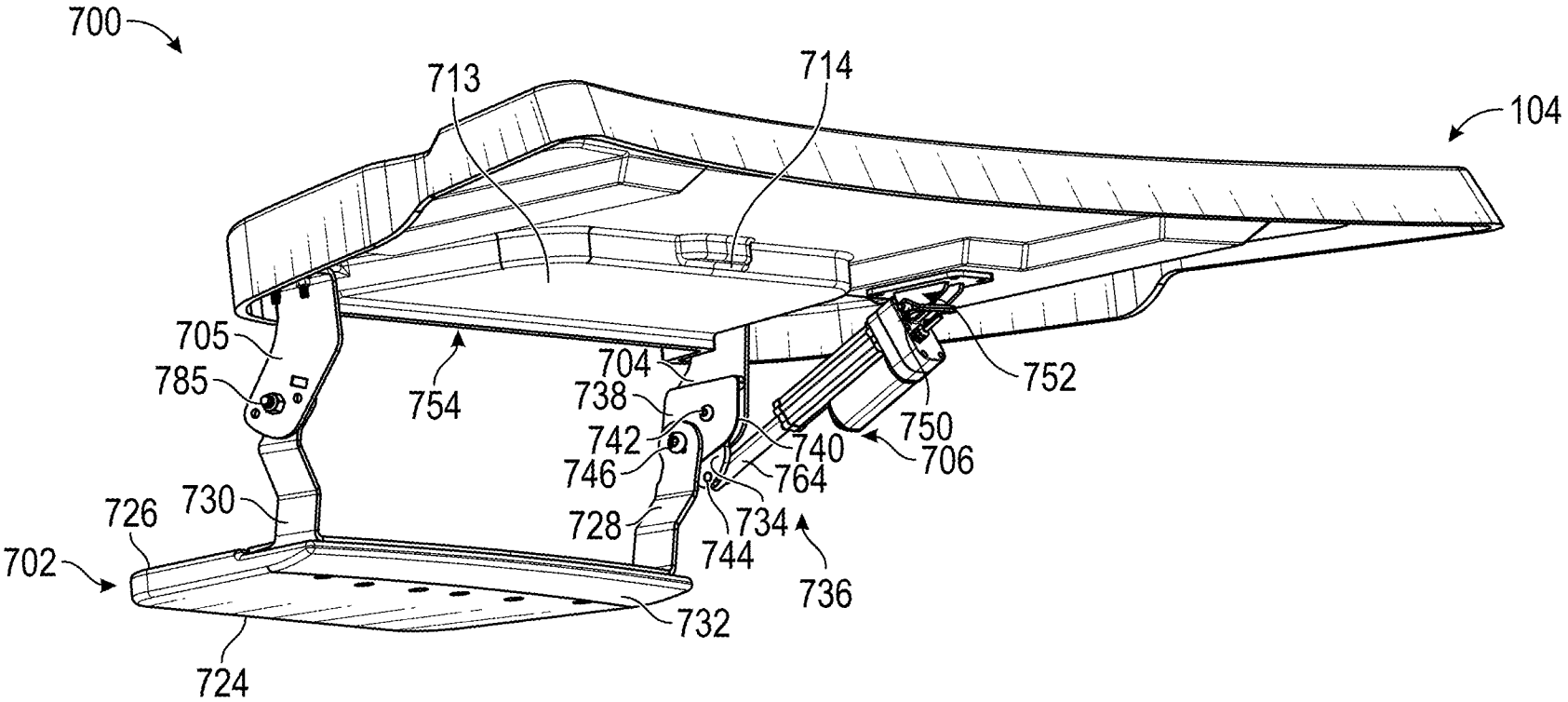
FIG. 41B shows another view of the movable platform in the deployed configuration.

The boat 100 can have a swim deck 104 and a movable platform 702, which can be moved (e.g., pivoted) between a stowed position and a deployed position. FIGS. 40A and 40B show the platform 702 in the stowed position. FIGS. 41A and 41B show the platform 702 in the deployed position. A first side 724 of the platform 702 can face generally upward, and a second side 726 of the platform 702 can face generally downward, when the platform 702 is in the stowed position. The first side 724 of the platform 702 can face generally downward, and the second side 726 of the platform 702 can face generally upward, when the platform 702 is in the deployed position. The top surface of the swim deck 104 can include a horizontal portion and the bottom surface of the swim deck 104 can include a horizontal portion. A first portion of the platform 702 (e.g., the first side 724) can be located above the horizontal portion or another portion of the bottom surface of the swim deck 104. A second portion of the platform 702 (e.g., the second side 726) can be located above the horizontal portion or another portion of the top surface of the swim deck 104.

The boat 100 can have a receiving portion (e.g., a recess) 713, and the platform 702 can fit into the receiving portion 713 when in the stowed position. The receiving portion 713 can be disposed in the swim deck 104 of the boat 100. When in the stowed position, the first surface 724 of the movable platform 702 can be substantially flush with the top surface of the swim deck 104. The recess 713 can include a pocket 714 that can enable the user to firmly grasp the platform 702 for deployment and/or when placing the platform 702 in the recess 713.

An actuator 706 can move the platform 702 between the stowed and deployed positions, such as by rotating the platform 702. The actuator 706 can move a shaft 764, which can be coupled to an actuating arm 734. The actuating arm 734 can be coupled to a gear assembly 736, which can be configured to pivot the platform 702. The powered actuator 706 can be operably linked to the gear assembly 736 through the cover 738 (e.g., through an opening of the cover 738 and/or an opening at least partially defined by the cover 738). The gear assembly 736 can be activated to rotate the gears thereof in a first direction to move the platform 702 between the stowed position and the deployed position. The gear assembly 736 can be activated to rotate the gears thereof in a second direction to move the platform 702 between the deployed position to the stowed position. For example, in some embodiments, the gear assembly 736 can be coupled to a first arm 728 that supports a first side of the platform 702 so that rotation of the gears in the gear assembly 736 applies a rotational force to the first arm 728. The first arm 728 can be rotationally coupled to a first mount 704, which can be mounted to the swim deck 104 (e.g., rigidly). For example, the first arm 728 can be coupled to the first mount 704 with a fastener 746 (e.g., bolt, screw, etc.) and nut 781. A gear assembly 736 can be disposed between the first arm 728 and the first mount 704, which, as described herein, can facilitate deployment and stowage of the platform 702. A second arm 730 can support a second side of the platform 702 and can be rotationally coupled to a second mount 705, which can be mounted to the swim deck 104 (e.g., rigidly). The second arm 730 can be coupled to the second mount 705 with a fastener 748 and nut 785. The boat and/or powered swim platform 700 can include a switch that can activate the actuator 706. The switch can be manipulated to move the platform 702, which can include moving the platform between the stowed and deployed configurations. In some embodiments, the switch can be held to move (e.g., rotate the platform between positions) and released to stop movement of the platform 702.

As described herein, the first mount 704 can include a first anchor (flange, clasp, hook) 778 that couples to the swim deck 104 within a first recess (groove, notch, indentation) 774. The second mount 705 can include a second anchor (flange, clasp, hook) 780 that couples to the swim deck 104 within a second recess (groove, notch, indentation) 776.

The platform 702 can be deployed and stowed at varying speeds, which can include less than fifteen seconds or eight seconds. The speed of deployment and stowage can be enhanced through gear configurations and/or the extension and retraction speed of the shaft 764 of the actuator 706.

The second mount 705 can include a stop 803 (protrusion), as shown in FIG. 41A, which can be disposed on an inside surface of the second mount 705. The stop 803 can be placed such that the second arm 730 rotates into contact with the stop 803 with the platform 702 in the deployed configuration. The stop 803 can, in some variants, prevent over rotation of the platform 702 and/or support a portion of a load on the platform 702 in the deployed configuration. The gear assembly 736, actuator 706, and related components can be disposed at a starboard, port, or central position. In some variants, the placement of the gear assembly 736, actuator 706, and related components can be positioned to avoid interference with a wake created by the boat. For example, the gear assembly 736, actuator 706, and related components may be positioned on a starboard side of the boat to reduce interference with a port surf wake. The powered swim platform 700, swim deck 104, and/or boat can include one or more mechanical stops to limit movement of the platform 702.

The first arm 728 and the second arm 730 can be curved inward and/or angled inward to provide clearance during rotational deployment or stowage of the platform 702. For example, the first arm 728 and the second arm 730 can be angled and/or curved inward such that the first arm 728 and second arm 730 can fit within a recess (gap, break) 754 of the swim deck 104 when the platform 702 is in the stowed position. In some cases, a cross member 765 can extend between the first arm 728 and the second arm 730. The main body of the platform 702 can be coupled to the cross member 765. The platform 702 can include an inclined surface 732, which can improve user comfort when sitting on the platform 702 in the stowed configuration.

Figure 40C:
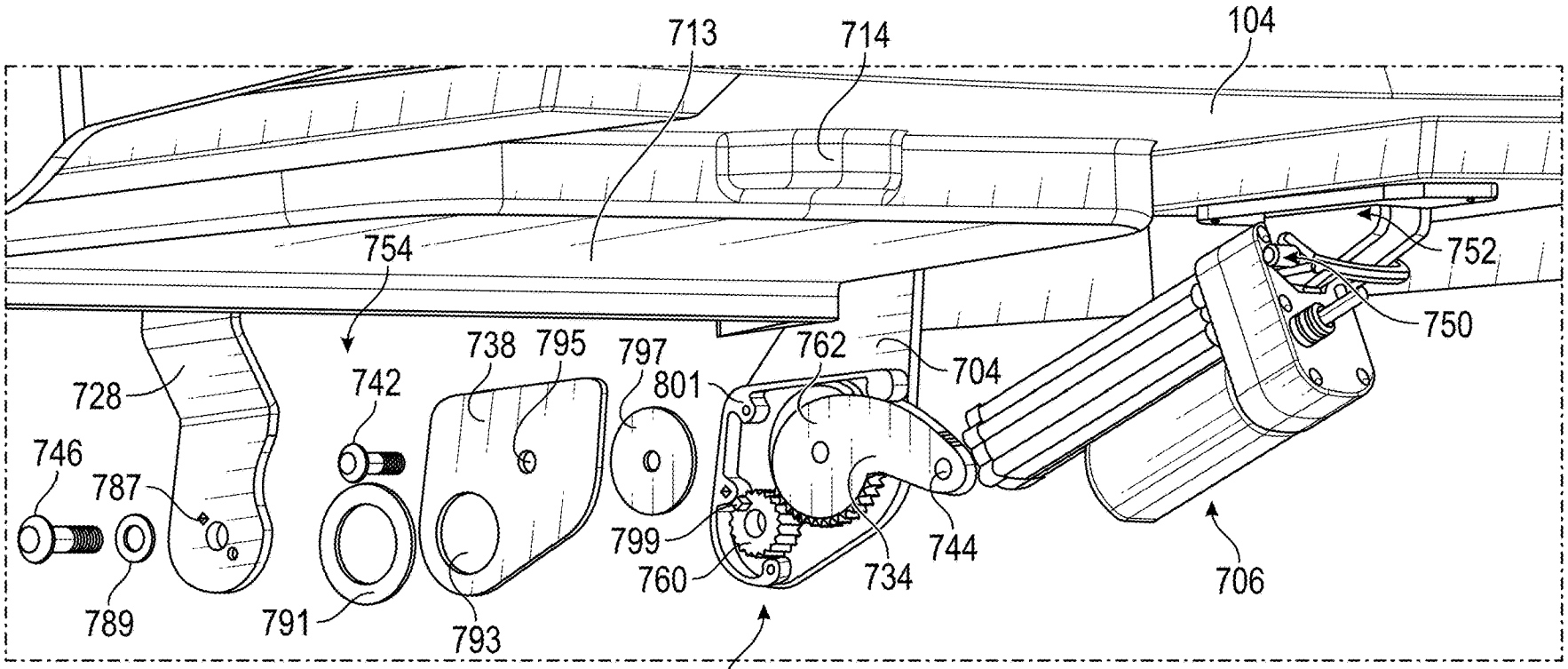
FIG. 40C shows a partially exploded view of the movable platform in the stowed configuration.

The powered swim platform 700 can have a different gear assembly 736 than the powered swim platform 200 or powered swim platform 400. FIG. 40C shows a partially exploded view of the gear assembly 736 with the platform 702 in the stowed configuration. The actuator 706 can be rotatably coupled to the swim deck 104 and/or other portion of the boat 100 such that the actuator 706 can pivot as the shaft 764 of the actuator 706 extends to rotate the actuating arm 734 about a pivot axis defined by the fastener 742. In some instances, the actuator 706 can be coupled to one or more (e.g., two) flanges 752 with a fastener 750, such as a locking pin. As shown, the shaft 764 of the actuator 706 is retracted, placing the actuating gear 734 and actuator 706 in an upward rotated position (i.e., rotated toward the swim deck 104).

The actuator 706 can extend and retract a shaft 764. The extension and retraction of the shaft 764 can rotate the actuating arm 734 about the fastener 742. For example, the shaft 764 can be coupled to the actuating arm 734 at a joint 744, which can be secured with a fastener, that allows the actuating arm 734 to rotate relative to the shaft 734. The actuating arm 734 can include an actuating gear 762, which can include a portion with teeth and a portion without teeth. The actuating gear 762 can be interfaced with another gear 760, such that rotation of the actuating gear 762 causes the rotation of the gear 760. The gear 760 can include a portion with teeth and a portion without teeth.

The gear 760 can be coupled and/or otherwise connected to the first arm 728 such that rotation of the gear 760 causes the rotation of the first arm 728 to deploy or stow the platform 702. The gear 760 can include a protrusion 799 (tab, key, flange, extrusion). The protrusion 799 can be disposed on an inward face of the gear 760. The protrusion 799 can extend in a direction that is parallel to the axis of rotation of the gear 760. The protrusion 799 can be inserted into a hole or recess 787 of the first arm 728 to couple the gear 760 and first arm 728 rotatably together. In some variants, the protrusion 799 can be welded, adhered, fastened, and/or otherwise secured to the first arm 728. The gear 760 can be smaller than the actuating gear 762 to amplify the rotation of the actuating gear 762, which can effectively amplify a relatively small amount of movement of the shaft 764 to rotate the platform 702 between the stowed and deployed configurations.

The gear assembly 736 can include a cover 738. The cover 738 can house the gear assembly 736. The cover 738 can enclose the entire gear assembly 736 or enclose a portion of the gear assembly 736 such that portion(s) thereof are exposed. The cover 738 can cover the gears, such as the actuating gear 762 and the gear 760. The cover 738 can cover at least a portion of the actuating arm 734. The cover 738 can be mounted onto the first mount 704. A peripheral structure 801 can space the cover 738 away from the first mount 704 to provide room for the actuating arm 734 and the gear 760 to rotate. The peripheral structure 801 can extend around the gear 760 and actuating gear 762. The first mount 704 and the cover 738 can cooperate to define a slot, gap, or opening 740 through which the actuating arm 734 can move as the shaft 764 extends and retracts to rotate the actuating arm 734. In some variants, the cover 738 or any of the covers described herein can be substantially watertight. In some variants, the cover 738 and the first mount 704 can cooperate to create an enclosure that is substantially water right. In some variants, the opening 740 can include a seal and/or other device to help a cavity at least partially defined by the cover 738 to be substantially watertight.

The cover 738 can include an opening 795 through which the fastener 742 can be disposed to support the actuating arm 734 on the first mount 704. The fastener 742 can be secured with the nut 783. The actuating arm 734 and the actuating gear 762 can rotate about the fastener 742. A disc or ring 797 can be disposed on the fastener 742 between the cover 738 and the actuating gear 762 to reduce friction between the rotating actuating gear 762 and the cover 738

The cover 738 can include an opening 793. The fastener 746 can extend through the first arm 728 and through the opening 793 of the cover 738 to support the gear 760 and first arm 728 on the first mount 704. The gear 760 can rotate about the fastener 742. The opening 793 can be sufficiently large to allow the protrusion 799 of the gear 760 to extend therethrough to be inserted into the opening 787 of the first mount 787 and rotate within the opening 793 during deployment and stowage of the platform 702. A first ring 789 can be disposed between the head of the fastener 746 and the first arm 728 to promote rotation between the head, which can be fixed relative to the first arm 728, and the rotating first arm 728. A second ring 791 can be disposed between the rotating first arm 728 and the cover 738 to promote rotation.

Figure 41C:
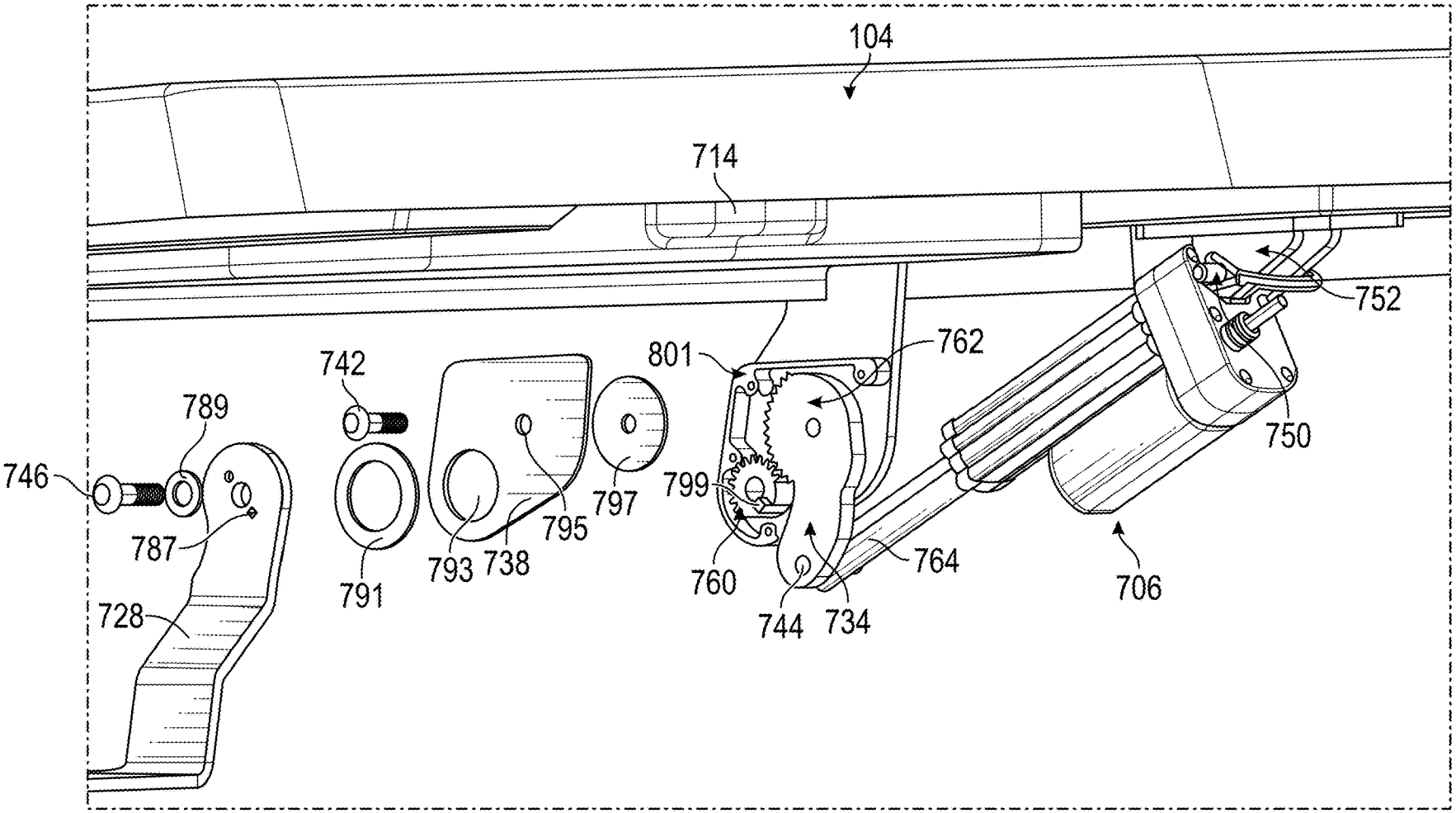
FIG. 41C shows a partially exploded view of the movable platform in the deployed configuration.

FIG. 41C shows a partially exploded view of the gear assembly 736 with the platform 702 in the stowed configuration. As shown, the shaft 764 of the actuator 706 is extended, placing the actuating arm 734 in a rotated down position. As described herein, the rotation of the actuating arm 734 downward rotates the actuating gear 762 which rotates the gear 760 to cause the first arm 728 and platform 702 to rotate to the deployed configuration illustrated in FIGS. 41A and 41B. The placement of the protrusion 799 of the gear 760 within the hole 787 of the first arm 728 can couple the rotation of the first arm 728 with the gear 760. As shown, the extension of the shaft 764 of the actuator 706 can rotate the actuator 706 downward away from the swim deck 104 about the pivot axis defined by the fastener 750.

In some embodiments, a limit switch or similar device, such as an electrical switch, can be used to determine whether the platform is deployed, deploying/stowing, or stowed. In some embodiments, the actuator can include a limit switch or similar device, which can include a built-in limit switch or similar device. In some embodiments, the limit switch or similar device can be external to the actuator. In some variants, a limit switch or similar device can be positioned on or in the platform, recess configured to receive the platform, swim deck, features of the gear assembly (e.g., actuating arm, cover, etc.), first or second mount, first or second arm, and/or another feature of the powered swim platform. The electrical input from the limit switch or similar device can be used to convey to a user the status of the platform (e.g., deployed, stowed, etc.). A user interface, such as the user interface of the cockpit (control center) and/or other user interface or screen described herein, speaker, light, portable device, etc. can notify the driver when the platform is deployed or stowed. An indicator of the cockpit (control center), which can include a dash-mounted indicator, can notify the driver when the platform is deployed or stowed.

In some embodiments, the gears can be manually driven to move the platform between stowed and deployed configurations. For example, a gear of the gear assembly can be connected to a lever, member, link, and/or other device that can be manipulated (e.g., rotated) by the user such that movement of the lever, member, link, and/or other device rotates the gear connected thereto to drive the gears of the gear assembly to move the platform (e.g., rotate the platform).

In some embodiments, the powered swim platform can include a strain gauge. The strain gauge can detect a strain on the platform. The powered swim platform can limit or stop movement of the platform based on the strain on the platform. For example, if the strain on the platform exceeds a certain strain, the powered swim platform can limit or stop movement of the platform. The boat can limit or stop movement of the boat based on the strain on the platform. For example, if the strain on the platform exceeds a certain strain, the movement of the boat can be limited or stopped.

The boats and/or powered swim platforms described herein can include at least one safety feature configured to provide at least one of an audio or visual alarm when the platform is not in the stowed position and the boat is at least one of ready for powered movement, moving under power, or moving under power above a predetermine speed. In some variants, the safety feature can determine that the boat is ready for powered movement when switched into a drive gear.

In some embodiments, the powered swim platform, can include a release mechanism, which can at least include those described herein. The release mechanism can decouple the platform from the powered actuator to enable manual movement of the platform between the deployed and stowed positions. The release mechanism can prevent the powered actuator from moving the platform. The release mechanism can decouple the powered actuator from the gears such that the powered actuator cannot drive the gears to move the platform. The release mechanism can decouple the gears form the platform such that gears cannot move the platform. The release mechanism can release the powered actuator to prevent the powered actuator from moving the platform.

In some embodiments, a sensor can output the current draw (e.g., amperage) of the actuator that moves the platform. If an object blocks movement of the platform, the current drawn by the actuator can increase. The system can monitor the current draw of the actuator. If the monitored current drawn increases (e.g., above a threshold value or at a threshold rate of increase) the system can provide a command to disable or reverse the actuator. The actuator can have a current sensor incorporated therewith so that the actuator outputs its current draw (e.g., amperage).

In some embodiments, the system can automatically deploy and/or retract the platform (e.g., without receiving commands from the user). For example, the system can automatically deploy the platform below a threshold speed, and/or can automatically retract the platform above a threshold speed. The system be configured to receive user input to enable or disable the automatic operation of the movable platform. When actively engaged in wakeboarding or wake surfing, the platform can be stowed when the boat is moving above a threshold speed and a rider is riding behind the boat. When the rider falls, the drive can turn the boat and reduce speed to return to the fallen rider. In response to the reduced speed, the system can deploy the movable platform. In some cases, the rider may exit the water and return to the boat, and the deployed platform would be ready to aid the rider. In some cases, the rider may not use the deployed platform and may stay in the water to engage in another ride. When the boat speed increases to start the next ride, the increased speed can cause the platform to move the stowed position. In some cases, the system can have a user interface that enables the user to indicate if the boat is being used for wakeboarding, or wake surfing, cruising, or other activities. The system can enable or disable automatic operation of the movable platform based on the indicated activity (e.g., enabled for wakeboarding and wake surfing, but disabled for cruising).

In some embodiments, a latching mechanism can be used to lock the movable platform in place. For example, if a user wants to keep the platform in the stowed position, the latch mechanism can be engaged to secure the movable platform. The latch mechanism can reduce vibrations or noise from the movable platform. The latch mechanism can take load off of the actuator, joints, and/or other couplings relating to the movable platform. The swim deck and the movable platform can have anti-slip, or soft-touch material, so that when the platform is stowed, the soft materials can touch to impede vibrations or noise from the movable platform.

In some cases, the movable platform can be used as a seat, such as for sitting partially submerged in the water. The movable platform and/or the swim deck can have cup holders (not shown) built therein. The movable platform can have seat indentations configured to fit a seated person on the platform.

Although various embodiments are disclosed in connection with water-sports boats, various features and systems disclosed herein can be used on various types of watercraft (e.g., cruisers, runabouts, pontoon boats, personal watercraft, and the like).

Terminology

Although this disclosure has been described in the context of certain embodiments and examples, a person of ordinary skill in the art would recognize, after reviewing the disclosure herein, that any embodiment disclosed can be combined with other embodiments, portions/aspects of other embodiments, and/or technologies known in the art to accomplish the desired advantages discussed herein. It will be understood by those skilled in the art, after reviewing the disclosure herein, that the disclosure extends beyond the specifically disclosed embodiments to other alternative embodiments and/or uses and obvious modifications and equivalents thereof. In addition, while several variations of the embodiments of the disclosure have been shown and described in detail, other modifications, which are within the scope of this disclosure, will be readily apparent to those of skill in the art after reviewing the disclosure herein. It is also contemplated that various combinations or sub-combinations of the specific features and aspects of the embodiments may be made and still fall within the scope of the disclosure. For example, features described above in connection with one embodiment can be used with a different embodiment described herein and the combination still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this invention may comprise, additional to its essential features described herein, one or more features as described herein from each other embodiment of the invention disclosed herein.

Wakes for wakeboarding and wake surfing can have different characteristics. A wake extends behind a water-sports boat as the water-sports boat travels forward through water. For wakeboarding, a symmetrical wake is desirable—meaning that a starboard side of the wake and a port side of the wake are generally symmetrical, which can form a V like shape behind the water-sports boat. The starboard side of the wake can have a front face and a back face. The port side of the wake can have a front face and a back face. The back faces of each of the starboard side and port side of the wake generally face each other while the front faces of each of the starboard side and port side of the wake generally face away from each other. The front faces of each of the starboard side and port side of the wake can be used by a wake boarder to leap into the air, like a ramp, which can include leaping from the front face of the starboard side to the front face of the port side. The front faces can be linear to exponential in shape with an exponential shape providing additional pop as the wakeboarder launches off the front face into the air.

For wake surfing, an asymmetrical wake is desirable—meaning that the starboard side of the wake and the port side of the wake are not symmetrical. One of the starboard side of the wake or the port side of the wake has a front face that is smooth, called a wave, for surfing while the other front face of the other side is turbulent. The wave (e.g., the smooth front face) can have a linear to exponential shape. An exponential shape can be generally preferred as it propels the wake surfer with suitable speed.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate after reviewing the disclosure herein that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize, after reviewing the disclosure herein, that the disclosure may be embodied or carried out in a manner that achieves one advantage or a group of advantages as taught herein without necessarily achieving other advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The term "and/or" has similar meaning in that when used, for example, in a list of elements, the term "and/or" means one, some, or all of the elements in the list, but does not require any individual embodiment to have all elements.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

Values and ranges of values disclosed herein are examples and should not be construed as limiting. The values and ranges of values disclosed herein can be altered while gaining the advantages discussed herein. The listed ranges of values disclosed herein can include subsets of ranges or values which are part of this disclosure. Disclosed ranges of values or a single value for one feature can be implemented in combination with any other compatible disclosed range of values or value for another feature. For example, any specific value within a range of dimensions for one element can be paired with any specific value within a range of dimensions for another element. One of ordinary skill in the art will recognize from the disclosure herein that any disclosed length of a spar may be combined with any disclosed width of a foil, each having any disclosed shape.

Any methods disclosed herein need not be performed in the order recited. The methods disclosed herein include certain actions taken by a practitioner; however, they can also include any third-party instruction of those actions, either expressly or by implication. For example, actions such as "controlling a motor speed" include "instructing controlling of a motor speed."

All of the methods and tasks described herein may be performed and fully automated by a computer system. The computer system may, in some cases, include multiple distinct computers or computing devices (e.g., physical servers, workstations, storage arrays, cloud computing resources, etc.) that communicate and interoperate over a network to perform the described functions. Each such computing device typically includes a processor (or multiple processors) that executes program instructions or modules stored in a memory or other non-transitory computer-readable storage medium or device (e.g., solid state storage devices, disk drives, etc.). The various functions disclosed herein may be embodied in such program instructions, and/or may be implemented in application-specific circuitry (e.g., ASICs or FPGAs) of the computer system. Where the computer system includes multiple computing devices, these devices may, but need not, be co-located. The results of the disclosed methods and tasks may be persistently stored by transforming physical storage devices, such as solid state memory chips and/or magnetic disks, into a different state. In some embodiments, the computer system may be a cloud-based computing system whose processing resources are shared by multiple distinct business entities or other users.

The various illustrative logical blocks and modules described in connection with the embodiments disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can include electrical circuitry or digital logic circuitry configured to process computer-executable instructions. In another embodiment, a processor includes an FPGA or other programmable device that performs logic operations without processing computer-executable instructions. A processor can also be implemented as a combination of computing devices, e.g., a combination of a DSP and a microprocessor, a plurality of microprocessors, one or more microprocessors in conjunction with a DSP core, or any other such configuration. A computing environment can include any type of computer system, including, but not limited to, a computer system based on a microprocessor, a mainframe computer, a digital signal processor, a portable computing device, a device controller, or a computational engine within an appliance, to name a few.

The steps of a method, process, or algorithm described in connection with the embodiments disclosed herein can be embodied directly in hardware, in a software module stored in one or more memory devices and executed by one or more processors, or in a combination of the two. A software module can reside in RAM memory, flash memory, ROM memory, EPROM memory, EEPROM memory, registers, hard disk, a removable disk, a CD-ROM, or any other form of non-transitory computer-readable storage medium, media, or physical computer storage known in the art. An example storage medium can be coupled to the processor such that the processor can read information from, and write information to, the storage medium. In the alternative, the storage medium can be integral to the processor. The storage medium can be volatile or nonvolatile. The processor and the storage medium can reside in an ASIC.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Additionally, all publications, patents, and patent applications mentioned in this specification are herein incorporated by reference to the same extent as if each individual publication, patent, or patent application was specifically and individually indicated to be incorporated by reference.

What is claimed is:

1. A swim deck positioned proximate a stern of a recreational boat, the swim deck comprising:

a top surface including a horizontal portion;

a bottom surface including a horizontal portion;

a platform configured to move back and forth between a stowed position and a deployed position, a first portion of the platform located above the horizontal portion of the bottom surface of the swim deck in the stowed position, a second portion of the platform located below the horizontal portion of the top surface of the swim deck in the deployed position, wherein the first portion is opposite the second portion and wherein the first and second portions include grip material configured to impede a user from slipping;

a gear assembly including gears, the gear assembly configured, when activated in a first direction, to move the platform between the stowed position and the deployed position, and the gear assembly configured, when activated in a second direction, to move the platform between the deployed position and the stowed position;

a gear cover housing the gear assembly;

a powered actuator operably linked to the gear assembly through the gear cover, the actuator configured to activate the gear assembly;

a release mechanism configured to decouple the platform from the powered actuator to enable manual movement of the platform between the deployed and stowed positions; and at least one safety feature configured to provide at least one of an audio or visual alarm when the platform is not in the stowed position and the boat is at least one of ready for powered movement, moving under power, or moving under power above a predetermine speed.

2. A deployable platform of a swim deck positioned proximate a stern of a boat configured for recreation, the deployable platform comprising:

a platform configured to move back and forth between a stowed position and a deployed position, a first portion of the platform located above a bottom surface of a swim deck in the stowed position, a second portion of the platform located below a top surface of the swim deck in the deployed position, wherein the first portion is opposite the second portion; and gears configured to move the platform between the stowed position and the deployed position or between the deployed position and the stowed position.

3. The deployable platform of claim 2, further comprising a powered actuator configured to drive the gears to move the platform.

4. The deployable platform of claim 3, wherein the powered actuator is electric or hydraulic.

5. The deployable platform of claim 3, wherein the powered actuator is an electric hydraulic actuator.

6. The deployable platform of claim 3, further comprising a dampener.

7. The deployable platform of claim 6, wherein the powered actuator is configured to drive the gears through a majority of motion of the platform and the dampener is configured to drive the gears through a remainder of motion of the platform.

8. The deployable platform of claim 3, further comprising a switch configured to activate the powered actuator, the switch configured to be held to move the platform and released to stop movement of the platform.

9. The deployable platform of claim 2, wherein the gears are configured to be manually driven to move the platform.

10. The deployable platform of claim 3, further comprising a release mechanism configured to prevent the powered actuator from moving the platform.

11. The deployable platform of claim 10, wherein the release mechanism is configured to decouple the powered actuator from the gears such that the powered actuator cannot drive the gears to move the platform.

12. The deployable platform of claim 10, wherein the release mechanism is configured to decouple the gears from the platform such that the gears cannot move the platform.

13. The deployable platform of claim 10, wherein the release mechanism is configured to release the powered actuator to prevent the powered actuator from moving the platform.

14. The deployable platform of claim 2, wherein the gears comprise three or more gears.

15. The deployable platform of claim 2, wherein the gears comprise two or more gears.

16. The deployable platform of claim 2, further comprising a cover configured to cover the gears.

17. The deployable platform of claim 16, wherein the cover comprises an access opening through which one or more of the gears can be accessed.

18. The deployable platform of claim 16, wherein the cover is substantially watertight.

19. The deployable platform of claim 2, wherein the gears are not disposed on a centerline of the boat.

20. A boat configured for recreation, the boat comprising:

a deployable platform of a swim deck positioned proximate a stern of the boat, the deployable platform comprising:

a platform configured to move back and forth between a stowed position and a deployed position, a first portion of the platform located above a bottom surface of the swim deck in the stowed position, a second portion of the platform located below a top surface of the swim deck in the deployed position, wherein the first portion is opposite the second portion; and gears configured to move the platform between the stowed position and the deployed position or between the deployed position and the stowed position.

21. The boat of claim 20, further comprising one or more mechanical stops to limit movement of the platform.

22. The boat of claim 20, further comprising a camera configured to capture a view of the swim deck and deployable platform to display to an operator of the boat.

23. The boat of claim 20, further comprising an engine, the engine configured to not start with the platform not in the stowed position.

24. The boat of claim 20, wherein the boat is configured to provide at least one of an audio or visual alarm when the platform is not in the stowed position and the boat is at least one of ready for powered movement, moving under power, or moving under power above a predetermine speed.

25. The boat of claim 20, further comprising an engine, the engine configured to not drive movement of the boat with the platform not in the stowed position.

26. The boat of claim 20, further comprising an engine, the engine configured to not drive the boat above a certain speed with the platform not in the stowed position.

27. The boat of claim 20, wherein the deployable platform comprises a shear point configured to enable the platform to break away from the swim deck upon a certain force being exerted on the platform.

28. The boat of claim 20, further comprising a strain gauge configured to detect a strain on the platform, wherein the boat can limit or stop movement of the boat based on the strain on the platform.

29. A method of improving ingress from water into a boat configured for recreation and egress from the boat into the water, the method comprising:

moving a platform from a stowed position to a deployed position with gears, a first portion of the platform located above a bottom surface of a swim deck in the stowed position, a second portion of the platform located below a top surface of the swim deck in the deployed position, wherein the first portion is opposite the second portion.

* * * * *